US005372560A

United States Patent [19]

Chang

[11] Patent Number: 5,372,560

[45] Date of Patent: Dec. 13, 1994

[54] MULTI-FUNCTIONAL SPORTING EQUIPMENT

[76] Inventor: John Chang, No. 1-2, Lane 975, Chun-Jih Road, Tao-Yuan City, Taiwan, Prov. of China

[21] Appl. No.: 156,733

[22] Filed: Nov. 24, 1993

[51] Int. Cl.[5] ..... A63B 22/00

[52] U.S. Cl. ..... 482/54; 482/51; 482/57; 482/58; 482/70; 482/72

[58] Field of Search ..... 482/51, 54, 57, 70, 482/79, 58, 59, 72

[56] References Cited

U.S. PATENT DOCUMENTS

| | | | |
|---|---|---|---|
| 3,637,206 | 1/1972 | Chickering, III | 482/54 |
| 3,738,649 | 6/1973 | Miller | 482/57 |
| 4,204,673 | 5/1980 | Speer, Sr. | 482/54 |

FOREIGN PATENT DOCUMENTS

| | | | |
|---|---|---|---|
| 8505280 | 12/1985 | WIPO | 482/57 |

*Primary Examiner*—Stephen R. Crow
*Assistant Examiner*—Lynne A. Reichard
*Attorney, Agent, or Firm*—Morton J. Rosenberg; David I. Klein

[57] ABSTRACT

A multi-functional sporting equipment comprises a front housing, a rear housing which can be folded up to the front housing while not in use. A slidable housing is slidable on the front housing. A pair of parallel rail disposed at the front and rear housing. A storage box disposed at sides of front housing and a pedal stored at the rear housing. A plurality of training equipments are disposed and stored in a proper position of the housing. Thereby, no interference will occur between equipment pieces during exercise. This is a multi-functional sporting equipment. The rear housing can be folded to a box. On the other hand, a cast and handle 191 are provided and the sporting equipment can be easily moved to proper position.

12 Claims, 44 Drawing Sheets

MULTI-FUNCTIONAL SPORTING EQUIPMENT

BACKGROUND OF THE INVENTION

This invention relates to a sporting equipment and, more particularly, to a multi-functional sporting equipment which integrates with functions of a plurality of individual sporting equipments to facilitate different kinds of sport within a single unit.

There are many kind of sporting equipment and the customer can use it for indoor exercise, such as running equipment, rowing-boat equipment, ski equipment, body build-up equipment, waist twisting equipment . . . etc. On the other hand, the so called multi-functional equipment means a plurality of functions can be integrated to a single unit. But, despite of a single sporting equipment or a multi-functional sporting equipment, there can be concluded with the following defects.

1) Most of the sporting equipment has a single and designated function and can not used for other applications. For example, a running can only be utilized as a running equipment, which can be utilized for other sport, such as a ski equipment. In light of this, their function are limited. If the user hopes to do sporting exercise other than running, a new sporting equipment shall be bought. Not only will this increase the sporting cost of the user, but also will the equipment take a large of space. Not every people can afford the cost and space easily.

2) Even the now existing multi-functional sporting equipment can provide a plurality of functions which are achieved by integrating a plurality of sporting equipment into a single unit, it has a very complicated configuration. Since those added sporting equipment can not be stored while they are not in use, the sporting space for a single sporting will be seriously blocked. Hence a plurality of limitations are exposed to the user. The sporting effect is largely spoiled.

3) The now existing multi-functional equipment has a very large size and it needs a comparative large space. On the other hand, it has heavy weight as well. Most of all, all the added equipment as fixed onto it, they can not be disassembled and stored into the unit while there are not in use. It become a great headache while the unit is not in use. These above described defects are inevitable for a sole-functional equipment or a multi-functional equipment.

SUMMARY OF THE INVENTION

It is the object of this invention to provide a multi-functional sporting equipment which integrated with a plurality of sporting functions within a single unit.

It is still the object of this invention to provide a multi-functional sporting equipment which integrated with a plurality mechanisms which can be assembled and arranged to different sporting equipment in a very simple way.

It is still the object of this invention to provide a multi-functional sporting equipment wherein all the mechanism incorporated therein can be stored into a single box. No limitations and blockage will be exposed to the mechanism in use.

It is still the object of this invention to provide a multi-functional equipment wherein the operation or movement of incorporated mechanisms are manually actuated. It provides extremely save and quiet operations.

BRIEF DESCRIPTION OF THE DRAWINGS

The structural and operational characteristics of the present invention and its advantages as compared to the known state of the prior art will be better understood from the following description, relating to the attached drawings which show illustratively but not restrictively an example of a multi-functional sporting equipment.

In the drawings:

FIG. 37A is an enlarged cross-sectional view of a portion of the extending lever showing an elastic pin member and upper lever interface;

FIG. 54 is a rear view showing the pedal member erected from the rear housing;

FIG. 56 is a rear view showing a controlling means is erected from the rear housing;

FIG. 56A is an enlarged cross-sectional view of a portion of the controlling means showing a knob interface with a clip ring;

DETAILED DESCRIPTION OF PREFERABLE EMBODIMENTS

Figure 1:
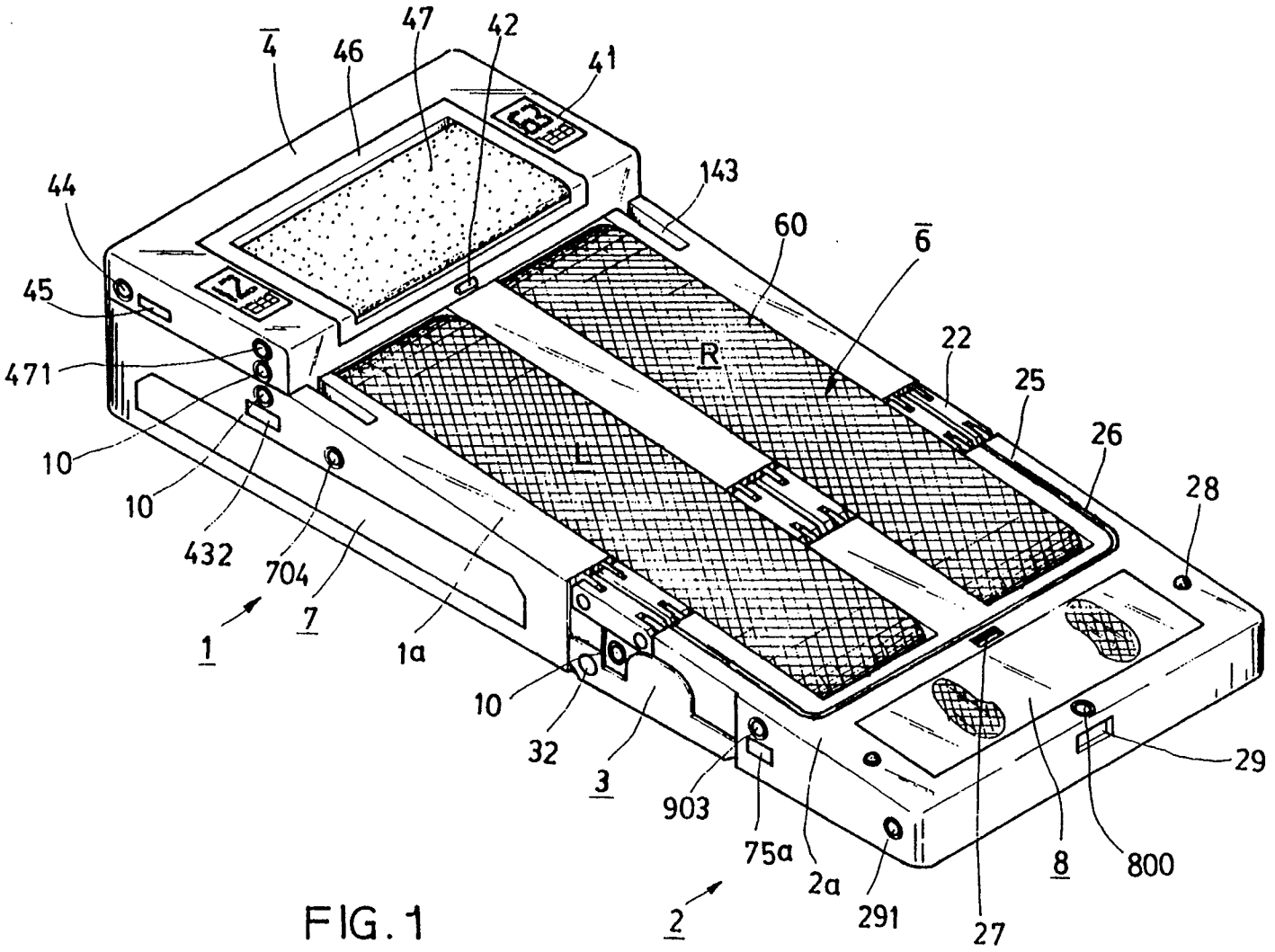
FIG. 1 is a perspective view of a multi-functional equipment made according to this invention.

Referring to FIG. 1, a perspective view of a multi-functional sporting equipment. The multi-functional sporting equipment made according to this invention comprises a front housing 1, a rear housing, a bottom protecting cover 3, a sliding housing 4, a running mechanism 6, a storage box 7 and a pedal assembly 8. A twin rack running sporting equipment can be constructed on said housing and there are many other kind of sporting equipments are stored beneath the storage box 5, pedal assembly 7 and sliding housing 4. Said rear hosing 2 is hinged to said front hosing 1 and can be folded onto said front housing 1. By this arrangement, a rectangular box is formed to decrease the space needed for storage.

Figure 2:
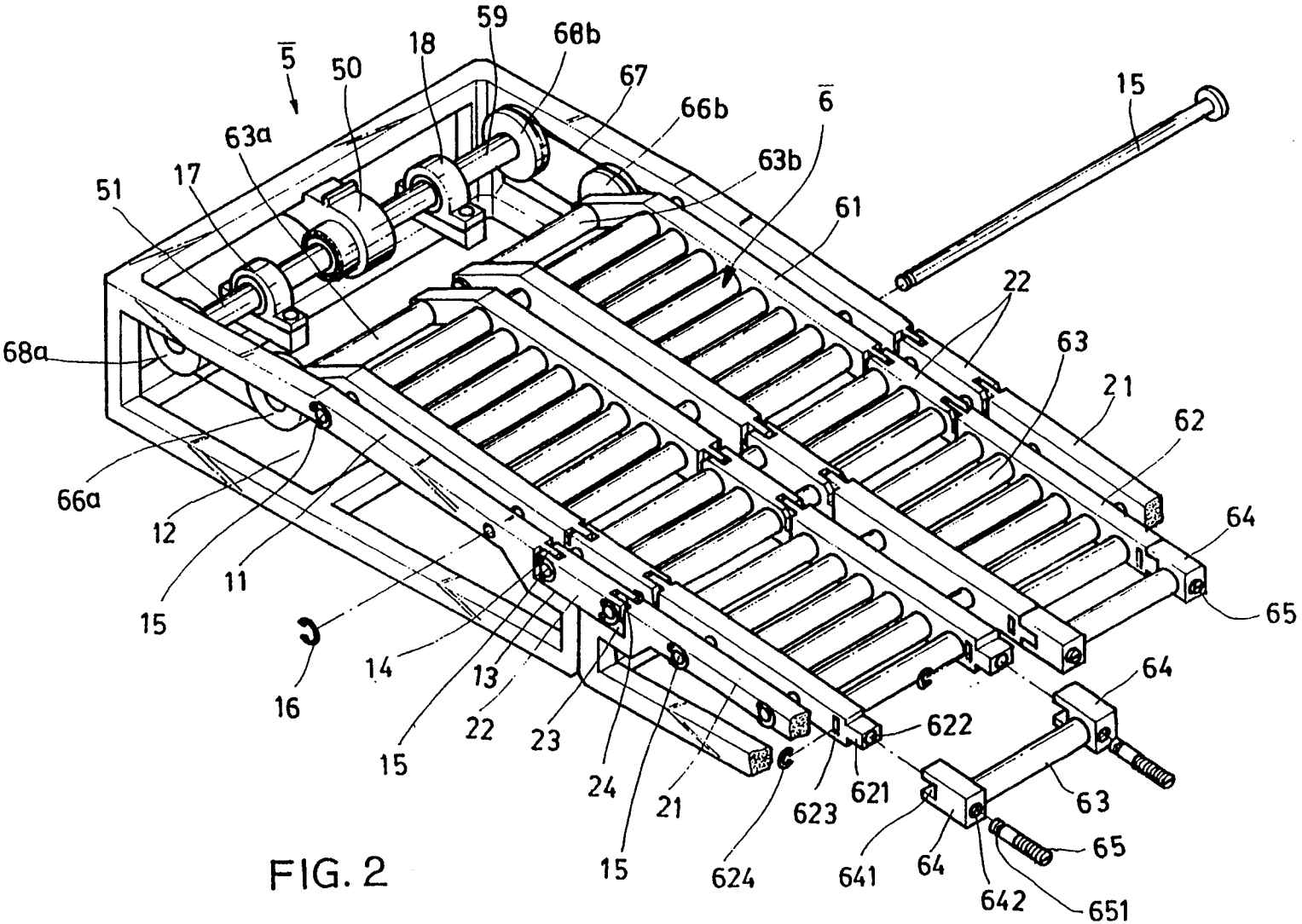
FIG. 2 is a perspective view of the truss of a multi-functional sporting equipment.

Referring to FIG. 2, the front housing 1 comprises front frame 11 covered with a cover 1*a* (shown in FIG. 1). Said frame 11 has a hollow portion 12 thereof for receiving a storage box 7. A recessed portion 13 is disposed at the rear portion having a lug member 14 thereof.

Said rear housing 2 comprises a rear frame 21 covered with a cover 2*a* (as shown in FIG. 1). A lug member 24 respected to said lug 14 of front housing 1 is disposed at the recessed portion 23 of said rear housing 2*a*.

Figure 5:
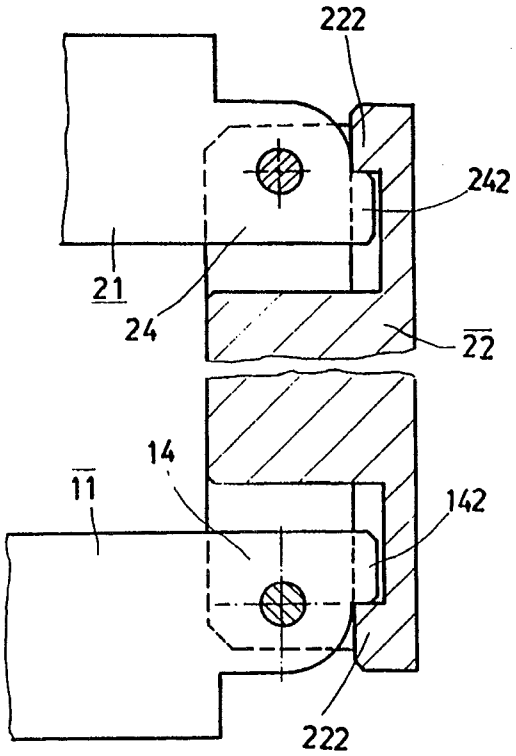
FIGS. 3 to 5 are a perspective view showing the structure of the connecting lever and their operation.
Figure 3:
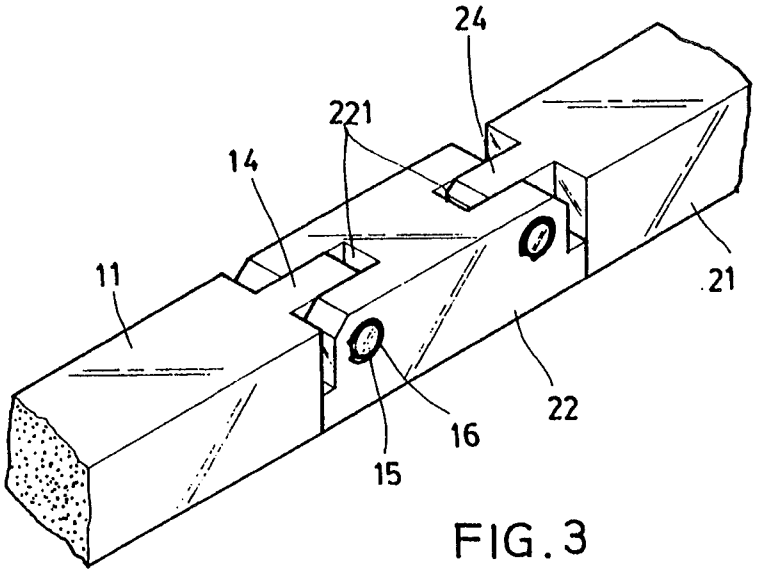
Figure 4:
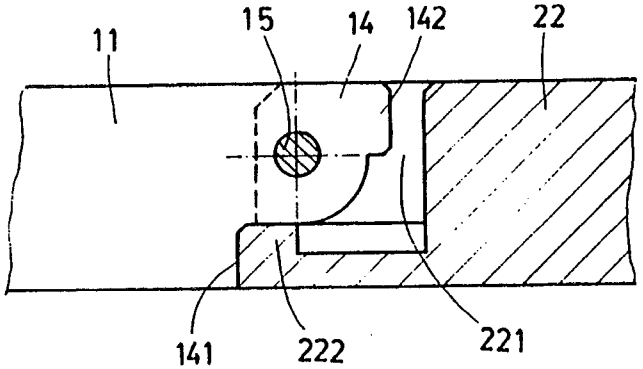

A connecting lever 22 disposed at the upper position of said recessed portions 13, 23 to connect the front housing 1 and rear housing 2. Referring to FIG. 2, a slot portion 221 is provided at the end portion of said connecting lever 22 for receiving said lug portion 13, 23. Then a shaft member 15 retained by a c-clip 16 is passed therethrough. As shown in FIG. 4, a projected block 222 is disposed in front of said slot 221. A recessed surface 141 with respect to said projected block 222 is provided at said lug portion 14. By this arrangement, said connecting lever 22 and said front housing 1, rear hosing 2 can be located in a horizontal position. On the other hand, a rectangular block 242 is provided at the front portion of said lug portion 14. As shown in FIGS. 3 and 5, when the rear frame 21 is folded toward said front housing 2, the projected block 242 of said lug portion 24 will butt against the projected block 222 of said connecting lever 22 and constituting a ninety (90) degrees contacting. When said connecting lever 22 is folded to another ninety (90) degrees, the lug portion 222 will butt against the block 142 of the lug portion 14 of front frame 11. By this arrangement, the rear frame 21 is folded onto said front housing 11. When the rear housing 21 is fully extended, a horizontal configuration is achieved.

Please refer to FIG. 2, when the front frame 11 and rear frame 21 are connected via the connecting lever 22, a pair of parallel juxtaposed supporting rack 61 are connected by said connecting lever 22 at their middle portion. In light of this, said supporting rack 62 can be folded into said supporting rack 61 when the rear frame 21 is folded. A plurality of rollers 63 are provided at said supporting rack 61. Said supporting rack 61 are attached to said front frame 11 and rear frame 21 via a plurality of connecting shaft 16 and fixed by a C-clip 16.

Besides, a projected portion 621 is formed at the rear portion of said supporting rack 61. A receiving hole 622 is provided at said projected portion 621. One side of said hole 622 is formed with a slot 623. A pair of adjusting block 64 connected by a roller 63. A receiving slot 641 is formed at said adjusting block 64 at the position aims to said projected block 621. A stud 65 is used to attach said adjusting block 64 onto said projected block 621. A ring slot 651 is provided at the tip of said stud 65. Said ring slot 651 passes said hole 622, a C-clip 642 will be applied to fix said stud 65. The engaging portion between said adjusting block 64 and said stud 65 is a threaded hole 642, by this arrangement, when the stud 65 rotates, the adjusting block 621 moves upward, the tension of the running belt 60 (as shown in FIG. 1) is then be adjusted.

Referring to FIG. 2, a pair of pulley 66*a*, 66*b* are disposed at the tip portion of the front roller 63*a*, 63*b*. Said pulley 66*a*, 66*b* are connected to the pulley 68*a*, 68*b* via a belt 67. Then this pulley 68*a*, 68*b* are connected respectively to a left rotating lever 51 and right rotating lever 59 of a transmission means 5. A controller 50 is provided at the transmission means 50 which is interconnected with a control panel 41 disposed at the sliding housing 4 (as shown in FIG. 1).

Figure 6:
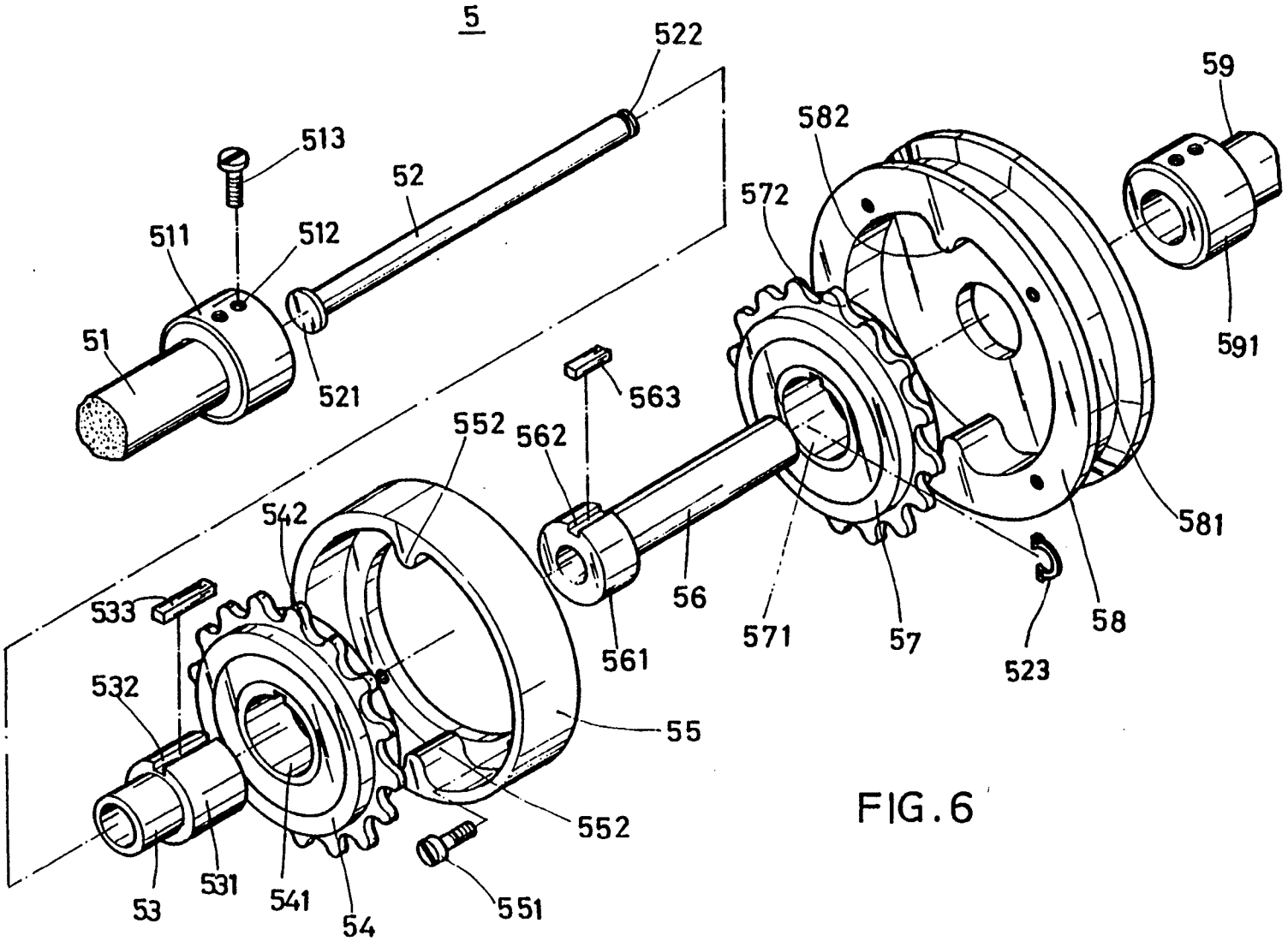
FIG. 6 is an exploded perspective view of a transmission of a multi-functional sporting equipment.
Figure 7:
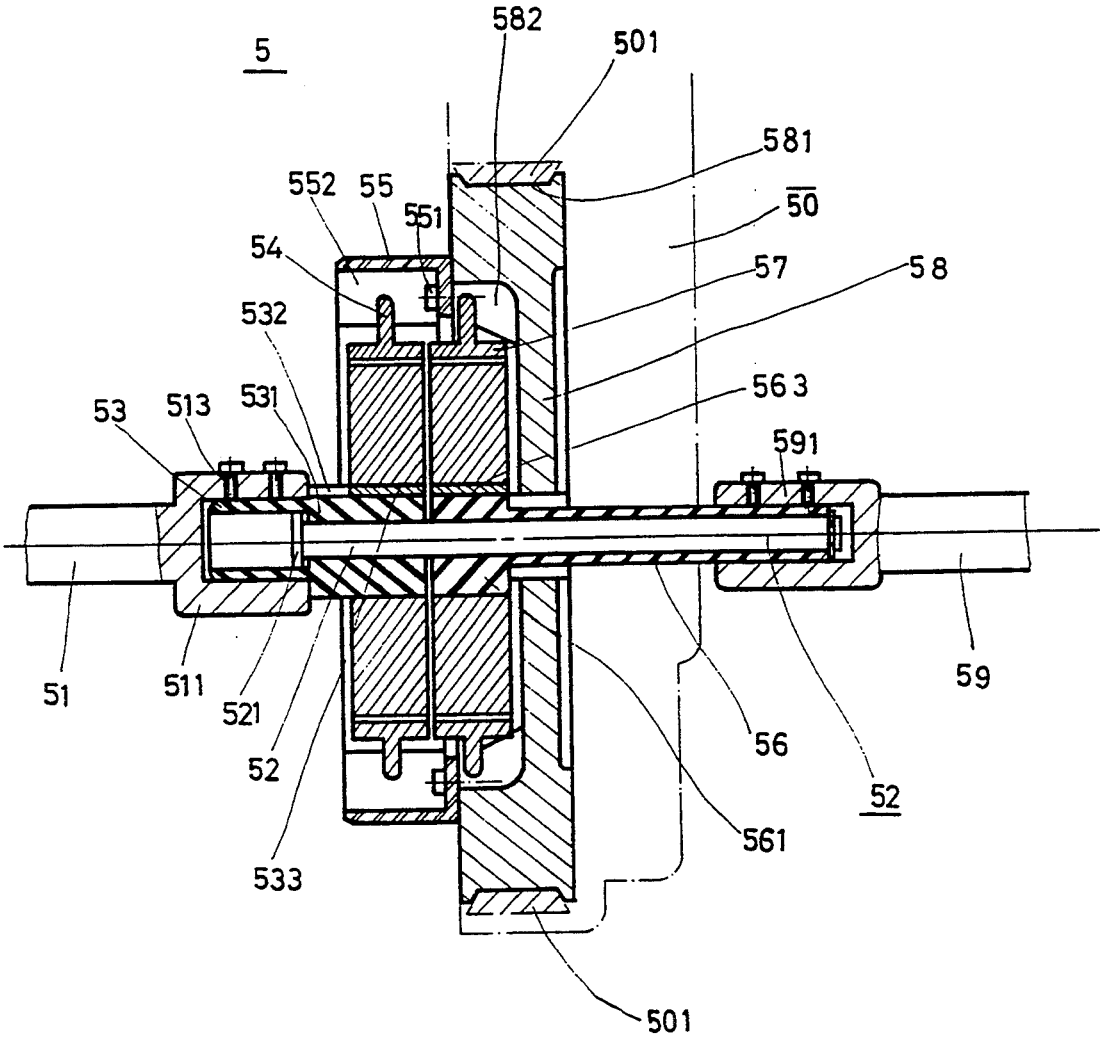
FIG. 7 is a cross sectional view of a transmission shown in FIG. 6.

Referring to FIGS. 6 and 7, the transmission means 5 comprises:

a left rotating lever 51 supported by a shaft housing 17 (shown in FIG. 2), a sleeve 511 is provided at the front portion, a threaded hole 512 and screw 513 are provided thereof;

a center shaft 52 has a rib portion 521 at end portion, a ring slot 522 is provided at the tail portion for receiving a C-clip 523;

a left rotating sleeve 53 is rotatably disposed at said shaft member 52, this left rotating sleeve 53 is fixed at said sleeve 511 of said left rotating lever 51 via a screw 513. A key slot 532 and a key member 523 is provided at the connecting end 531 with a large diameter;

a left rotated gear 54 which is incorporated with an one-way rotating means, this gear member 54 is connected to the connecting end 531 of said left rotating sleeve 53 by its hole 541 and fixed thereof by a key 523;

a left bushing 55 attached to side portion of right bushing 58 via a screw member 551, by this arrangement, the left bushing 55 will be retained at the gear slot 542 of said one way rotated gear 54 and be actuated thereof;

a right rotating sleeve 56 is rotatably disposed at the shaft member 52, the tail portion is attached to the sleeve member 591 of said right rotating lever 59, a key slot 562 and a key member 563 are provided at the connecting end 561;

a right rotated gear 57 which is incorporated with an one way rotating means, this gear member 57 is connected to the connecting end 561 of the right rotating sleeve 56 and fixed thereof by a key member 563;

a right bushing 58 has a slot portion 581 at its peripheral to form a connecting portion with said controller 50 (as shown in FIG. 7). A projected block 582 is provided at the inner rim portion, by this arrangement, the right rotating bushing 58 is attached to the gear slot 572 of said right rotated gear 57 and be actuated thereof.

By these above arrangement, a running equipment is modified and the distance which the runner runs can be accurately counted. The detailed operation of this running equipment will be better described below.

In order to prevent the L and R (left and right) tracks from interfering with each other while in operation, a unique transmission means 5 is used to count the distance of left and right respectively. Such as shown in FIGS. 1 and 2, the rotating lever 59 is supported by a shaft housing 18 and being actuated by the R track. When the right track operates, the right rotating lever 59 rotates as well. Since the shaft member 52 is idle there and can not transmit a rotation therefrom, the rotating shaft sleeve 591 will actuate the right rotating sleeve 56 to rotate on sand shaft 52. Then the right rotated gear 57 will rotate. Since the right rotated gear 57 is retained at the projected block 582 of said right bushing 58, the right bushing 58 rotates effectively. Besides, the right bushing 58 is disposed within a controller 50 which is interconnected with a control panel 41 (as shown in FIG. 1), in light of this, the distance which the runner runs can be accurately displayed on the control panel 41. The control panel 41 is affordable at the market or the control panel 41 disclosed at the "Multi-functional Adjustable Controller for Sporting Equipment" of Taiwan Utility Patent No. 69194 and U.S. Pat. No. 5,108,091. The right bushing 58 is a wheel for a controller, by provision of slot portion 581 of said right bushing 58, a braking rope 501 of controller 50 can be wound thereof to provide the load (resistance) of said right bushing 58.

When the right track moves, the right rotating lever 59, right rotating sleeve 56, right rotated gear 57 and right bushing 58 is rotated on said shaft 52, and it can be controlled with the load (resistance) thereof. Meanwhile, the left track is still thereof since the left leg is lifted up from said left track, hence the left rotating lever 51 and left rotating sleeve 53 is still as well. But since the left rotating bushing 55 is fixed at the right side of said right rotated bushing 58, hence it moves as well. Then the right rotated gear 54 is idle there as well. In light of this, the operation of right track will not interfere the operation of left track because the left and right rotating sleeve 53, 56 are coaxial but not interconnected. This arrangement provides a independent operation of the left track and right track. On the other hand, when the left track is operated, the left rotating lever 51, left rotated sleeve 53, left rotated gear 54 and left bushing 55 rotate clockwise. On the other hand, the left bushing 55 is attached to the right side of right bushing 58, the right bushing 58 is rotated clockwise as well. Then controller can count the distance accurately of left track. Then the distance counted from left track and right track will be added together and display this figure in the control panel 41. Besides, when the right busing 58 is actuated by the left bushing 55, the right rotated gear 57 is moved as well.

From the above description, even the left and right track are installed on a shaft member 52, but their mechanism are independent with each other. Only by the provision of this transmission means 5, the left track and right track will operate independent with each other and free from interference of each other. This provides a real running equipment.

Figure 8:
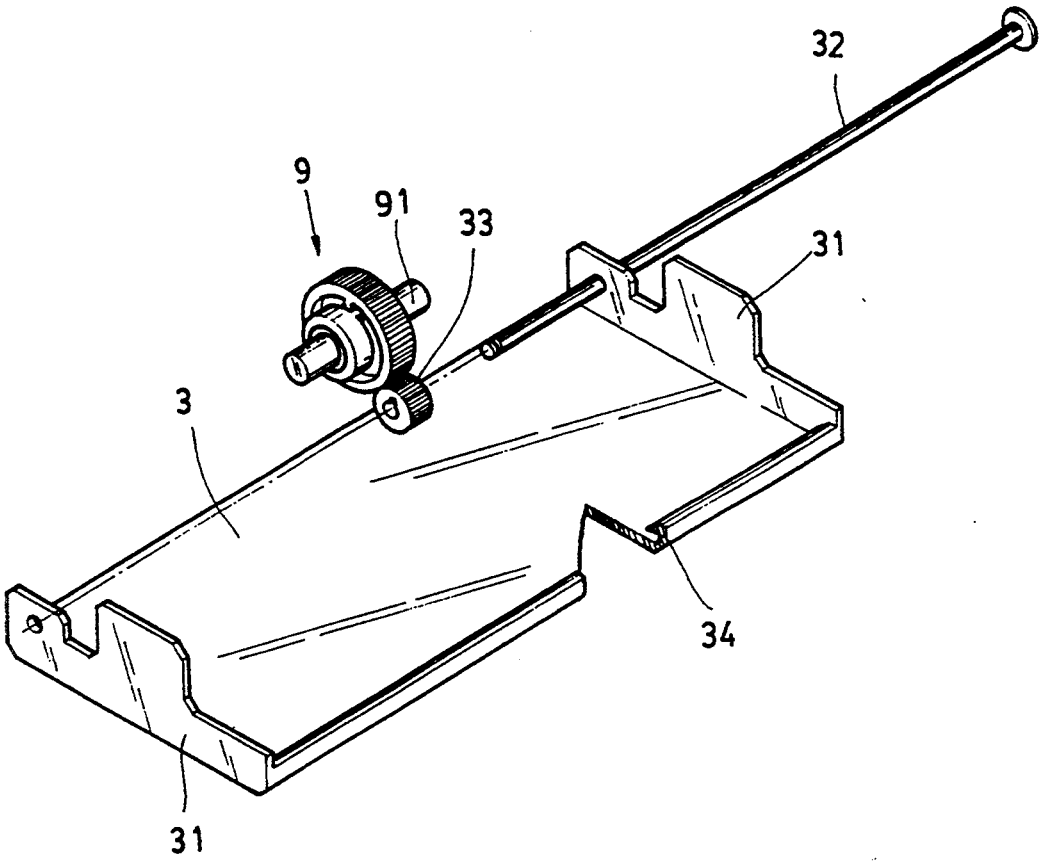
FIG. 8 is a perspective view of a bottom protecting cover.

Referring to FIGS. 1 and 8, the bottom protecting cover 3 is disposed at the bottom of the connecting portion of front housing 1 and rear housing 2. When the rear housing 2 is folded onto said front housing 1, a protecting surface will be formed therefrom. A folded edge portion 31 is formed at the edge of bottom protecting cover 3 and a shaft 32 is disposed thereof. A gear 33 is fixed at the middle portion of said shaft member 32 and controlled by an actuating device 9 meshed thereof. The shaft 91 of said actuating device 9 is installed at a suitable position of rear housing 2. Besides, a hook portion 34 is formed upward at the rear portion of said bottom protecting cover 3.

The detailed actuating device 9 will be described below with the accompanied FIGS. 10 to 13.

The actuating device 9 comprises a gear 92 having a stopper 921 at its inner rim portion, a projected block 931 is disposed at the front portion and a block 933 is provided at the central hole 932;

a first actuating member 93 is sleeved on the inner portion of said gear 92, a block 931 is provided at the front portion, a hole 932 is provided at the block 931 having a block 933 therein;

a second actuating member 94, this second actuating member 94 has a hole 941 having a key member 942 at its inner rim portion, the second member 94 has a smaller diameter at the front portion 943 which is received by the hole 932 of said first actuating member 93, a rib portion 944 is provided thereof;

a shaft member 91 for receiving the gear 92, the first actuating member 93 and the second actuating member 94, the shaft member 91 is disposed on a positioning plate 95 inside the housing;

a coiled spring member 96 is attached to the shaft member 91 at one end 961 and the other end 962 is attached to the positioning post 922 of the gear 92;

a spring member 97 is disposed at the outer side of said second actuating member 94, said spring member 97 is fixed to said shaft 91 via a C-clip 98 received at to the ring slot 911, this spring member 97 provides a biasing pressure to said second actuating member 94.

By the above described members, an effective actuating member 9 is assembled.

This assembled actuating member 9 can be applied to many applications to substitute the usage of an electric motor or spring. In utilization, the first actuating member 93 is pulled outward and the second actuating member 94 is moved outward accordingly. By the movement of the key member 942 along the key slot 912 of the shaft member 91, the block 931 of the first actuating member 93 will be released from the block 92 of the gear 92. Then the gear 92 can be rotated counterclockwise to actuate the coil spring 96 to preserve a suitable potential energy. After the potential energy is achieved, the first actuating member 93 is released and moved inward. Then the first actuating member 93 is biased by the second actuating member 94 which is biased by the spring member 97, and the first actuating member 93 is moved inside of the gear 92. By the energy released from the coiled spring 96, a clockwise torque is released from said gear 92, the accompanied gear 33 which is engaged with the gear 92 is then actuated by this torque (as shown in FIG. 8). In light of this, the actuating member 9 provides an actuating force to said accompanied gear 33. When the accompanied gear 33 is released from the applied force, the accompanied gear 33 is actuated by the torque released from the gear 92.

Figure 12:
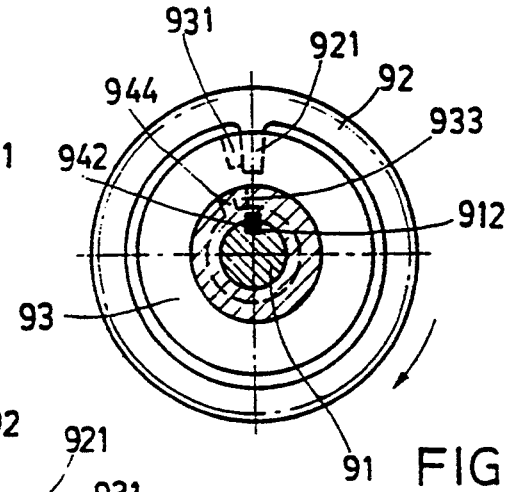
FIG. 12 is an other end view of an assembled actuating means from the 12—12 direction shown in FIG. 10.
Figure 13:
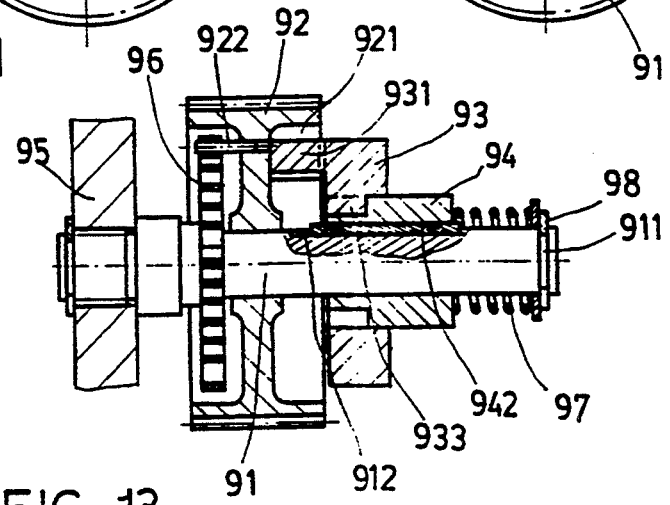
FIG. 13 is a cross sectional view of an actuating means shown in FIG. 10.

Since the actuating member 9 is special designed and the first actuating member 93 and second actuating member 94 can be rotated for two winds, as shown in FIG. 12, when the gear 92 moves toward three hundred and sixty degrees (360), the block 921 of the gear 92 will be stopped by the block 931 of the first actuating member 93. If the accompanied gear 33 is still out of preset position, the second actuating member 94 will provide a further assistance. When the gear 92 rotates near a circle, the first actuating member 93 will rotate on the second member 94. Then the block 944 of the second actuating member 94 will engage the block 932 of the first actuating member 93 and stop the rotation of the first actuating member 93. Since the second actuating member 94 is keyed on the shaft member 91, it can moves axially only. Then the gear 92 and the first actuating member 93 is stopped. By this kind of arrangement, the accompanied gear of the gear 92 will be actuated to rotate slowly and naturally without rotating quickly as actuated by the spring 96. In light of this, a safe and secure rotation is achieved by the provision of the actuating device 9. Hence, no added power such as electricity is needed for this sporting equipment. The sporting equipment can operate securely both in operation and even in storage.

Figure 9:
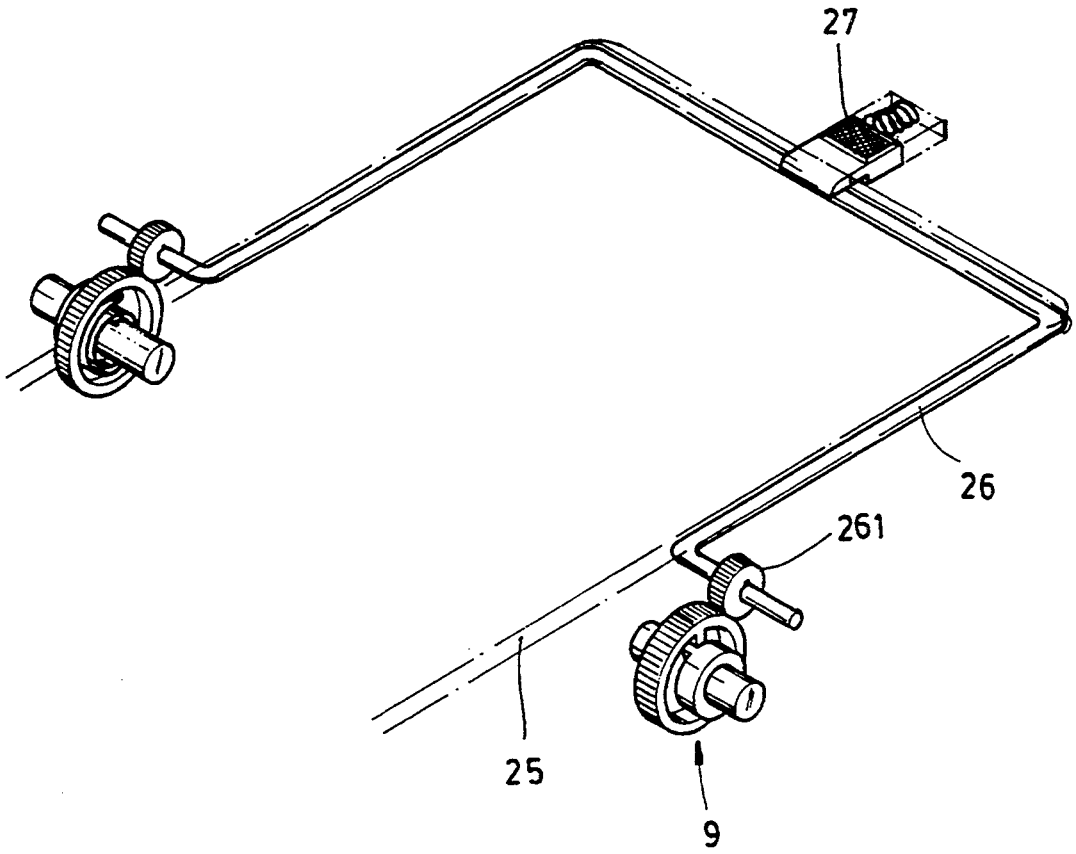
FIG. 9 is a perspective view of an U-shape actuating lever.
Figure 10:
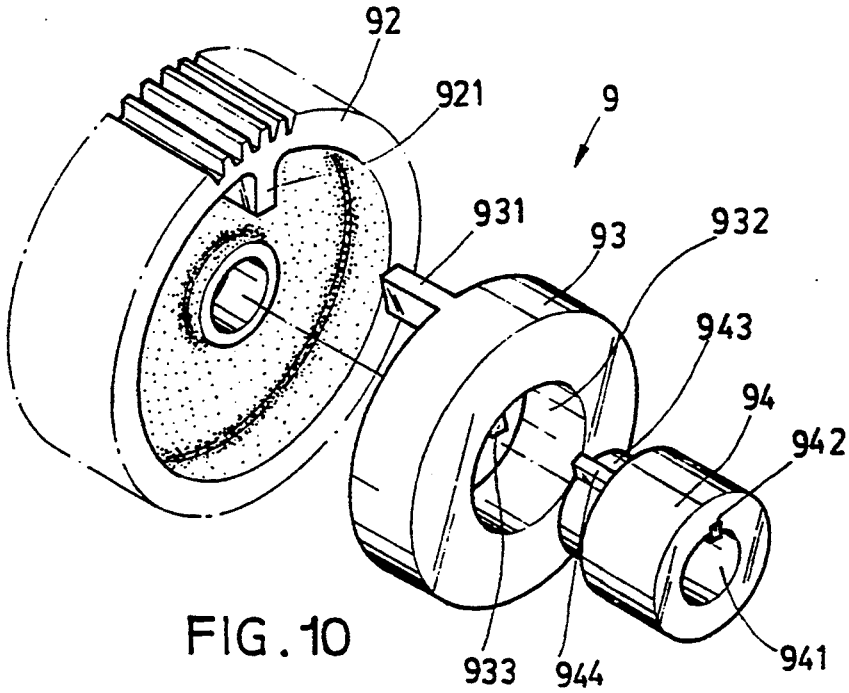
FIG. 10 is a perspective an actuating means of a multi-functional sporting equipment.
Figure 11:
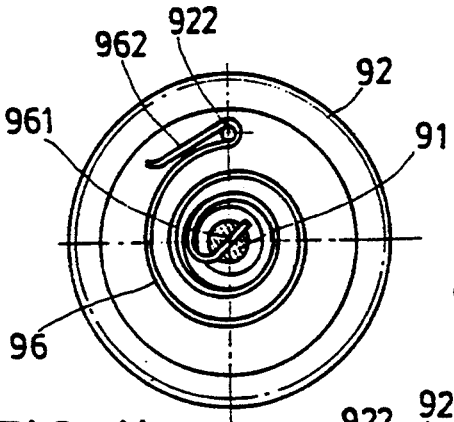
FIG. 11 is an end view of an assembled actuating means from the 11—11 direction shown in FIG. 10.

Referring to FIGS. 1 and 9, an U-shape slot 25 is provided at the rear portion of the rear housing 2. An U-shape frame 26 is received thereof. The end portions of the frame 26 is extended into the inner space of the rear housing 2. An accompanied gear 261 is provided at the U-shape frame 26. This accompanied gear 261 is meshed with an actuating device 9. In light of this, when the U-shape frame 26 is retracted into said U-shape slot 25, by rotation of the gear 261, the actuating device 9 is rotated to preserve a suitable energy. Hence, an actuating force is applied to the U-shape frame 26 from said actuating device 9. The U-shape frame 26 is then retained by a retaining plate 27 disposed at the rear housing 2.

Figure 14:
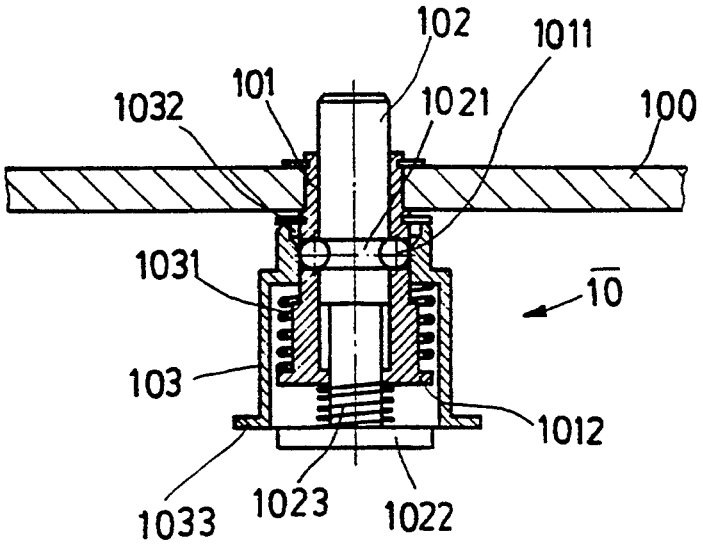
FIG. 14 is a cross section view of a positioning post wherein the positional post 102 is closed.
Figure 15:
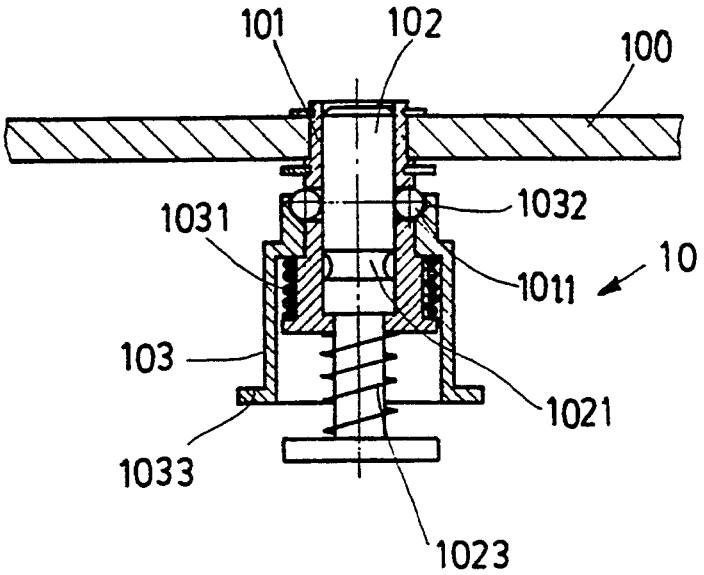
FIG. 15 is a cross section view of a positioning post wherein the positional post 102 is opened.

Referring to FIGS. 14 and 15, the positioning device 10 which has been widely applied to many application on this invention, comprises a tube member 101 disposed at a positioning member 100, there are holes provided at the middle portion for facilitating for steel balls 1011, then post member 101 has a projected edge portion 1012;

a central post member 102 received by said tube member 101, an annual slot portion 1021 is provided at the outer wall for receiving the ball 1011, this post member 102 has a projected edge portion 1022, a spring member 1023 is disposed inside said projected edge portion 1022 and biases to said projected edge 1012 of said tube member 101; and an adjusting tube 103 envelopes to the outer wall of the tube member 101, a spring member 1031 is disposed between the adjusting tube 103 and said tube member 101; an inclined slot portion 1032 is disposed at the front portion.

By assembling the above described members, the central post member 102 facilitating a positioning function.

As shown in FIG. 14, the central post 102 is projected to facilitating a positioning function. If the central post 102 needs to release from the fixed position, the adjusting tube 103 is pulled outward, then the slot 1032 is moved to the position of steel ball 1011. Since the post 102 is biased by the spring member 1023 and moves outward, then the bass 1011 is released from the slot 1021 toward the slot 1032.

Figure 16:
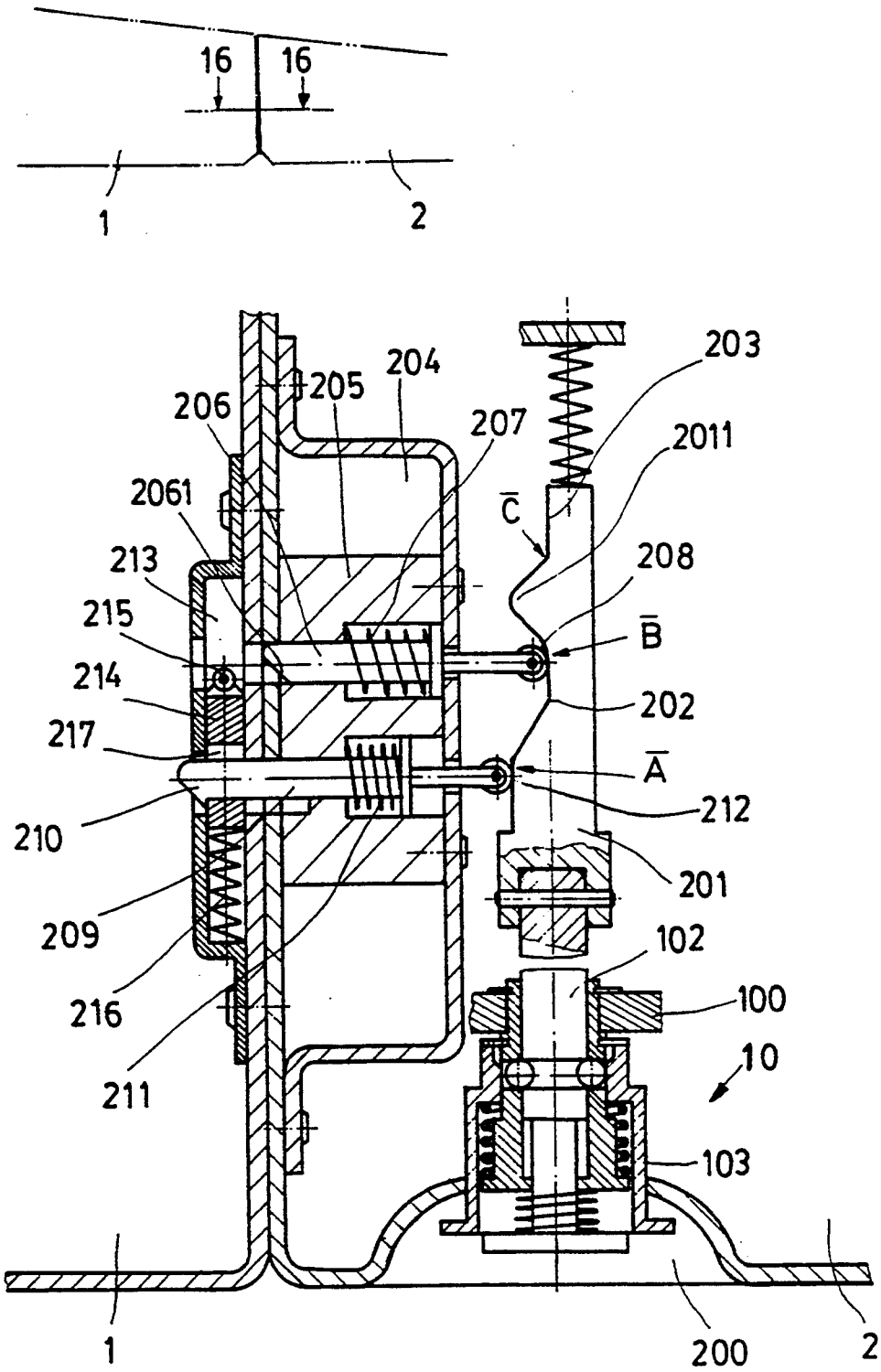
FIG. 16 is cross section view of a positioning post disposed between the front and rear housings, wherein the positional post 102 is closed.

As shown in FIG. 16, the engagement of the front housing 1 and rear housing 2 need the positioning device 10. Please refer to FIG. 1 as well, the positioning device 10 is disposed at the recessed portion 200 of the rear housing 2, an actuating plate 201 is disposed in front of said central post 102. Two recessed portions 202, 203 is formed at the actuating plate 201. A slot 204 is formed at the front portion of the rear housing 2. A block 205 having a pushing stick 206 is disposed at the slot 204. A spring member 207 is enveloped to the middle portion of said pushing stick 206. The rear portion of the pushing stick 206 has a roller 208 received by the recessed portion 202. A hooking stick 209 having a hooker 210 is disposed parallel with the pushing stick 206. A spring member 211 is enveloped at the middle portion. The rear portion is connected with a roller 212 biased toward the actuating plate 201. Besides, a sliding slot 213 is provided at the rear housing 1 with respective to said slot 204. A sliding block 214 is provided at the sliding slot 213. A roller 214 has a roller 215 and the rear portion has a spring 216. A retaining hole is provided at the middle portion of the sliding block 214. The hooker 210 of the hooking stick 209 is attached to the sliding block 214 facilitating the connection of the front housing 1 and the rear housing 2.

Figure 17:
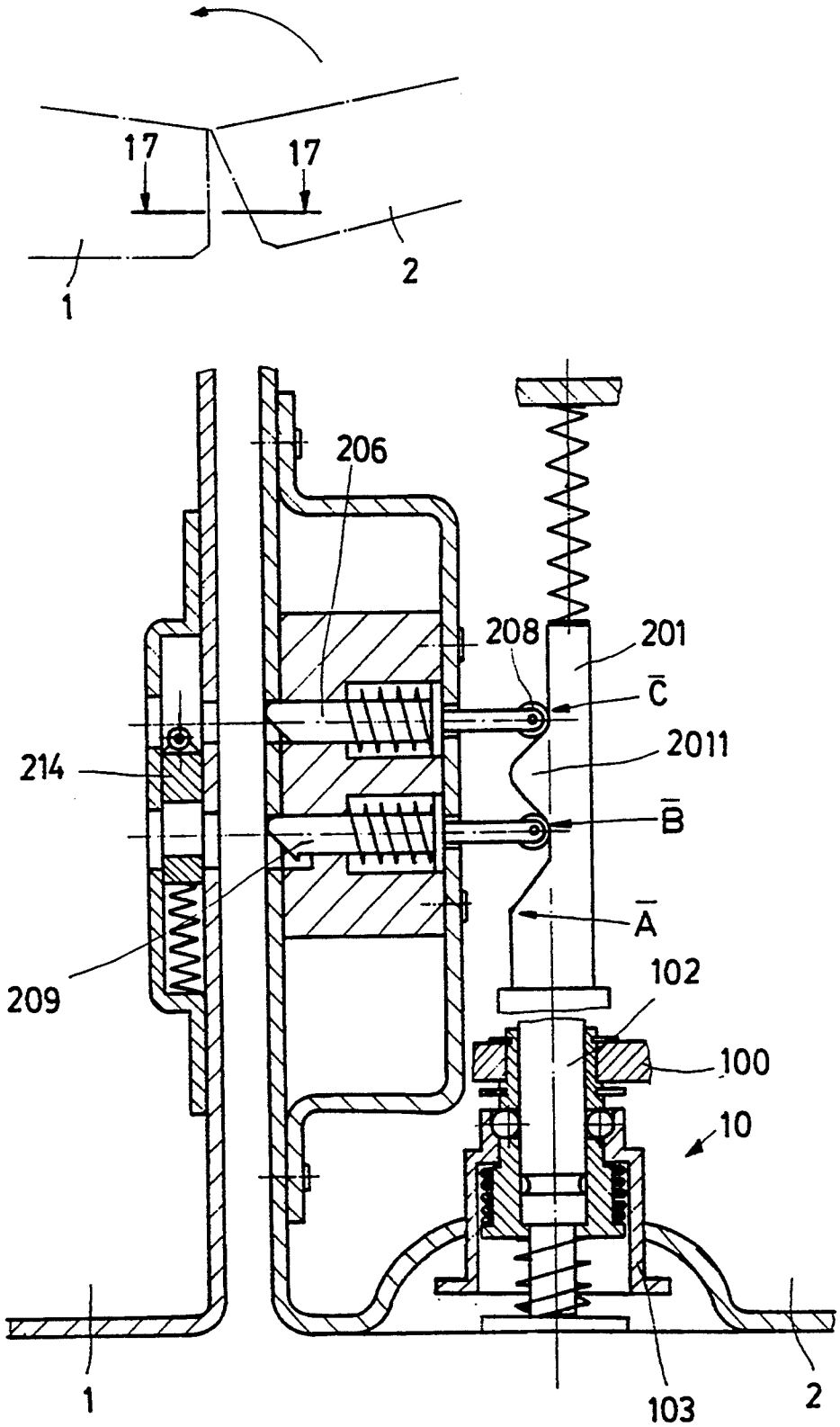
FIG. 17 is cross section view of a positioning post disposed between the front and rear housings, wherein the positional post 102 is opened.

If the user hopes to fold the rear housing 2 onto the front housing 1, they may firstly pull the adjusting tube 103 outward to make the retaining plate 201 move downward, then the pushing stick 206 is biased by the projected surface 2011 and move left. The inclined surface 2061 will press down the roller 215 to make the sliding block 214 downward. Then the hooker 210 of the hooking stick 209 will release from the retaining slot 217. The roller 212 then moves from the point A to point B. As shown in FIG. 17, the roller 208 of the pushing stick 206 moves from point B to C, the hooking stick 209 of the rear housing 2 is released from the sliding block 214 of the front housing 1. When this situation is achieved, the rear housing 2 is folded up to the front housing 1. If the user wants to use this sporting equipment, the positioning device 10 can be pushed to the original position, as shown in FIG. 16, then the front housing 1 and rear housing 2 is easily retained each other.

Figure 18:
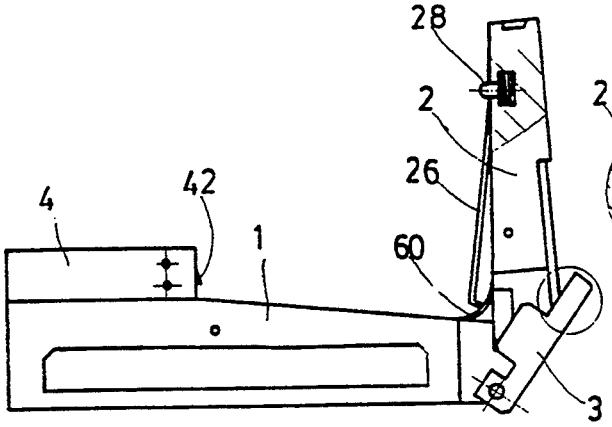
FIG. 18 is a sketch view showing the rear housing is folded.
Figure 18A:
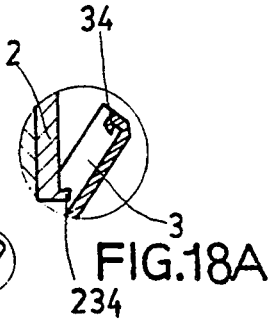
FIG. 18A is an enlarged cross-section of a portion of the rear housing showing a hooking portion.

Referring to FIGS. 18 to 20, FIGS. 1, 8 and 9. When the user hopes to fold up the rear housing 2, the retaining plate 27 shall be removed firstly, this will make the U-shape frame 26 be released therefrom. By virtue of the torque applied from actuating device 9, the gear 261 will be rotated smoothly and slowly to make the U-shape frame 26 mm one hundred and eighty (180) degrees, and then link against the running belt 60 (as shown in FIG. 18). The main function of this is to prevent the running belt 60 from loosing and further provide a retaining force to the running belt 60. On the other hand, an elastic block 28 is disposed above the rear housing 2. When the rear housing 2 is folded upon to the front housing 1, the elastic block 28 is retracted into the rear housing 2. Besides, a retaining slot 29 is disposed at the rear end portion of the rear housing 2, and the front portion of the sliding housing 4 is provided with a retaining block 42, when the rear housing 2 is folded onto the front housing 1, the retaining block 42 will be received by the retaining slot 29 to fix the rear housing 2. The structure of the retaining slot 29 will be better described latter. The function and operation of the bottom protecting cover 3 will be described below. This bottom protected cover 3 is pivoted to the front housing 1 via a shaft member 32 and the rear portion of it is a hooking portion 34. A hooker 234 is disposed at the rear housing 2 with respect to said hooking portion 34. When the rear housing 2 is folded upon the front housing 1, the hooker 234 will engage with said hooking portion 34. When this is done, the bottom protecting cover 3 is arranged to a vertical position. By this arrangement, a box is formed.

Figure 19:
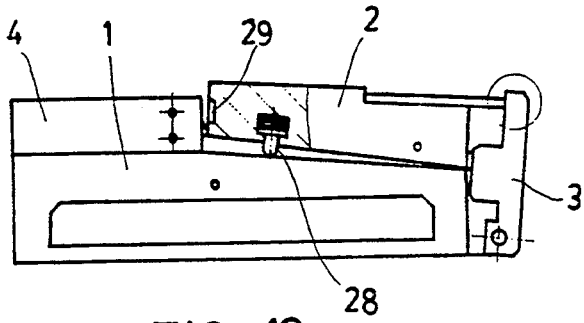
FIG. 19 is a sketch view showing the rear housing is folded toward the front housing.
Figure 19A:
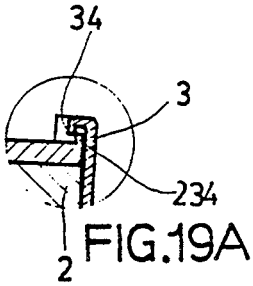
FIG. 19A is an enlarged cross-section of the rear housing showing the hooking portion in a hooked condition.
Figure 20B:
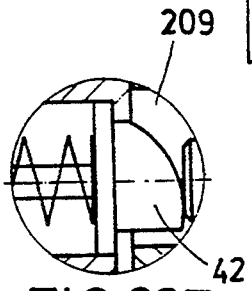
FIG. 20B is an enlarged cross-sectional view of a portion of the rear housing showing the retaining block.
Figure 20:
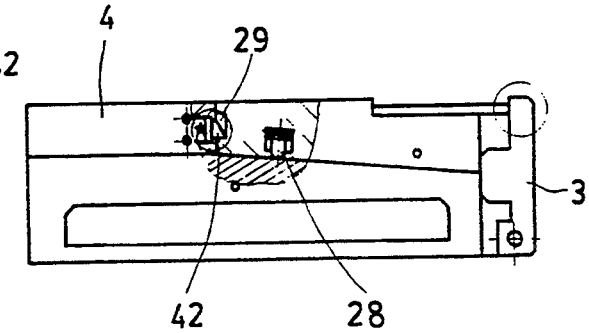
FIG. 20 is a sketch view showing the rear housing is folded to the rear housing.
Figure 20A:
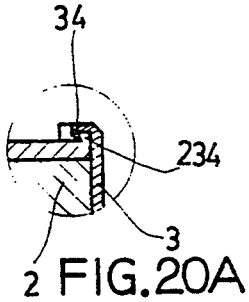
FIG. 20A is an enlarged view of a portion of the rear housing showing the hooking portion in a hooked manner.
Figure 21:
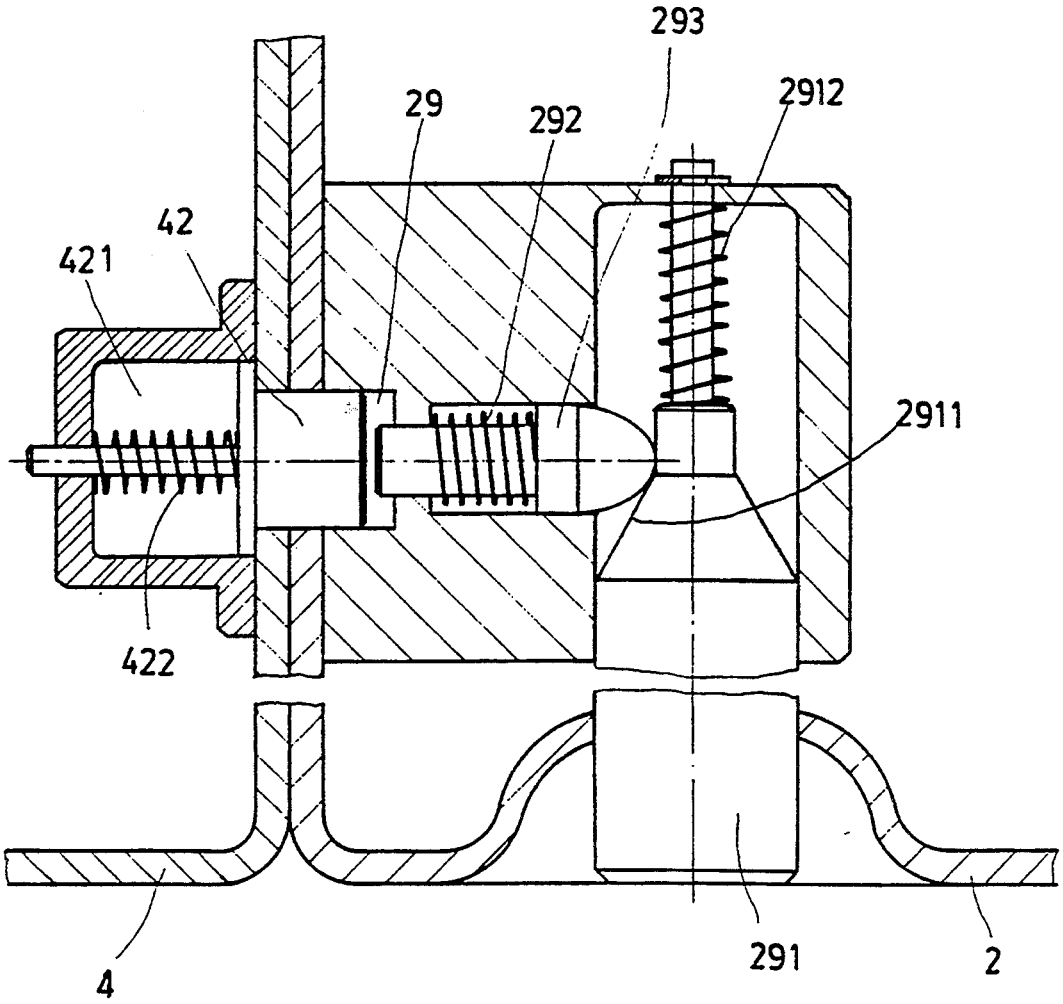
FIG. 21 is cross sectional view showing the rear housing and sliding housing.

Referring to FIG. 21, the top cross sectional view of a retaining slot 29, when the rear housing 2 is folded upon to the front housing 1, the retaining block 42 which is in front of the sliding housing 4 is received by the retaining slot 29 to fix the rear housing 2. When the rear housing 2 is released from the front housing 1, a push button 291 which locates at the side portion of the rear housing 2 is pressed to release the rear housing 2. This push button 291 has a cone portion 2911 at its front portion. When the push button 291 is pressed, an actuating lever 293 which is biased by a spring 292 is pressed to move toward left direction. Then the retaining block 42 is moved toward the space 421 of the retaining block 42. Besides, the retaining block 42 is biased by a spring 422 as well. When the push button 291 is restored to the original position by virtue of the spring 2912, the retaining block 42 is restored to its original position. Meanwhile, the rear housing 2 is biased by the spring force transferred from said elastic block 28 (as shown in FIG. 19) and forms an open position. On the other hand, the retaining block 42 is released from the retaining slot 29, in light of this, the rear housing 2 is readily extended to form a running equipment as shown in FIG. 1.

Figure 22:
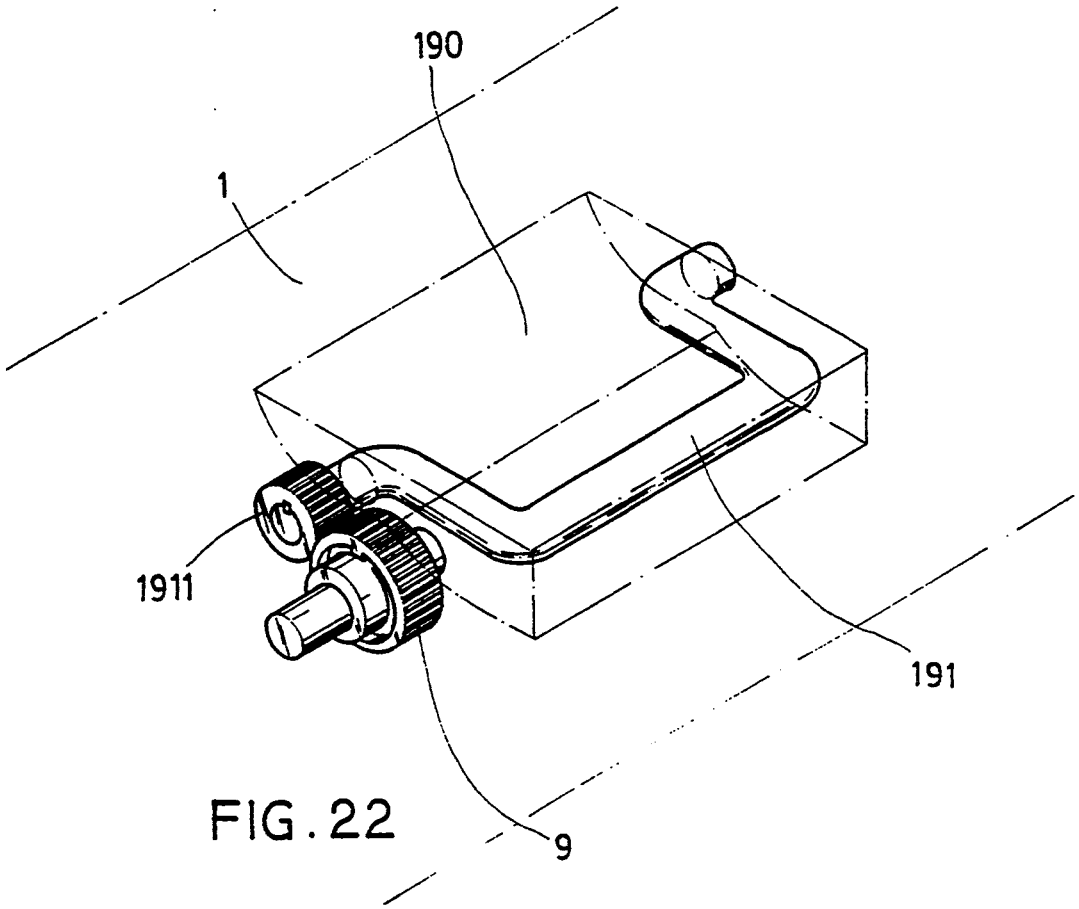
FIG. 22 is perspective view of a handle device.
Figure 23:
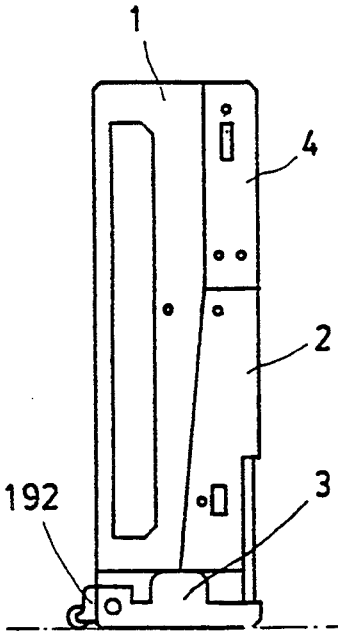
FIG. 23 is a sketch view showing the multi-functional sporting equipment is folded together for storage.
Figure 24:
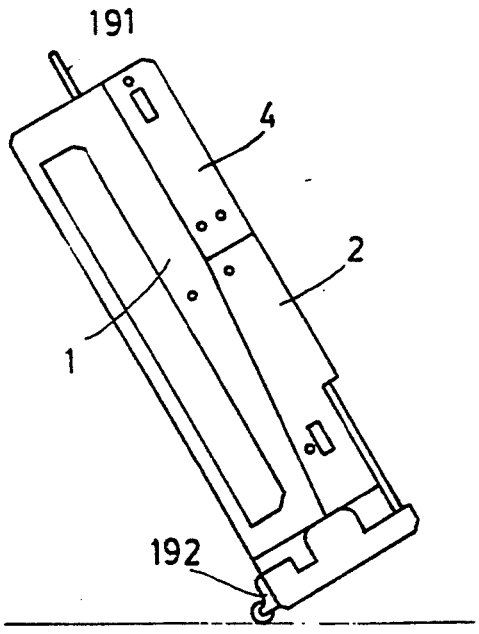
FIG. 24 is a sketch view showing the multi-functional sporting equipment is in moving position.
Figure 25:
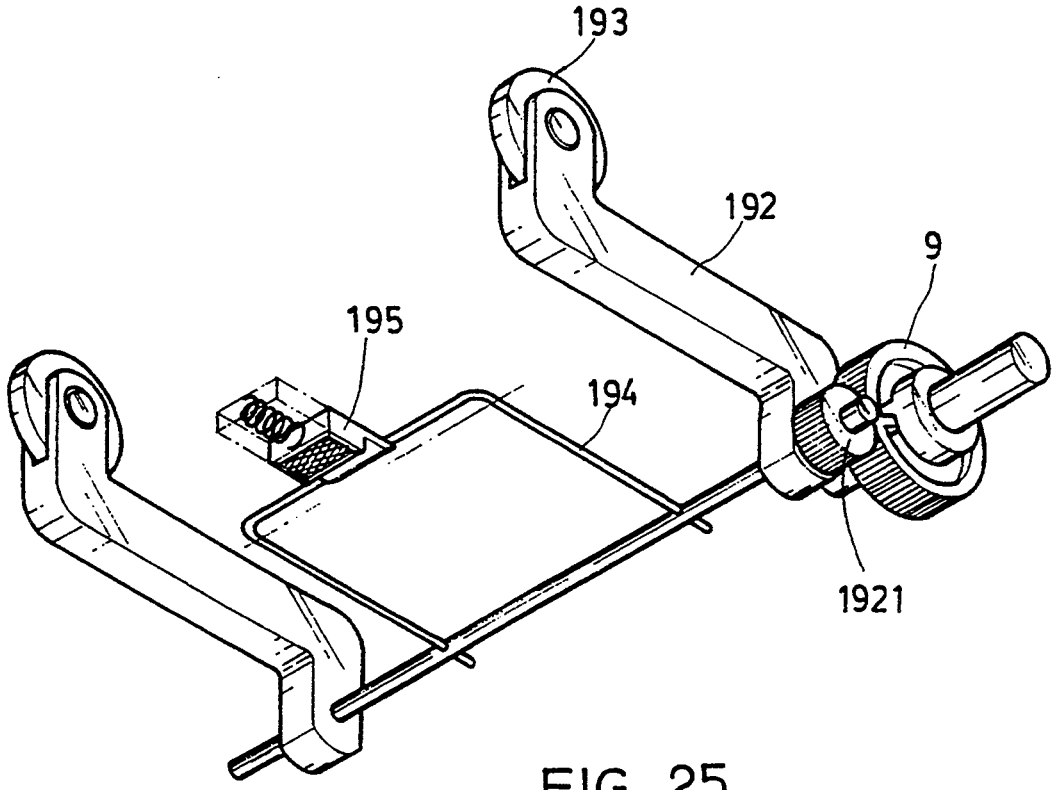
FIG. 25 is a perspective view of the cast.
Figure 26:
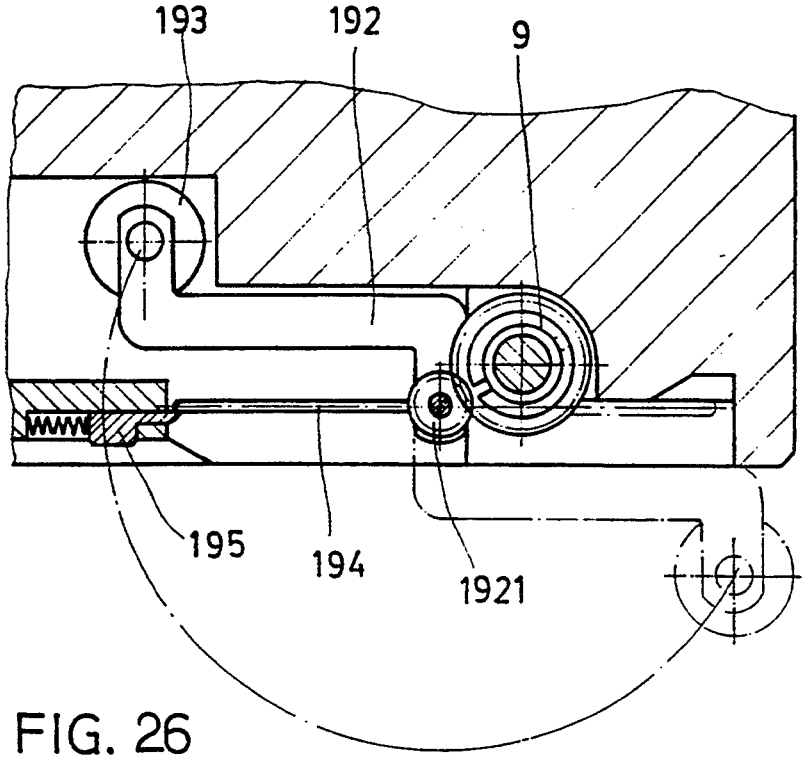
FIG. 26 is cross sectional view of the cast in a fully extended position (dash line)

Referring to FIGS. 22 to 24, a recessed slot portion 190 is provided at the front housing 1 to receive the handle 191. This handle 191 having a gear 1911 is meshed with an actuating device 9. When the sporting equipment is not is use, the handle 191 is stored in the slot 190. When the handle 191 is in use, the handle 191 can be easily pulled out, such as shown in FIG. 24. By this arrangement, the box can be easily transferred by virtue of the handle 191. When the handle 191 is released from the hand, the handle 191 will be readily stored to the slot 190 by the actuating force applied by the actuating device 9. On the other hand, a cast frame 192 having a cast 193 thereof is disposed at the bottom of the front housing 1. In normal, the cast frame 192 is stored within the front housing 1. Besides, the frame 192 is incorporated with a gear 1921 which is meshed with an actuating device 9. When the frame 192 is stored, a torque is applied to the actuating device 9. An U-shape frame 194 is provided at the middle portion of the U-shape frame 11194 and retained by a retaining plate 195. When the cast frame 192 is to release, the retaining plate 195 shall be removed firstly, then the torque released from the actuating device 9 will turn the cast frame 192 to one hundred and eighty (180) degrees. Then the cast 193 is ready to withstand the weight of the sporting equipment, such as shown in FIGS. 23, 24.

Figure 27:
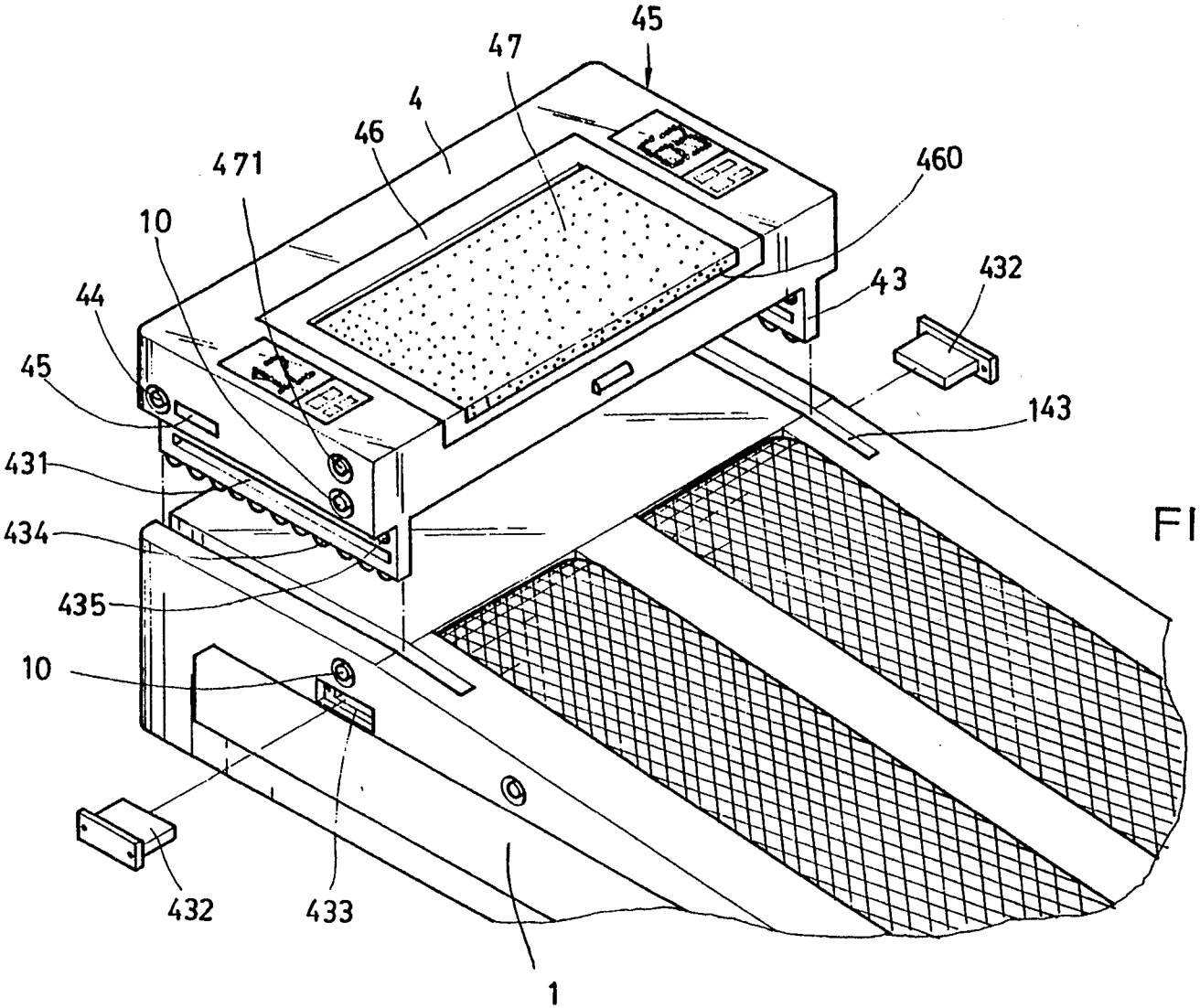
FIG. 27 is a side elevational view of the sliding housing.

Referring to FIG. 27, a projected plate 43 is provided at the bottom edge of the sliding block 4. This projected plate 43 extends into the slot 143 of the front housing 1. An elongate slot 431 is provided at the projected plate 43. A pin 432 is inserted into the elongate slot 431 via the slot 433 of the front housing 1. A row of rollers 434 are disposed at the underside of the projected plate 43. By this arrangement, the sliding housing 4 is movable on the front housing 1. Besides, a positioning holes 435 is provided at the upper position of the elongate slot 431 of the projected plate 43. A positioning member 10 can be inserted into the hole 435 to adjust the position of the sliding housing 4.

Figure 28:
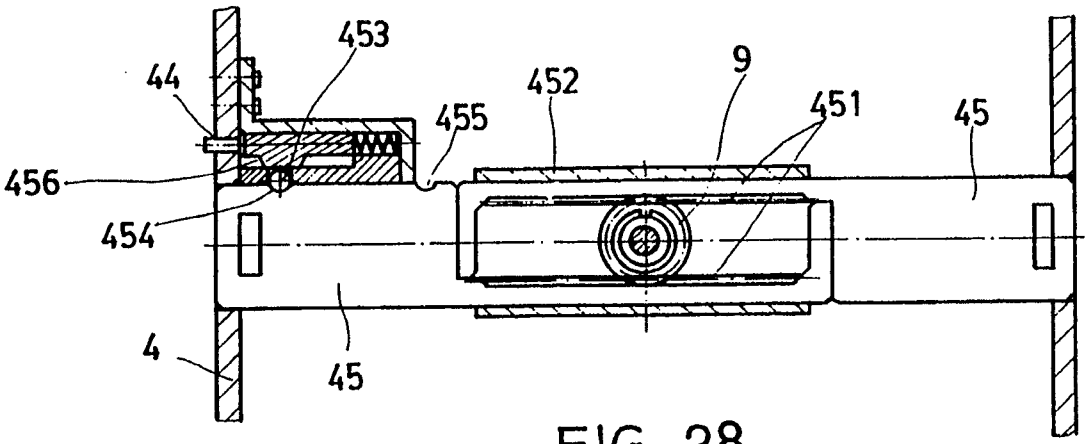
FIG. 28 is cross sectional view showing a lug means in a retracted position.
Figure 29:
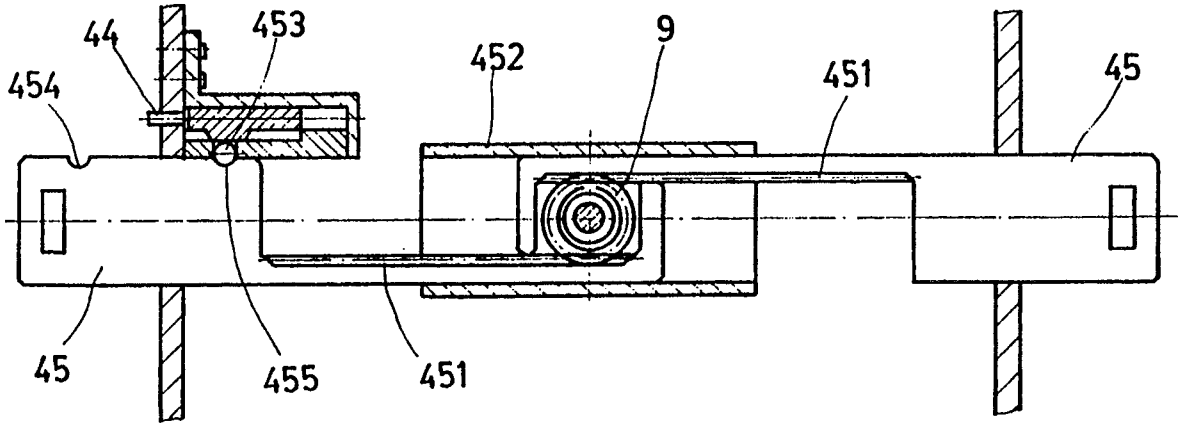
FIG. 29 is cross sectional view showing a lug means in a extended position.

Besides, a pushing button 44 is provided at the side of the sliding housing 4. When the pushing button 44 is pressed, a lug 45 which is stored in the sliding housing 4 will extend to its full position. Referring to FIGS. 28, 29, a recessed portion is provided at the lug 45. A row of symmetrical teeth 451 are formed at the recessed portion. An actuating device 9 is disposed inside the sliding slot 452. On the other hand, an actuating device 9 is also disposed between those teeth 451. By this arrangement, a counterclockwise torque is applied thereof. But a steel ball 453 is retained in the first cavity 454 of the lug 45. In normal condition, the steel ball 453 is retracted and when the pushing button 44 is pressed, a pressing block 456 which locates above the steel ball 453 will be removed. Then the force applied by the steel ball 453 to the first cavity 454 is released, hence the actuating device 9 moves clockwise to extend the lug 45 to both sides, as shown in FIG. 29. When the lug 45 is fully extended, the steel ball 453 is retained to the second cavity 455 to fix the lug 45. When the lug 45 is restored to its original position, the actuating device 9 is again rotated counterclockwise to preserve a potential energy, as shown in FIG. 28. The function of lug 45 will be described later.

Figure 30:
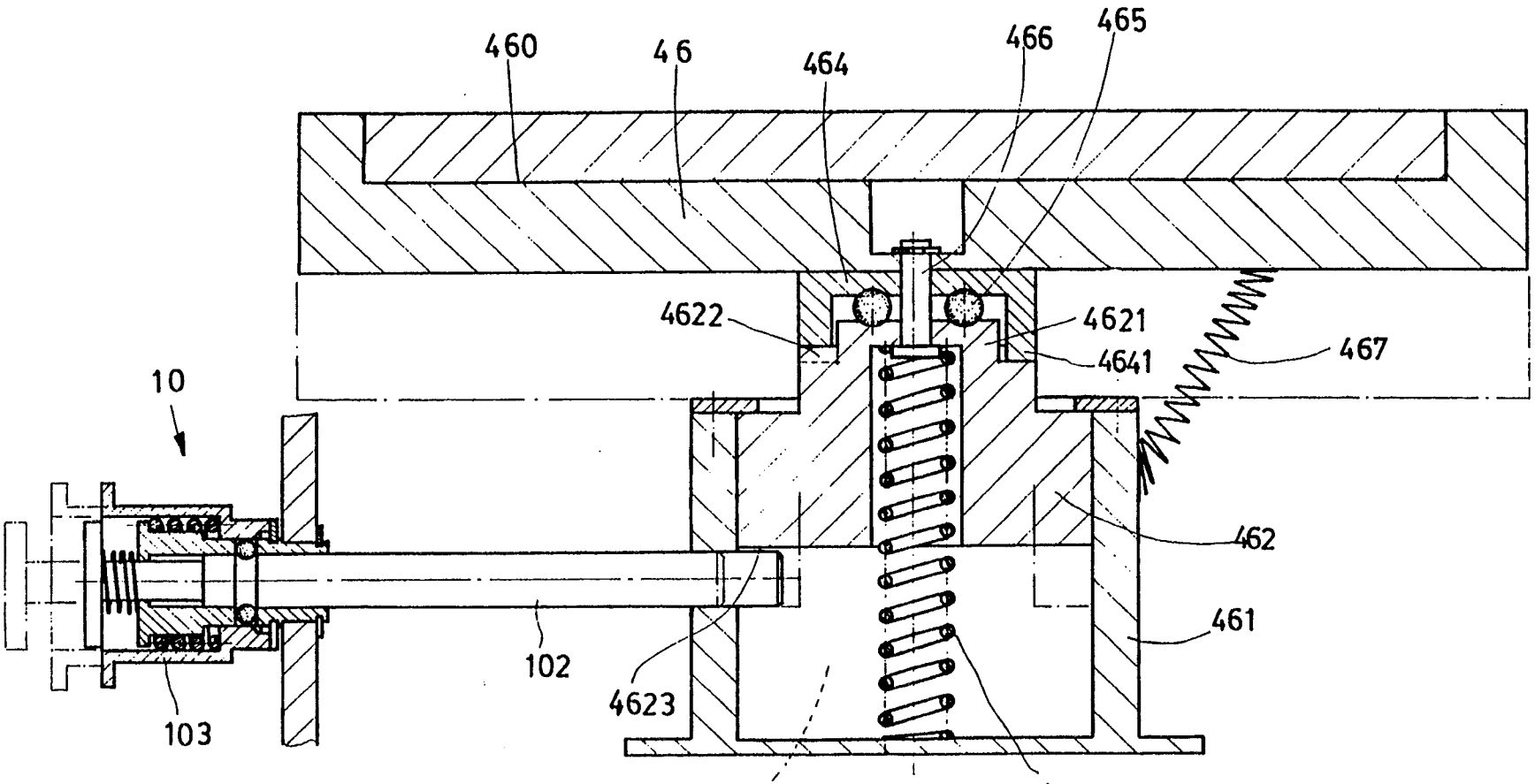
FIG. 30 is a cross sectional view showing a lifting table, wherein dash line show the lifting table in a retracted position.
Figure 32:
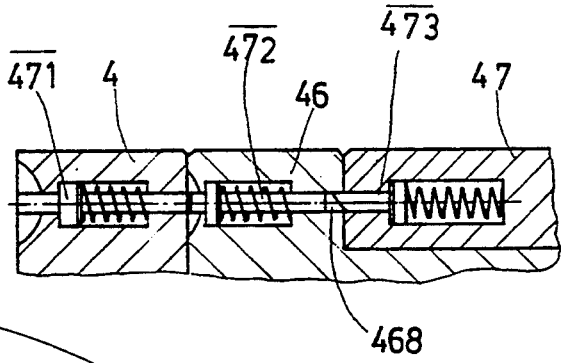
FIG. 32 is a controlling means for a shim member.
Figure 31:
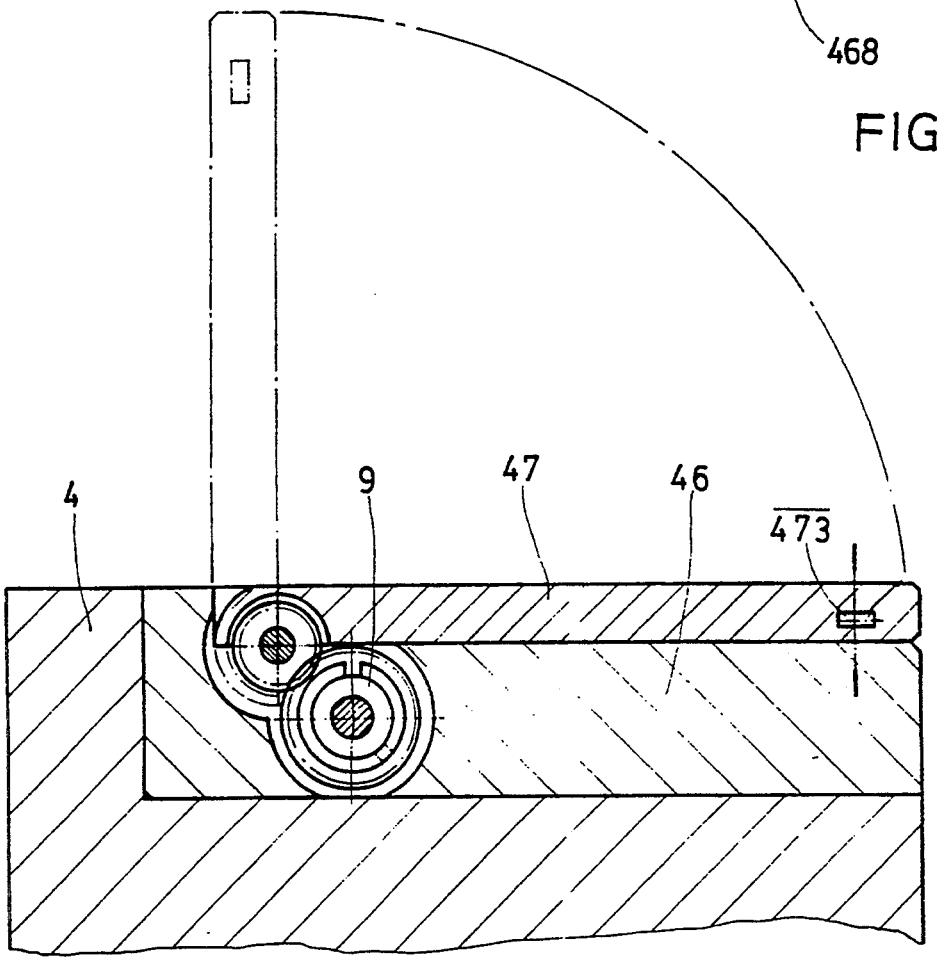
FIG. 31 is a sketch view showing the movement of the rotating table.
Figure 33:
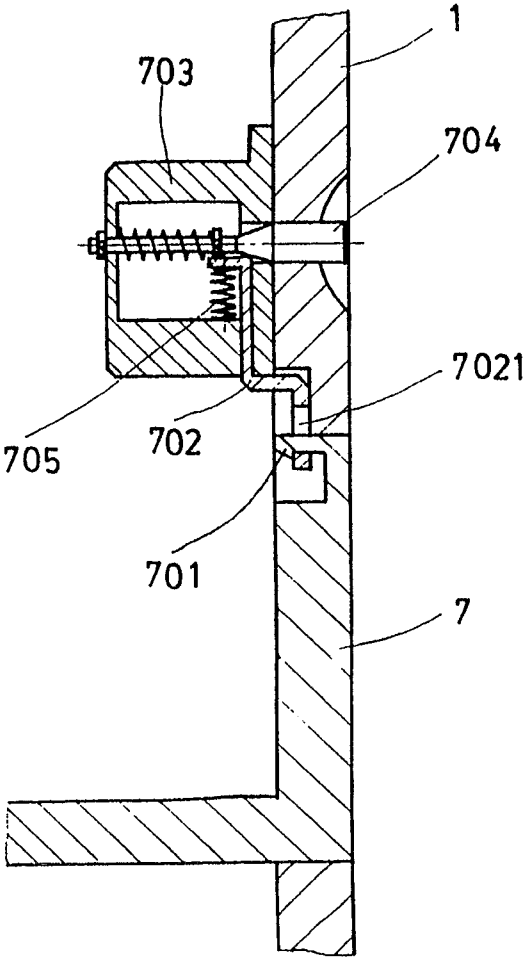
FIG. 33 is a locking member for the box member in a closed position.

Referring to FIGS. 27 to 30, a turntable 46 is disposed at the sliding housing 4. This turntable 46 is fixed by a positioning device 10 installed at one side of the sliding housing 4. A housing 461 is provided at the sliding housing 4. Besides, a lifting block 462 is installed within the housing 461 and a spring 463 is disposed between the lifting block 462. On the other hand, a rotating sleeve 464 is disposed above the lifting block 462. The rotating sleeve 464 has a contact with the upper portion of the sliding block 462 via a steel ball 465. Besides, the turntable 46 is fixed to the upper position of the rotating sleeve 464 via a shaft member 466. By this arrangement, the rotating sleeve 464 can rotate freely above the lifting block 462. A stopper 4622 is provided at the outer circumference of the housing 4621 and an elongate end portion 4641 is provided at the rotating sleeve 464. By this provision, the rotation of the rotating sleeve 464 will not exceed three hundred and sixty (360) degrees to avoid any risk. Besides, a spring member 467 is disposed between the turntable 46 and housing 461, hence a restoring force is applied to the turntable 46 to prevent the turntable 46 from sliding into the sliding housing 4. Furthermore, the turntable 46 is pressed into the sliding housing 4, such as shown in FIG. 27. If the user hopes to release the turntable 46 from the sliding housing 4, the adjusting sleeve 103 can be removed from the positioning device 10, then the central post 102 will be removed from the housing 461, and the lifting block 462 will move upward by virtue of the force released from the spring 463. Then the turntable 46 will be lifted to the upper position of the sliding housing 4. When the turntable 46 achieves the preset position, the positioning device 9 can be restored to the original position to make the central post 102 link against the button 4623 of the lifting block 462. Then a turning chair can be constructed for the user. When necessary, the push button 471, as shown if FIGS. 27 and 32, can be pressed. This push button 471 has three stages, that means, the second push button 472 which locates inside the turntable 46 can be triggered firstly, then the third push button 473 locates in the shim block 47 can be triggered via the second push button 472. Besides, the second push button 472 is independent with the sliding block 4. Then the control of the up and down of the turntable 46 is solely done by the positioning device 10, not via push button 471. The second push button 472 only served as a lever, i.e., the third push button 473 is triggered by the first push button 471 via the push button 472 which is disposed between the cavity 468 of the turntable 46. Then the shim block 47 is released from the turntable 46. As shown in FIG. 31, an actuating device 9 disposed behind the turntable 46 is released and turn clockwise, then the shim block 47 is turned to from a back support.

Figure 34:
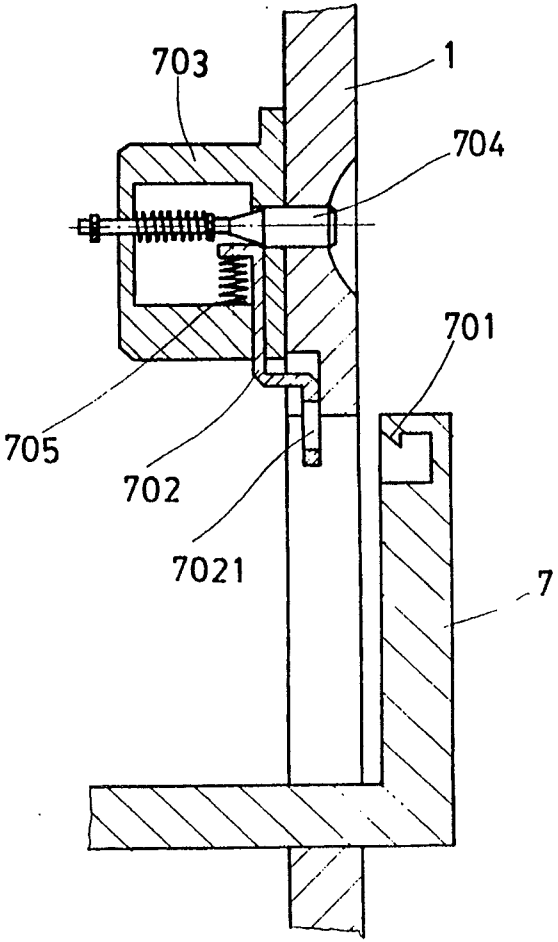
FIG. 34 is a locking member for the box member in an open position.

The configuration of the storage box 7 will be better described below. Referring to FIGS. 1, 33, 34, and 35, a hooking portion 701 is provided at the storage box 7. This hooking portion 701 is retained by a retaining plate 702. This retaining plate 702 is disposed in a housing 703 and controlled by a push button 704. When the push button 704 is pressed, the retaining plate 702 is pressed to move downward. Then the slot 7021 of the retaining plate 702 is moved downward accordingly and the hooking portion 702 is released therefrom and moves outward, as shown in FIG. 34. When the push button 704 is released, the retaining plate 702 restores to its original position by virtue of spring 705. If the storage box 7 is pushed back to the front housing 1, the hooking portion 701 is retained again by the retaining plate 702 after the hooking portion 702 1 passes the slot 7021. This is the controlling mechanism of the storage box 7.

Figures 35, 35A:
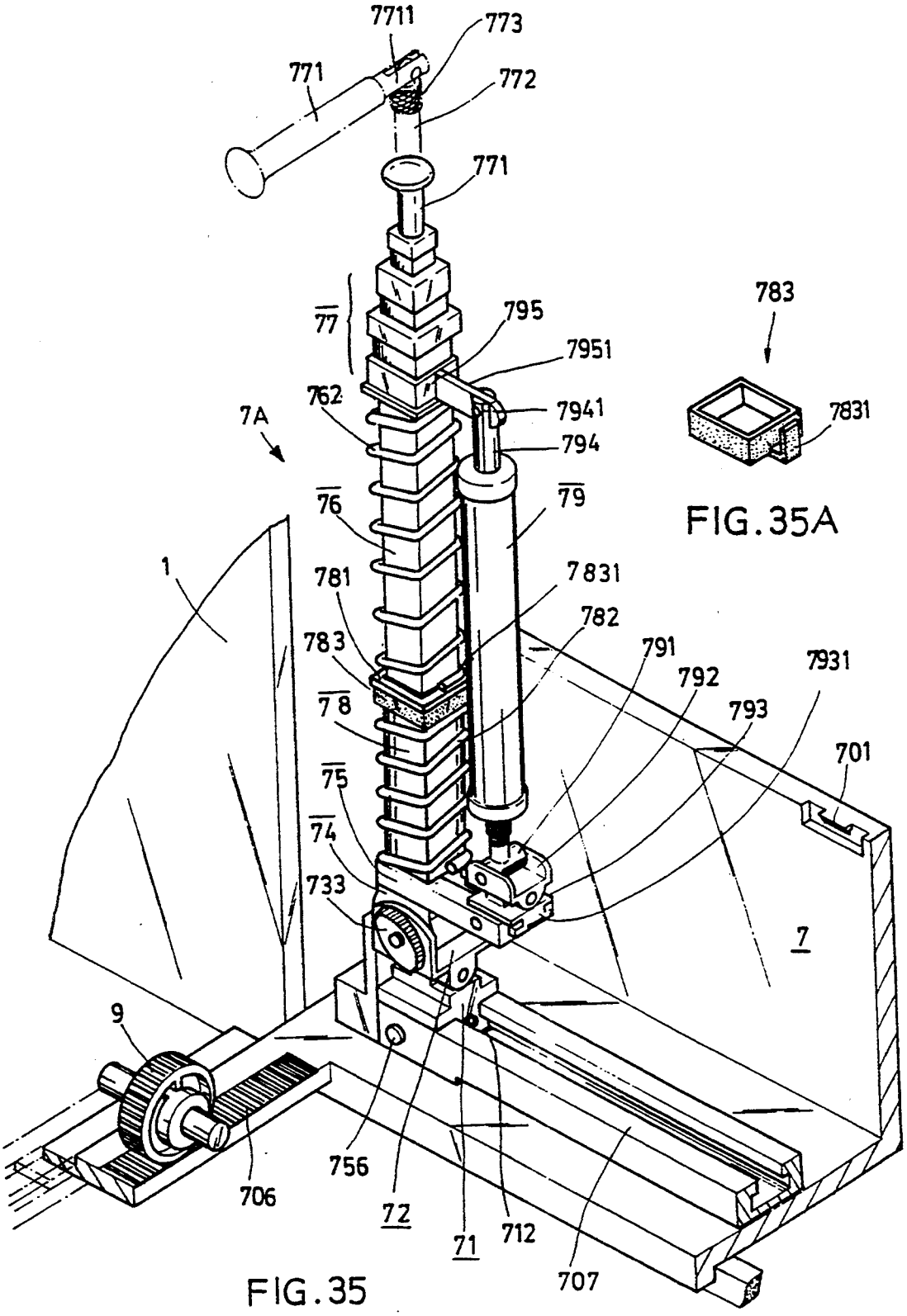
FIGS. 35, 35A and 35B are the perspective views of an extending lever.

Referring to FIG. 35, a row of teeth 706 are disposed both sides of the storage box 7. An actuating device 9 is disposed thereof and the teeth 706 will rewind the actuating device 9 counterclockwise. When the hooking portion 701 is released from the retaining plate 702, the torque released from the actuating device 9 will push the storage box 7 from the front housing 1.

Figure 36:
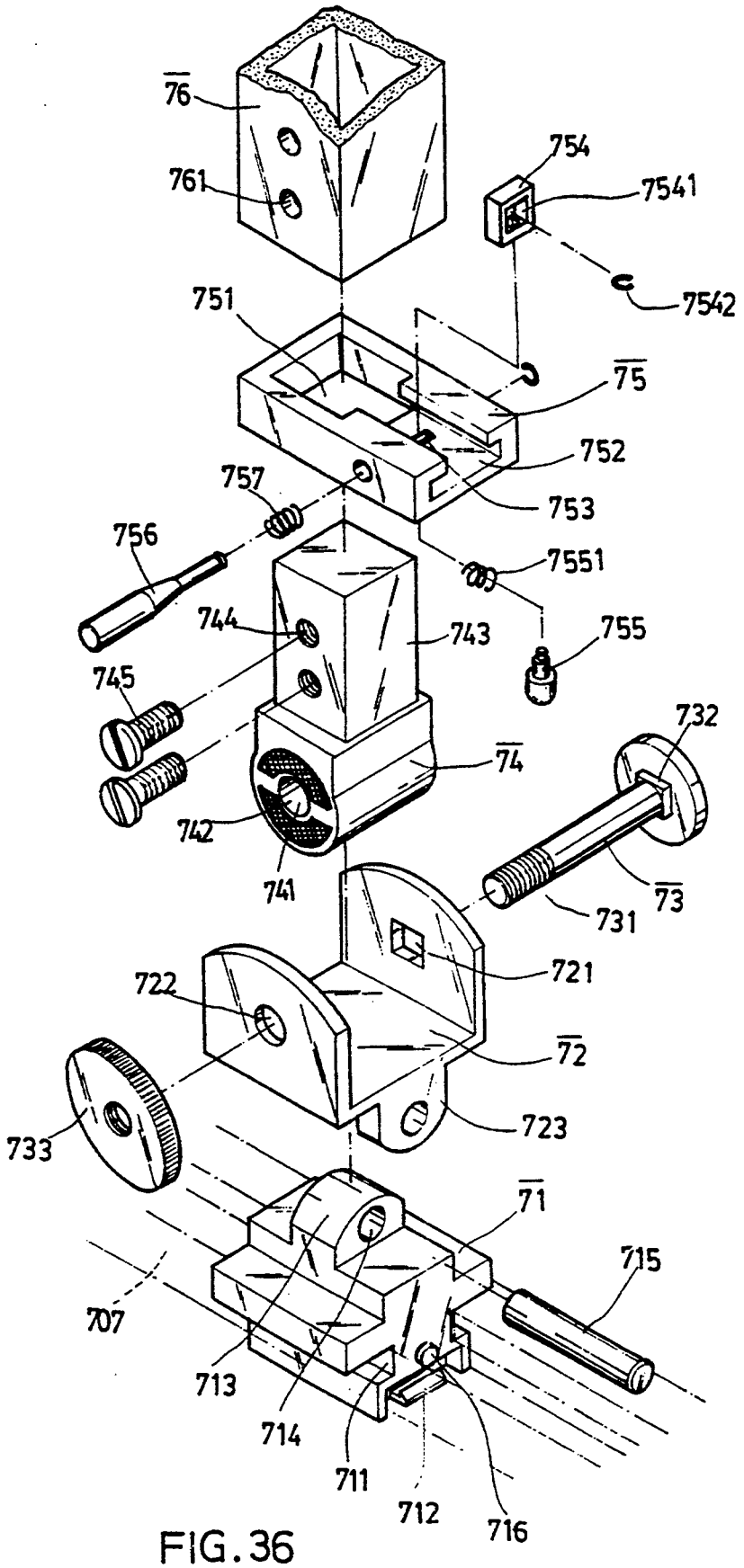
FIG. 36 is an exploded view for an extending lever.

Besides, a dovetail rail 707 is provided at the bottom edge of the storage box 7, and a retractable lever 7A is disposed at the rail 707. This retractable lever 7A can be pulled up to extend over the storage box 7. As shown in FIGS. 35 and 36, it comprises:

a sliding housing 71, a retaining slot 711 being slidable at the rail 707 is disposed at the bottom, a hooker 712 and an elastic boss 716 are disposed at the rear portion of the retaining slot 711, the sliding housing 71 has a connecting rib 713 at its upper portion, a hole 714 is disposed thereof for receiving a shaft 715;

a U-shape housing 72, a rectangular hole 721 and a hole 722 are disposed separately on the sides of the housing 72, a pair lug 723 which are parallel with each other are disposed at the bottom portion, these lugs 723 can be engaged with the rib 713 and positioned thereof by means of a shaft member 715;

a central shaft 73 having a threaded portion 713 at the tip portion and a rectangular block 732 at the rear portion, the rectangular block 732 can be received by the rectangular hole 721 of the U-shape housing 72, an oval adjusting knob 733 locked to the threaded portion 731 to adjust the tightness of the U-shape housing 72;

a rotating body 74 having a hole 741 thereof, this rotating body 74 is fixed to the U-shape housing 72 by means of a lever member 73, a pair of lining plate 742 are disposed at the sides of the body 74, the rotating clearance of the rotating body 74 can be adjusted by the adjusting knob 733 disposed at side of the U-shape housing 72, a connecting boss 743 is provided at the upper portion of the rotating body 74 which has a threaded hole 744 and screw 745 at sides;

a retaining slot body 75 having a rectangular hole 751 can be enveloped to the connecting boss 743 and a retaining slot 742 with a rectangular slot 753 is provided thereof, a clip ring 754 can be inserted therein, a positioning body 755 is used to fix the clip ring 754 through the bottom of the retaining slot 75, this positioning body 754 also pass through a hole 7541 of the clip ring 754 and positioned by a C-clip 7542, then the clip ring 754 is retained inside the retaining slot 752 such a manner that the hole 7541 is above the retaining slot 752 for engaging with a hooker 712.

Figure 38:
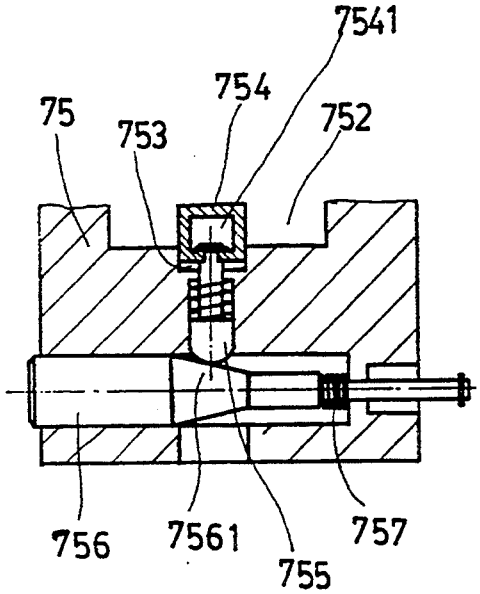
FIG. 38 is a cross sectional view of a retaining slot for an extending lever in an open position.
Figure 39:
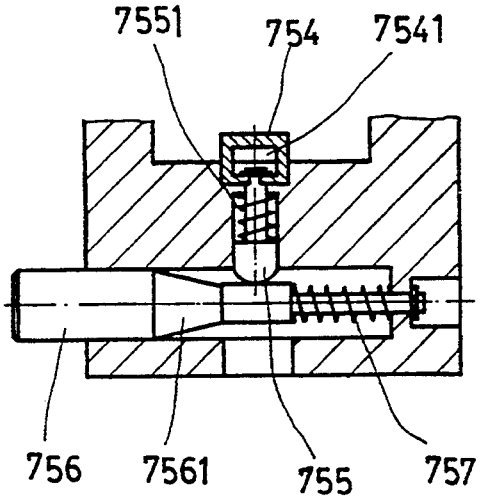
FIG. 39 is a cross sectional view of a retaining slot for an extending lever in an closed position.

On the other hand, an actuating lever 756 is provided at one side of the retaining slot body 75, as shown in FIGS. 38 and 39, an tapped surface 7561 is disposed at the actuating lever 756. When the actuating lever 756 is pressed, the tapper surface 7561 moves to right direction to lift the positioning body 755. By this arrangement, the clip ring 754 is opened then. To the country, when the actuating lever 756 is lowered by the spring member 757 to its original position, the positioning body 755 is lowered by the spring member 7551, then the clip ring 754 returns to its original position.

An outer rectangular tube 76 having a hole 761 at side with respective to the threaded hole 744 of the connecting boss 743. This tube 76 is enveloped to the boss 743 and retained thereof by a screw member 745. Then the retaining slot 75 is enveloped to the connecting boss 743. A spring member 743 is provided at the peripheral.

Figures 42, 43:
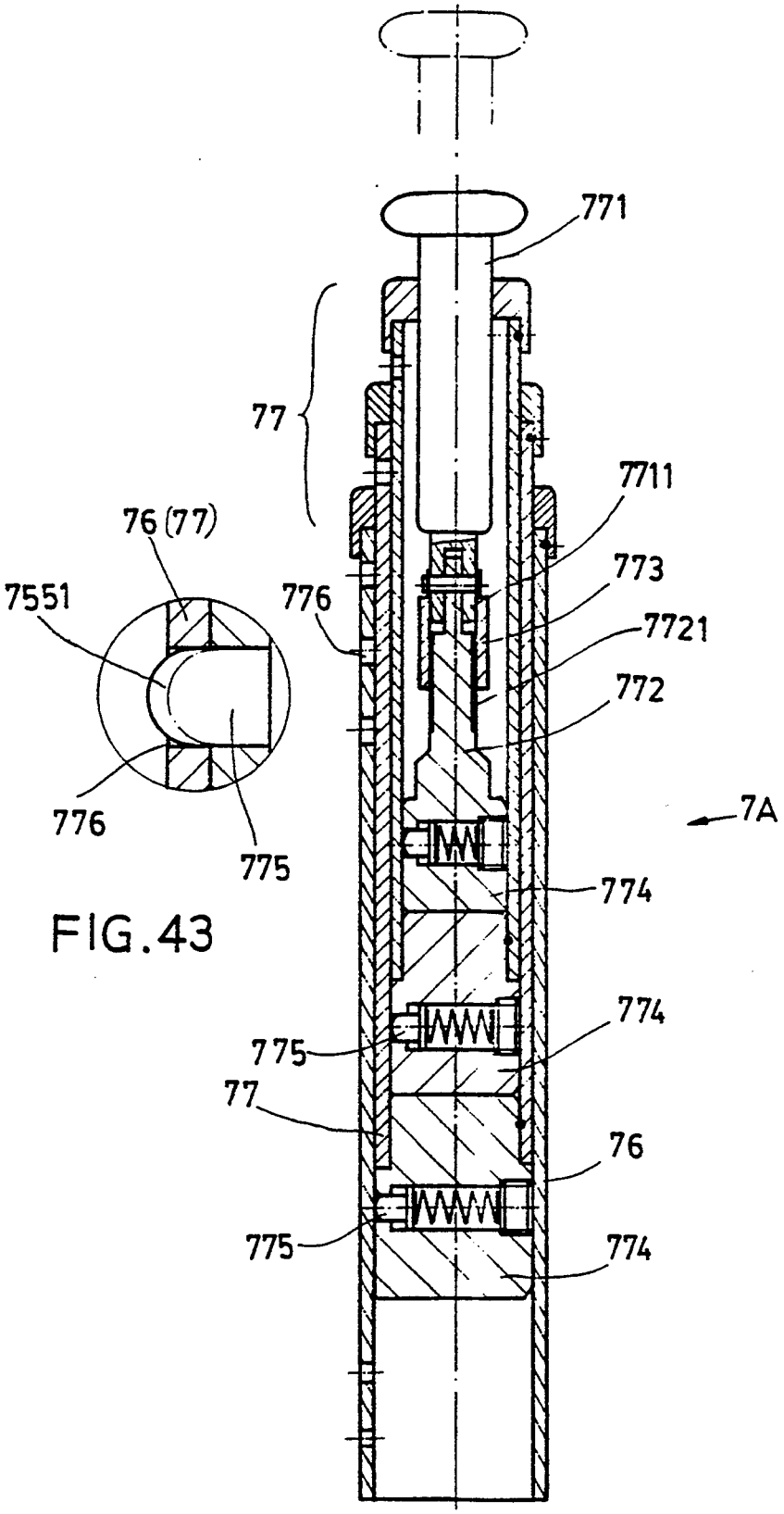
FIG. 42 is a cross sectional view of an extending lever.
FIG. 43 is a cross sectional view of a retaining member for extending lever.

A plurality of retractable tubes 77 are telescopically disposed within the outer rectangular tube 76. A upper circular lever 771 is received within the upper retractable tube 77. The circular lever 771 is removable and a second tube 772 is attached to the bottom of the tube 771. When the upper lever 771 is pulled out, it can rotate to right or left. Referring to FIG. 42, a threaded portion 7721 is provided at the lower end of the lower tube 772 and a sleeve 773 is enveloped on it. When the upper lever 771 is retracted, the sleeve 773 moves upward and contacts with the connecting portion 7771 and retains thereof. By this arrangement, the upper lever 771 and the lower lever 772 form a straight tube. On the other hand, when the upper and lower levers 771,772 are removed from the tube 77, the sleeve 773 moves downward, then the connecting portion 7711 is released therefrom and bends outward or inward for ninety (90) degrees to horizontal. Then the sleeve 773 moves upward again to contacts with the connecting portion 7711, hence the upper lever 771 can be fixed to from a handle or handrail.

A tube 78 envelops to the lower portion of the outer rectangular tube 76. The upper portion of the tube 78 has a folded flange 781. A spring member 782 is provided at the circumference of the tube 78 and presses down to a movable ring 783 thereunder. The ring member 783 is shown in FIG. 35A and a retaining plate 7831 is disposed outside. This retaining plate 7831 is connected with the lug 45 extends from the sliding housing 4 to fix the retractable tube 7A.

Figure 35B:
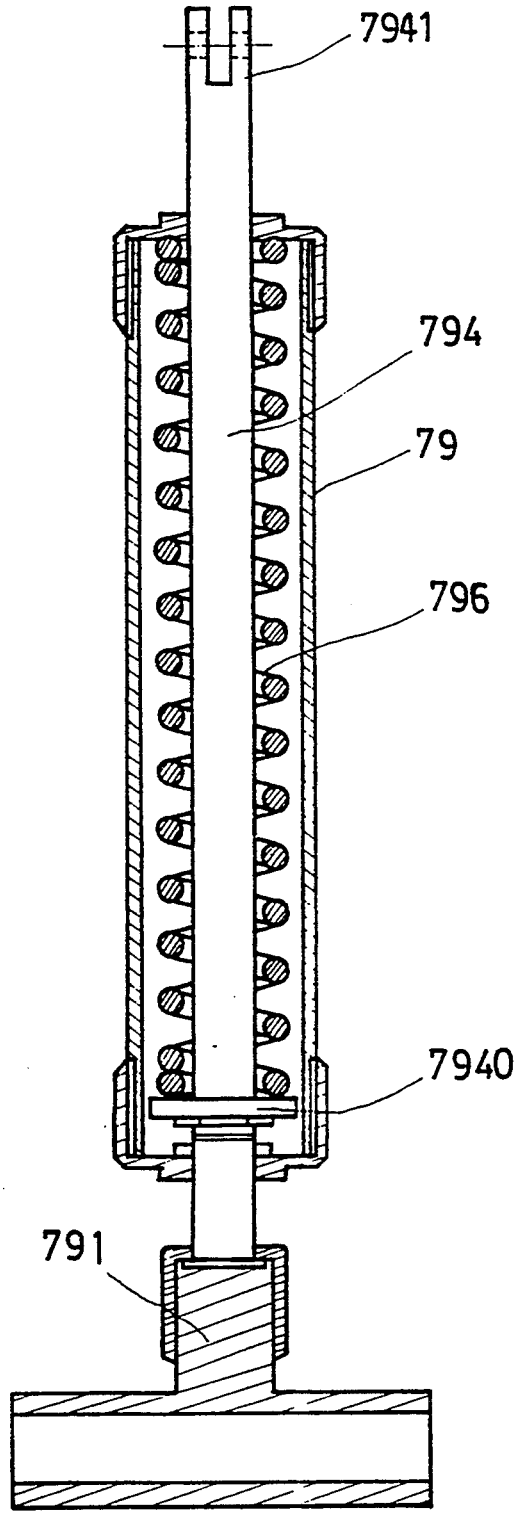

A cylinder 79 disposed at one side of the retractable lever 7A. A connecting portion 791 is provided at the lower portion and a U-shape housing 792 is connected thereof. The U-shape housing 792 is pivoted to a retaining housing 793. A retaining slot 7931 is provided at the bottom of the retaining housing 793. This retaining housing 7931 is received by the retaining slot 752 of the retaining slot body 75. Since the connection of the U-shape housing 792 and the U-shape housing 72 and retaining housing 793 and the sliding housing 71, no detailed description is necessary. A retractable piston 794 is provided above the cylinder 79. A pivoting portion 7941 is pivoted to a lug member 7951 of the ring member 795 locates above the retractable tube 77, as shown in FIG. 35B, the piston 794 is located inside the cylinder 79 and an anchoring plate 7940 is provided at the lower portion of it. A spring member 796 is provided thereof to make the piston 794 be slidable pulled out.

By the combination of these elements, the retractable tube 7A is stored inside the storage box 7 and can be retrieved thereof in use.

Referring to FIGS. 37 to 43, the detailed description of the retractable tube 7A for its operation and internal configuration.

Figure 37:
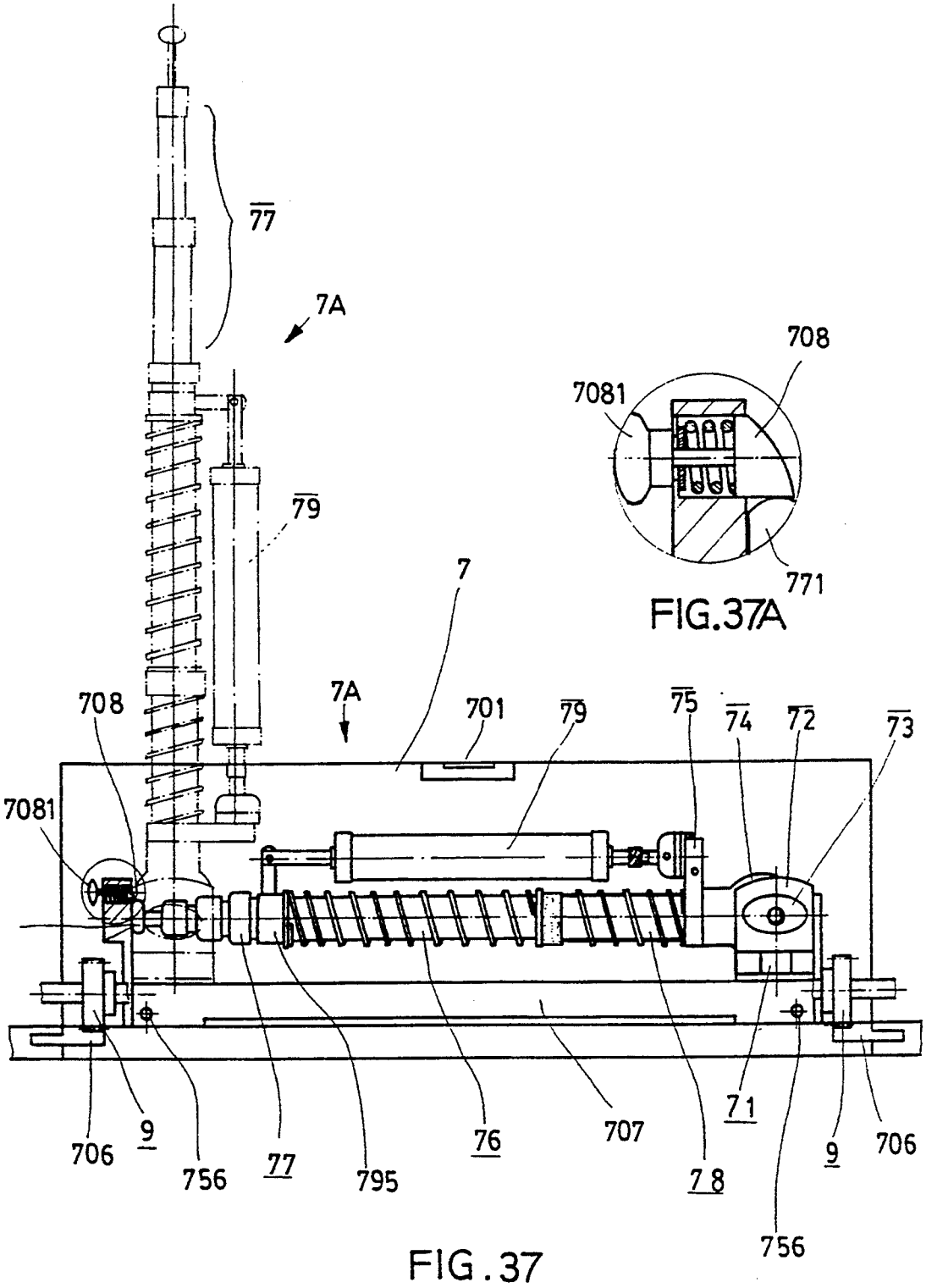
FIG. 37 is a sketch view showing the operation of an extending lever.

As shown in FIG. 37, the retractable tube 7A is stored horizontally within the storage box 7 when not in use. The sliding hosing 71 is moved to the right position of the rail 707. The upper lever 771 is retained by an elastic pin member 708. When the elastic pin member 708 is removed outward by the handle 7081, the retractable lever 7A is rotated and centered with the U-shape housing 72 and turns ninety (90) degrees by the support of the rotating body 74. Then the actuating lever 756 is pressed and the sliding housing 71 is released thereof; then the sliding housing 71 is moved to the left to pull out the retractable tube 77, as shown in ghost line.

Figure 41:
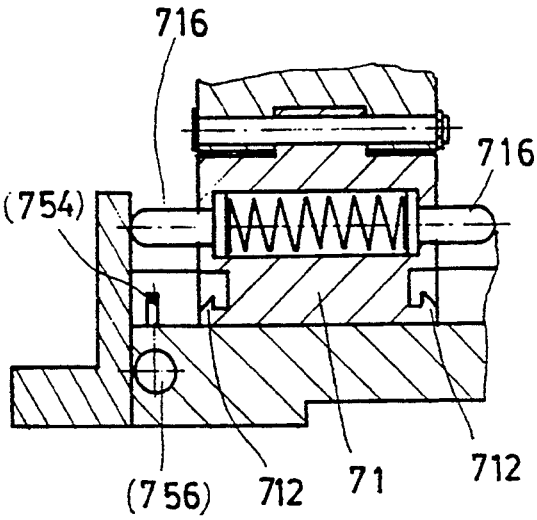
FIG. 41 is a cross sectional view of a sliding housing in a released position.
Figure 40:
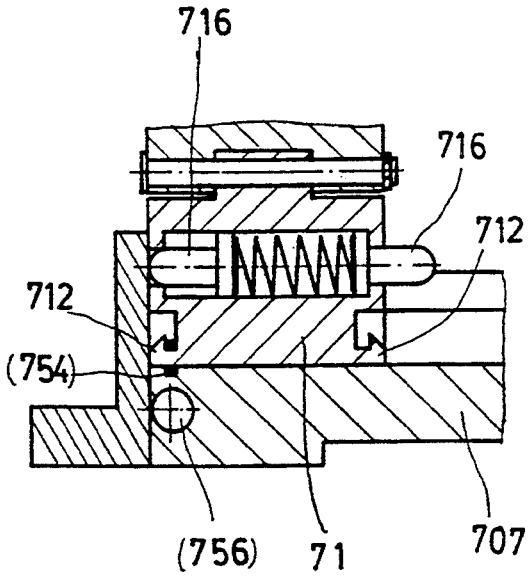
FIG. 40 is a cross sectional view of a sliding housing in a locked position.

Besides, the positioning of the sliding housing 71 on the rail 707 is same with the retaining housing 793 of the cylinder 79 to the retaining slot body 75. Referring to FIGS. 38, 39, 40 and 41, the hooker 712 of the sliding housing 71 has an inclined surface. When the upper half of the slot hole 7541 of the clip ring 754 floats up, the hooker 712 can be easily inserted in, as shown in FIG. 40. Then the elastic boss 716 is pressed to retract inside the sliding housing 71. When the sliding housing 71 moves to the right, it can be easily done by pressing the actuating lever 756, and the clip ring 754 float, as shown in FIGS. 38 and 41. The elastic boss 716 will push the sliding housing to the right to make the hooker 712 being released therefrom. When the sliding housing 71 moves to the right, the positioning is same with the above description.

The internal configuration of the retractable lever 7A will be described in accompanying with FIGS. 42 and 43. A sliding block 774 is provided at the lower end of the retractable tube 77 of the outer rectangular tube 77. Besides, the lower portion of the circular lever 772 is connected with a rectangular block 774 as well. An elastic pin member 775 is provided inside the sliding block 774. A positioning hole 776 is provided at upper side of each retractable tube 77. And the outer rectangular tube 76 is also provided with a plurality of positioning holes 776. When the retractable tube 77 is pulled out, the sliding block 774 is lifted as well. When the sliding block 774 reaches the top end of the rectangular tube, the elastic pin 775 is then extended into the positioning hole 776 to fix the tube. On the other hand, a plurality of positioning holes 776 are also provided to the outer rectangular tube 76 to adjust to a suitable height for different user. When the retractable tube 77 is to retract, the elastic pin 775 can be easily pressed in to retract its round head 7751, then the tube 77 can easily slide down as it is pressed by hand.

Figure 44:
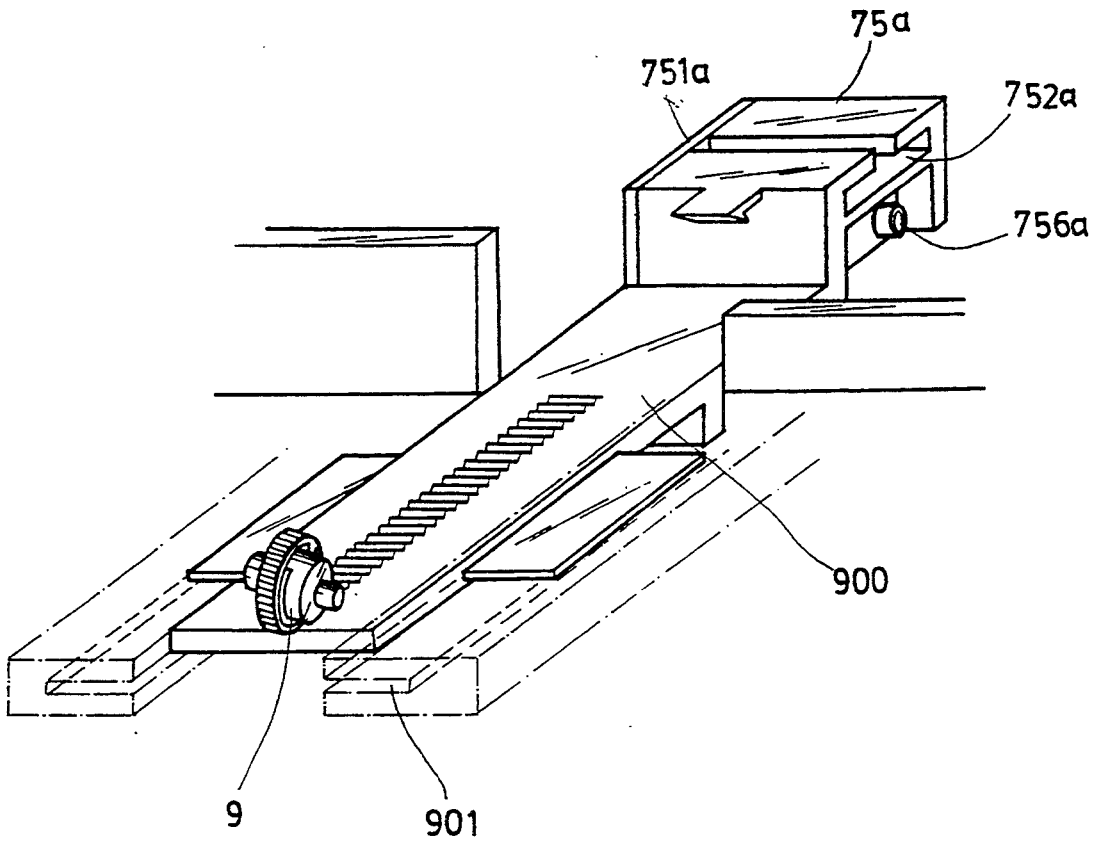
FIG. 44 is a sketch view showing the retaining slot in a extended position.
Figure 45:
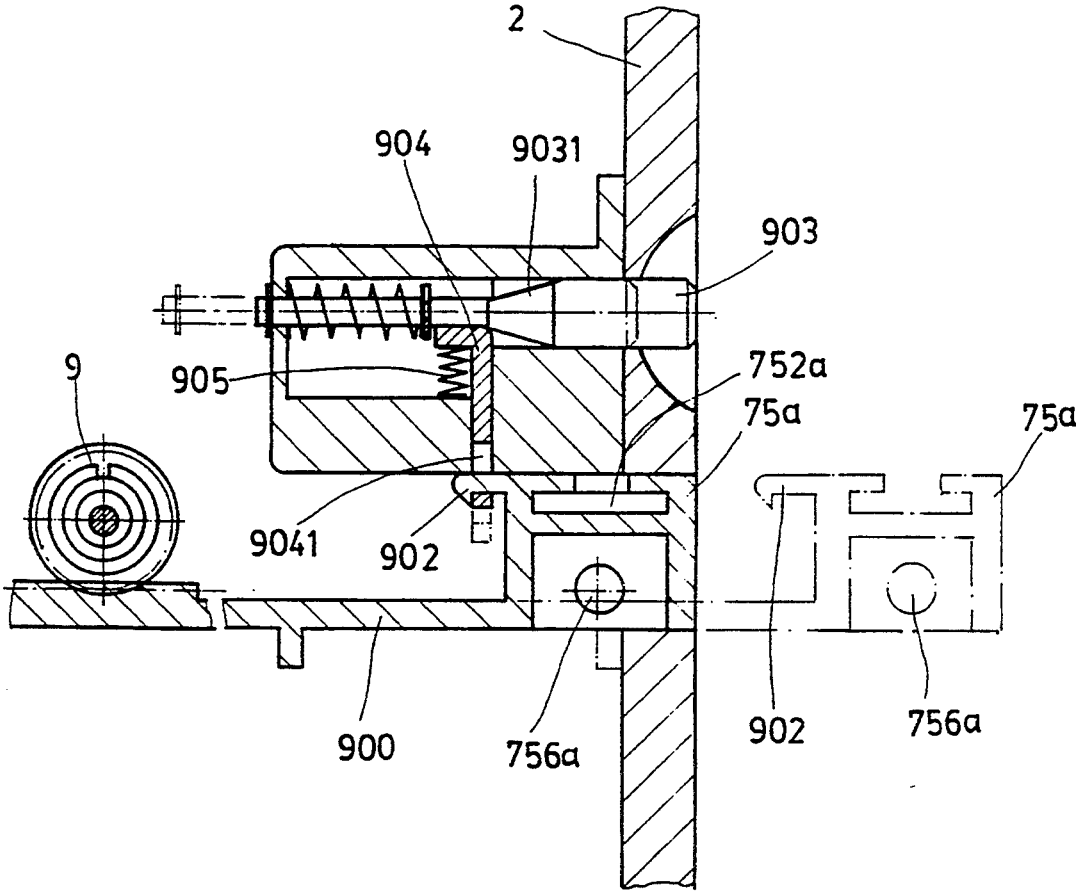
FIG. 45 is a cross sectional view of a retaining slot.

Referring to FIGS. 1 and 44, a retaining slot body 75*a* is provided respectively to the side of rear housing 2. The configuration of this retaining slot body 75*a* is same with the retaining slot body 75 of the retaining housing 793 of the cylinder 79. A retaining slot 752*a* is provided thereof and is closed by a fixing plate 751*a* at its front portion. The actuating lever 756*a* locates at the bottom is used to control the clip ring of the retaining slot 752*a*. Since this structure has been described above, no further description is given. The retaining slot body 75*a* is attached to a row of teeth 900. The teeth is meshed with an actuating device 9 and slidable with the sliding slot 901. A hooker 902 is provided inside the retaining slot body 75*a*. The extension and retraction of the retaining slot body 75*a* is controlled by the knob 903 disposed above, as shown in FIG. 45. When this retaining slot body 75*a* is received within the rear housing 2, the actuating device 9 is rotated counterclockwise. On the other hand, the hooker 902 passes through the slot hole 9041 of the retaining plate 904. The retaining plate 904 is pressed upward by the spring member 905. Then the hooker 902 is fixed by the retaining plate 904. When the retaining slot body 75*a* is to extend, only the knob 903 needs to be triggered. The inclined surface 9031 of the knob 903 is then pushed the retaining plate 904 to move downward. Accordingly, the hooker 902 is released from the slot hole 9041. Meanwhile, the teeth 900 then slides outward by the force from the actuating device 9, the retaining slot body 75*a* is then extended. The provision of the retaining slot body 75*a* is to provide an anchoring site for the sleeve of the retaining housing 793 of the cylinder 79. When different function is needed, the retaining housing 793 of the cylinder 79 can be positioned to the retaining slot body 75*a* for multi-functional usages.

Figure 46:
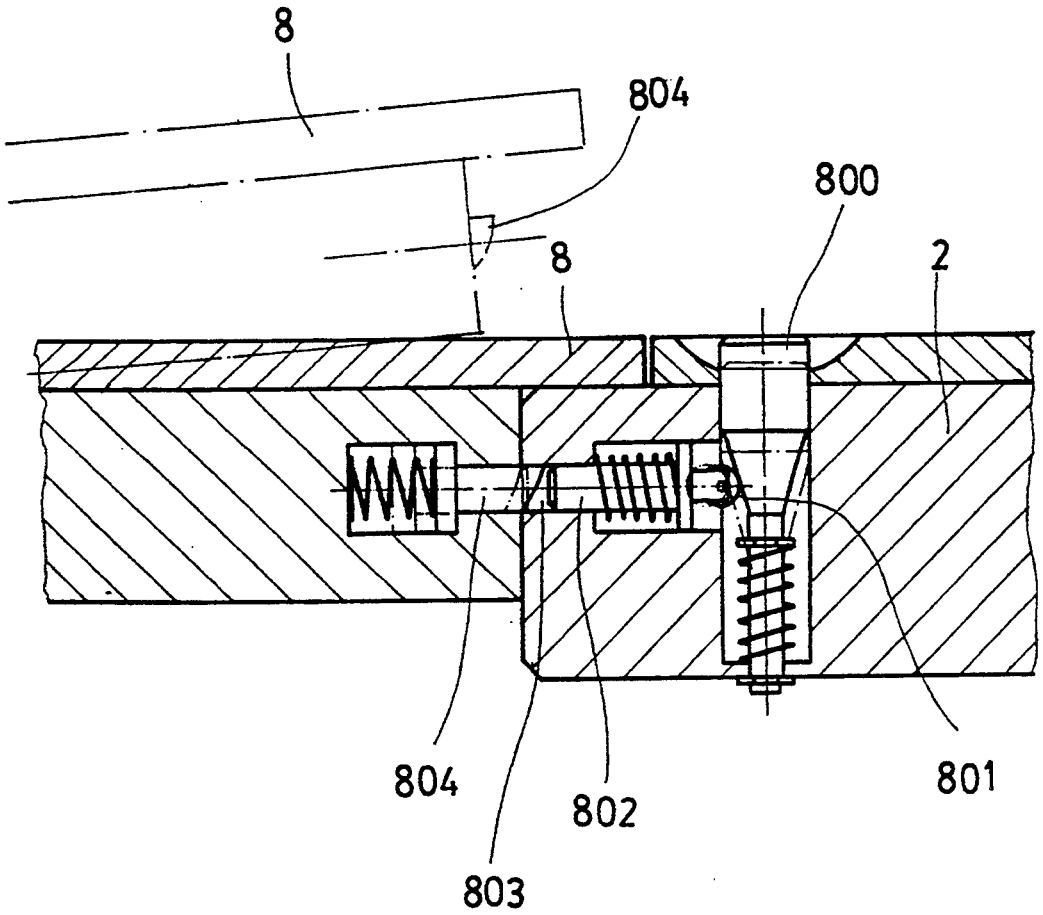
FIG. 46 is a cross sectional view of a pedal member.
Figure 47:
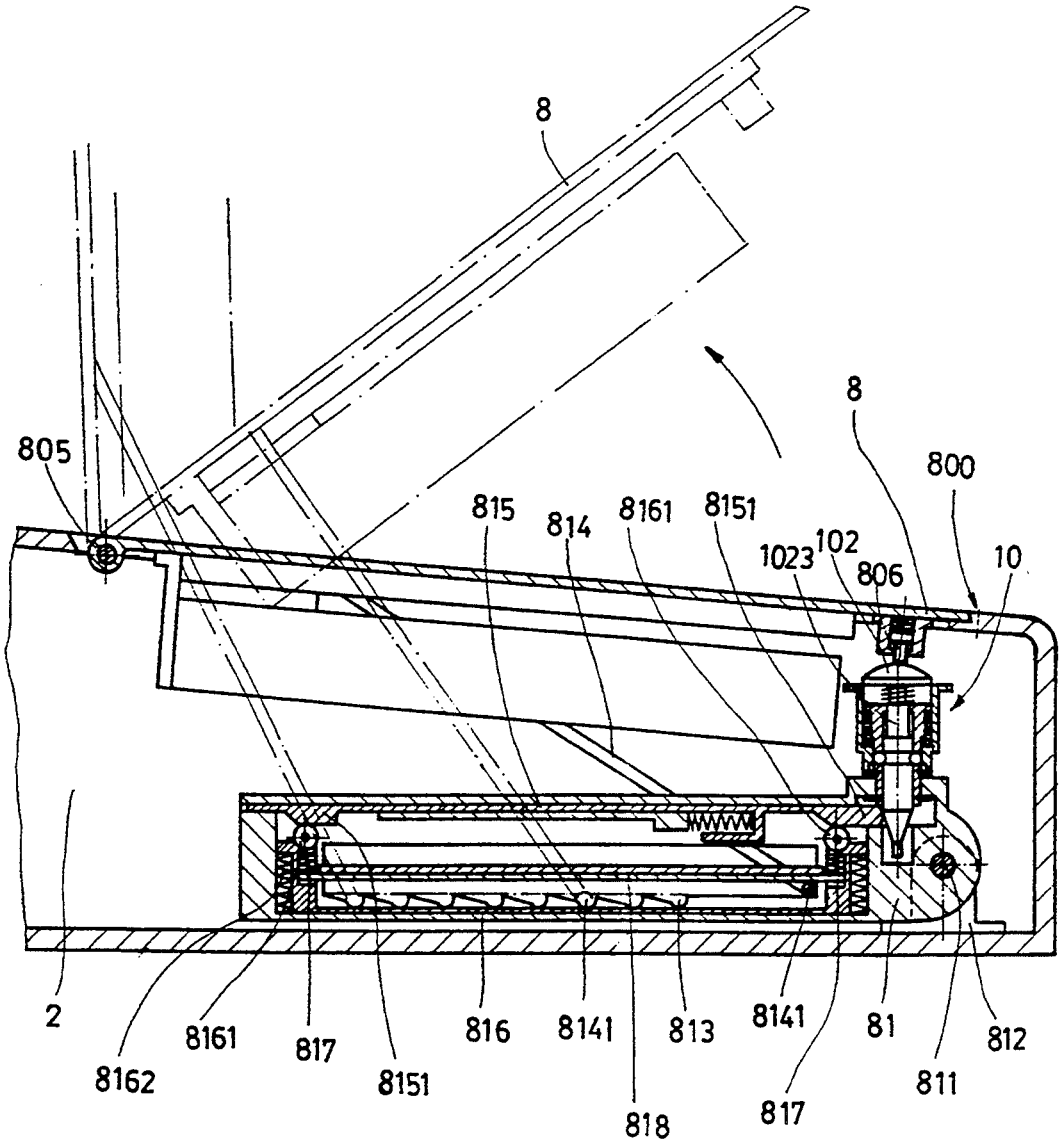
FIG. 47 is a sketch view of an adjusting device.
Figure 49:
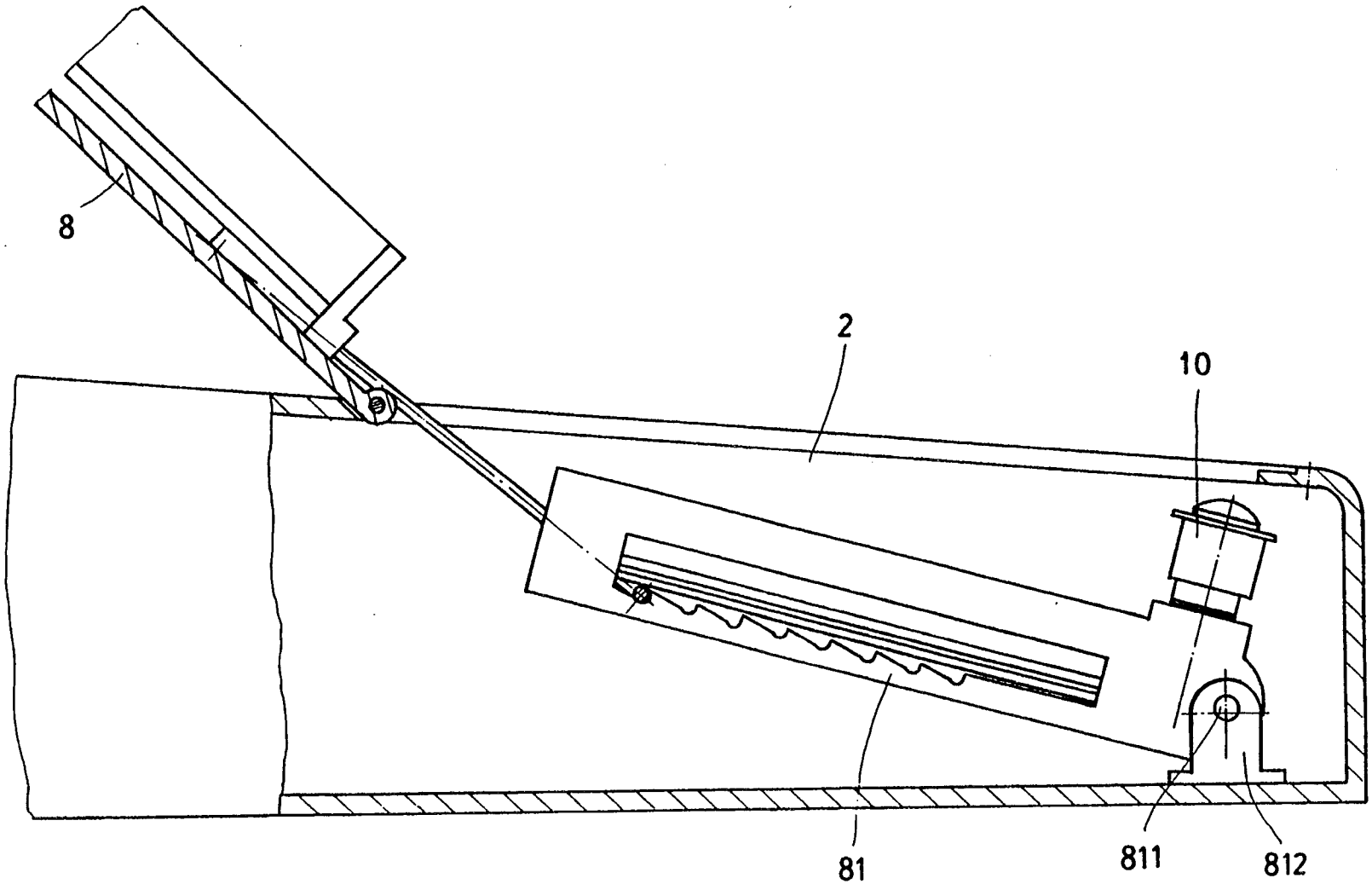
FIG. 49 is a sketch view showing the operation of an adjusting table.

Referring to FIGS. 1 and 46, the pedal 8 is covered to the rear housing 2 when it is stored. The pedal 8 is controlled by the knob 800 disposed at front portion. When the knob 800 is pressed, the cone surface 801 of the knob 800 presses the spring post 802 to the left side to release the retaining post 804 from the slot hole 803. When the front portion of the pedal 8 is released from the rear housing 2 and tilts upward and slightly, as shown in FIG. 47. The pedal 8 is supported by a pivoting ring member 805 at its end portion. The elastic post 806 disposed at the front end portion is pressed to a central post 102 of a positioning device 10, as described above. When the pedal 8 is released therefrom, as shown in FIG. 46, the spring post 806 will push the pedal 8 upward and reach the surface of the rear housing 2. Then the user can adjust the pedal 8 to a suitable position. The positioning device 10 is fixed to an adjusting socket 81. This adjusting socket 81 is disposed at the rear housing 2 and pivoted to a bottom socket 812 via a shaft member 811. By this arrangement, the rear portion of the adjusting socket 81 can be lifted to a certain height, as shown in FIG. 49. On the other hand, a plurality of circular positioning slots 813 are provided at the bottom of the adjusting socket 81. An U-shape supporting bracket 814 is pivoted to the sides of the pedal 8. When the pedal 8 is erected, it can be positioned to a suitable angle by placing the transverse lever 8141 of the supporting bracket 814 to the positioning slot 813. Then the positioning device 10 is closed and the central post 102 is inserted deeply inside the adjusting socket 81 and presses down a retaining plate 815 disposed above the adjusting socket 81. Then the boss 8151 of the retaining plate 815 is pressed to the roller 8161 of the U-shape bracket 814 at the bottom of the positioning slot 8 13. The U-shape bracket 814 is provided with a spring member 8162 at front and rear end portions. Besides, the U-shape bracket 814 is pressed to a positioning plate 818 by means of a spring member 817. Consequently, the positioning plate 818 is pressed to the transverse lever 8141 of the U-shape bracket 816 to the positioning slot 813 from escaping therefrom.

Figure 48:
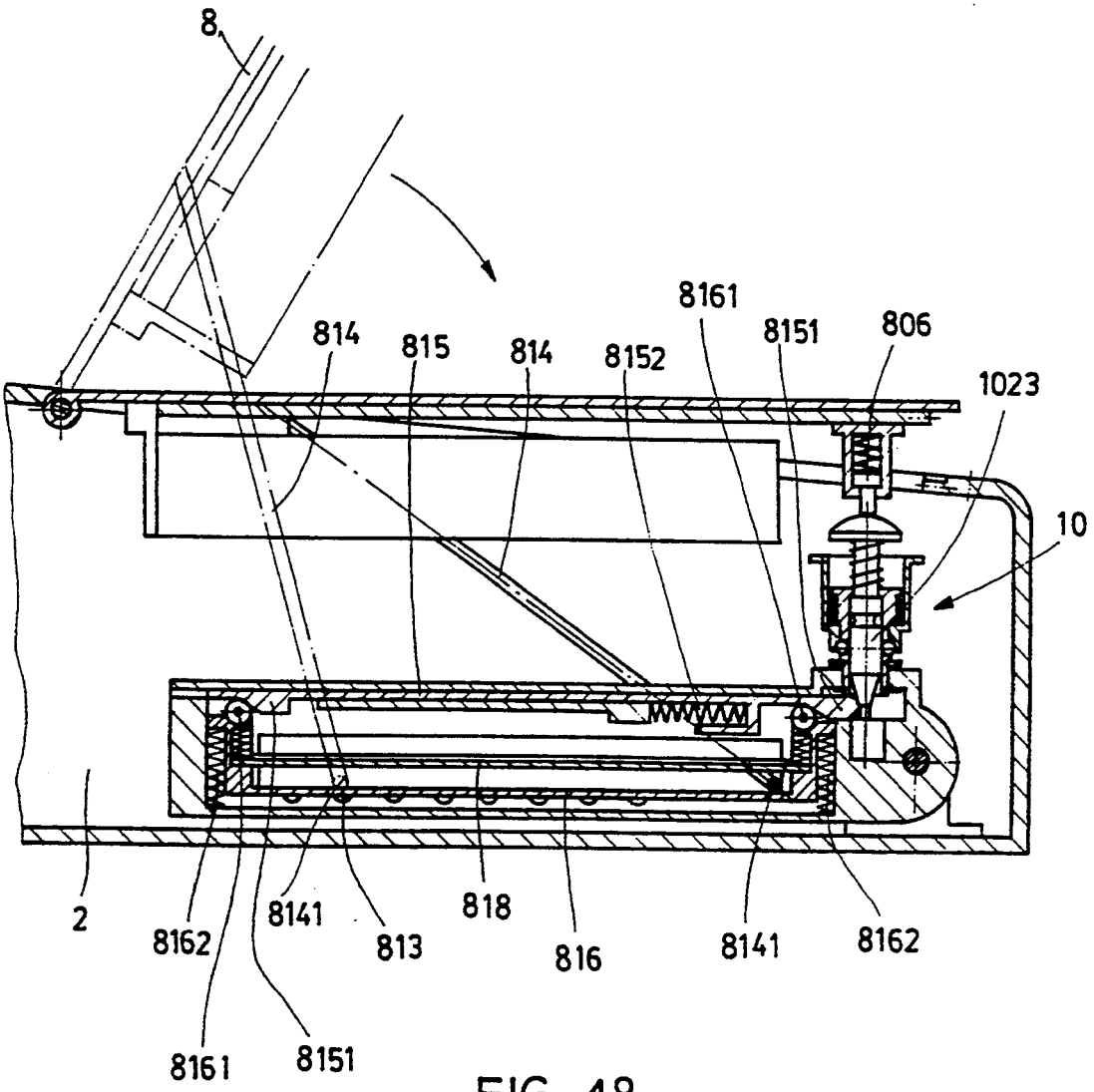
FIG. 48 is a sketch view showing the operation of a pedal in an adjusting table.

As shown in FIG. 48, when the pedal 8 is to retract into the rear housing 2. The transverse lever 8141 shall be released from the positioning slot 813 firstly. In light of this, the positioning device 10 is adjusted to open. Then the central post 102 floats up, the retaining plate 815 moves right as actuated by a spring member 8152. The block 8151 moves to the right position and the roller 8161 of the U-shape bracket 816 is released therefrom. Then the bracket 816 moves upward from the bottom of the positioning slot 813 to release the bracket 814 from the positioning slot 813 and slides to front position. Besides, when the pedal 8 is covered to the rear housing 2, the elastic post 806 will press down the central 1023 to close it. That means the central post 1023 is moved downward to move the retaining plate 815 to left position. Again the U-shape bracket 816 is pressed to the bottom of the positioning slot 813, as shown in FIG. 47, then the pedal 8 is retracted fully in the rear housing.

Figure 50:
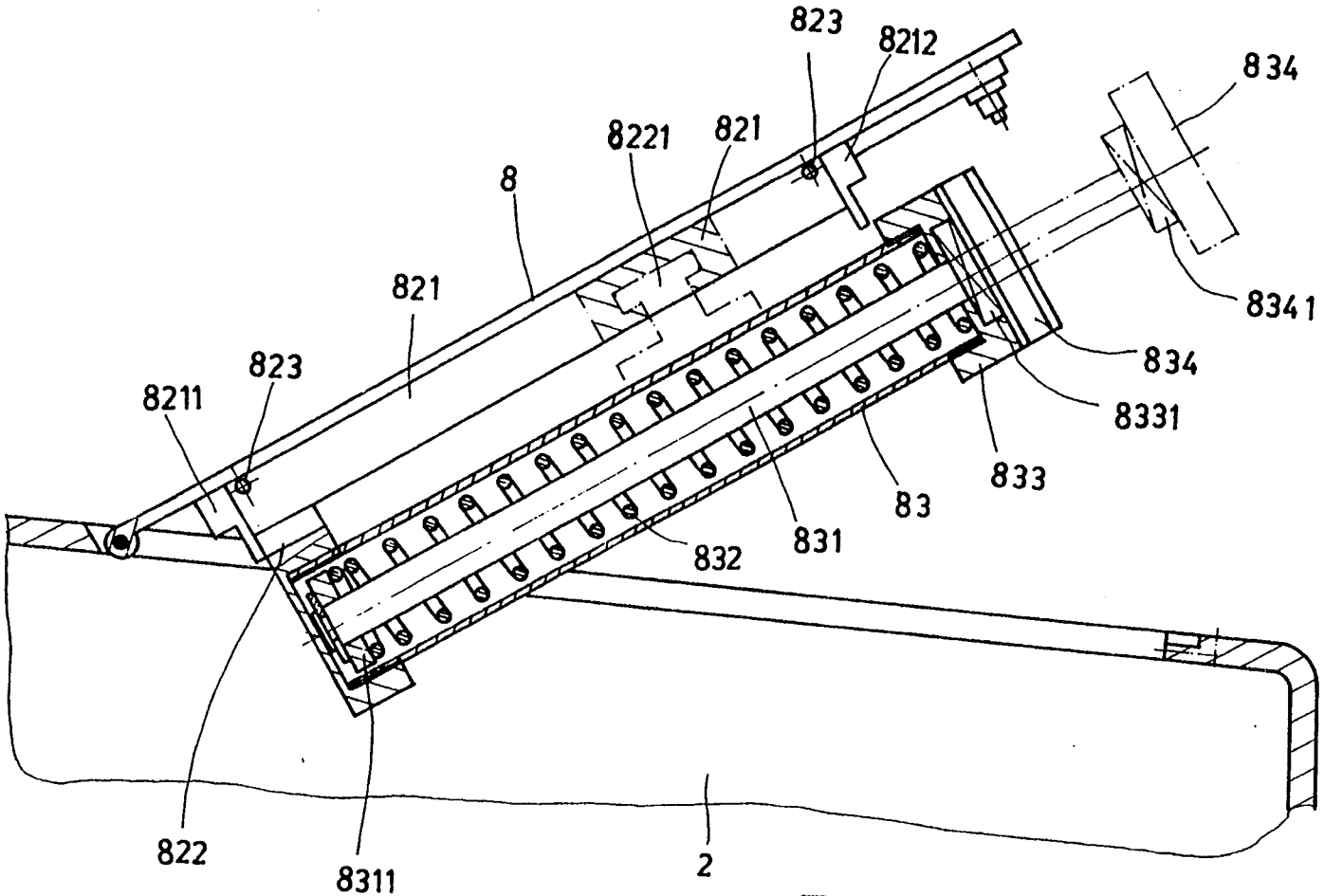
FIG. 50 is a cross sectional view of a pedal and tube.
Figure 51:
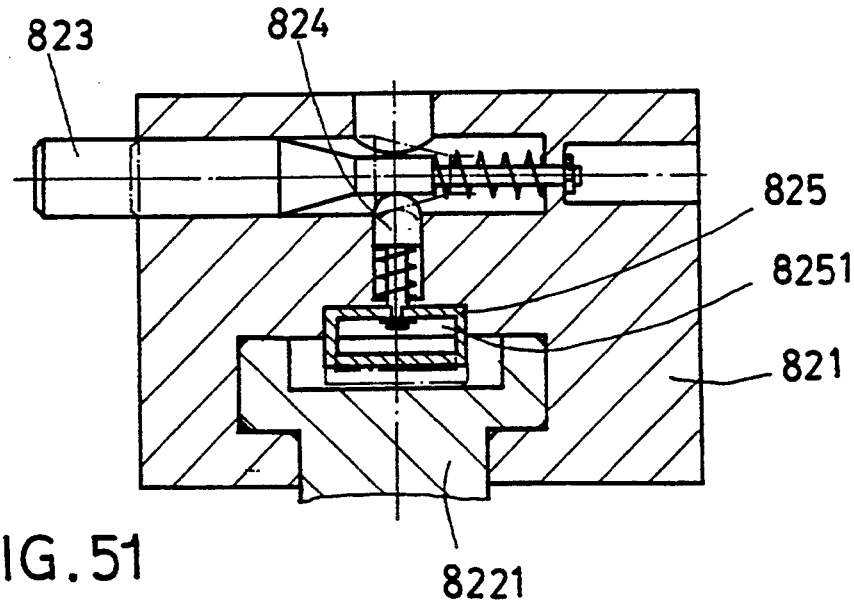
FIG. 51 is a cross sectional view of a sliding rack.
Figure 52:
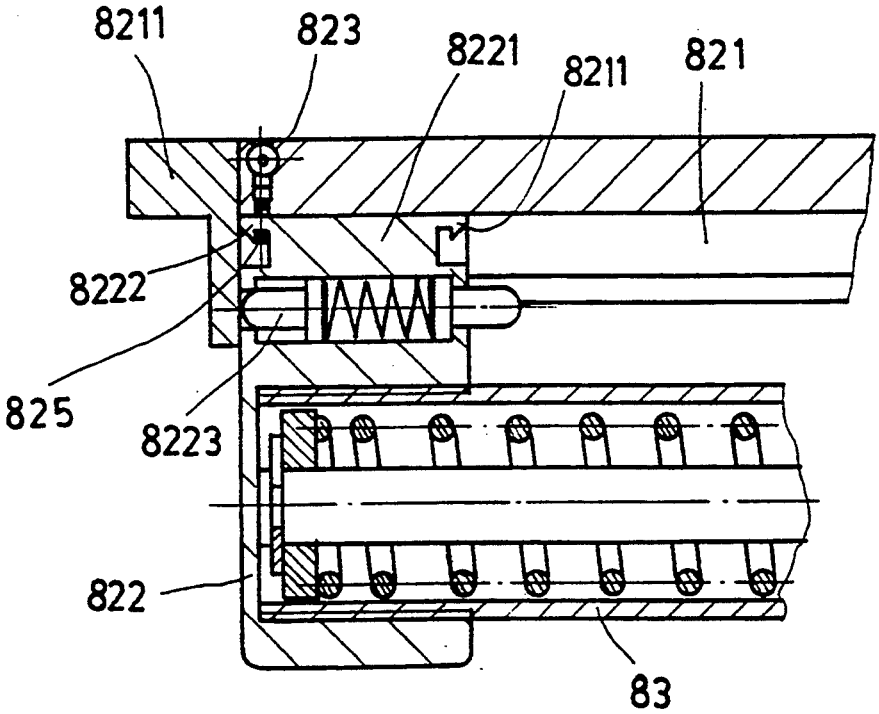
FIG. 52 is a cross sectional view showing a sliding housing and sliding rack.

Referring to FIG. 50, a rail 821 is provided at the bottom of the pedal 8 and the rail 821 is same with the rail of the storage box 7, rail 707 as shown in FIG. 35. A sliding housing 822 is slidable on the rail 821 by means of a T slot 8221. A retaining lever 823 is provided at side to control the sliding housing 822, as shown in FIGS. 51 and 52. When the retaining lever 823 is not pressed down, the positioning body 824 will pull up the clip ring 825. Then, the slot hole 8251 of the clip ring 825 is extended to the rail 821. By this arrangement, the hookers 8221, 8222 with inclined surface of the T slot 821 is engaged with. When the sliding housing 822 is positioned to the lower plate 8211 of the rail 821, the elastic boss 8223 is pressed to retract. When the retaining lever 823 is pressed, the clip ring 825 is open. The sliding housing 822 is moved by means of spring force of elastic boss 8223, consequently, the hooker 8212 is released from the clip ring 825. Then it can easily move to the upper plate 8212. The configuration of it is same with the configuration disclosed in FIGS. 35 to 41, no further description is given.

The sliding housing 822 is provided with a tube 26 parallel with the rail 821. A lever 831 and spring member 832 are provided thereof. The bottom of the spring member 832 is pressed to the boss 8311 of the lever 831. Then the lever 831 is provided with a force. A lid 833 is provided above the tube 83. This lid 833 is provided with a rectangular slot 8331. A housing 834 is disposed at the lever 831 on the portion extended above the lid 833. A rectangular boss 8341 of the housing 834 can be received by the rectangular slot 8331 to position the housing 834. The housing 834 can be lifted and turn ninety (90) degrees, then retained by the rectangular slot 8331 to change the direction of the housing 834.

Figure 53:
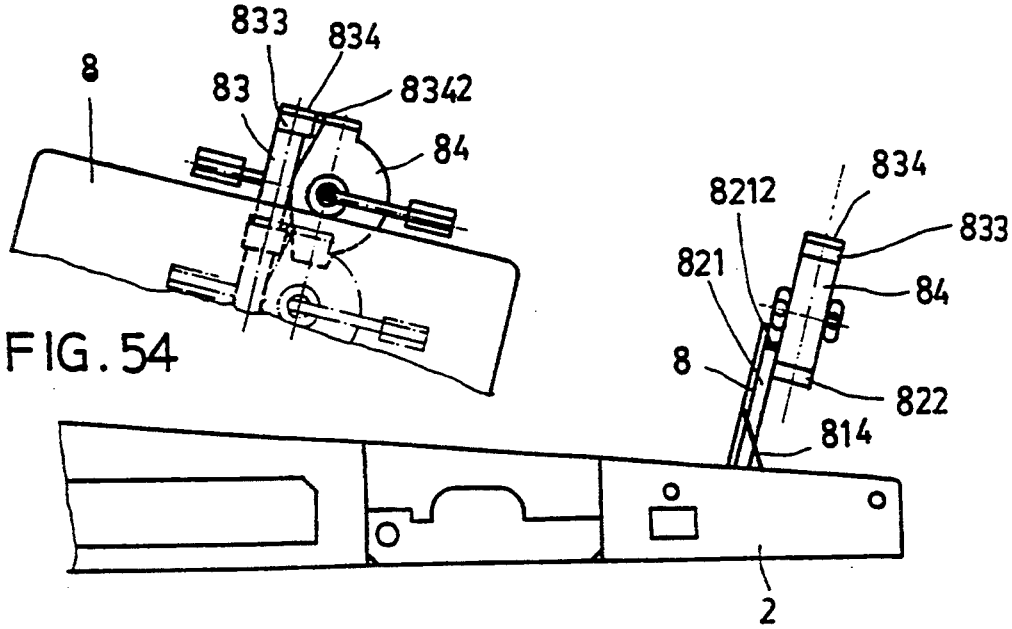
FIG. 53 is a side elevational view showing the pedal member erected from the rear housing.

As shown in a side view of FIG. 53, and a rear elevational view of FIG. 54, when the pedal 8 is erected and supported by the U-shape bracket 814, the tube 83 can moves upward. Then the sliding housing 822 moves from the lower end plate 8211 (as shown in FIG. 52) to the upper end plate 8212 and be fixed thereof. A hinge member 8342 is disposed at side of the sliding housing 834. This hinge member 8342 is connected with a controller 84. When the controller 84 is not in use, it is stored at side of the tube 83 and stored in the bottom side of the pedal 8.

Figure 55:
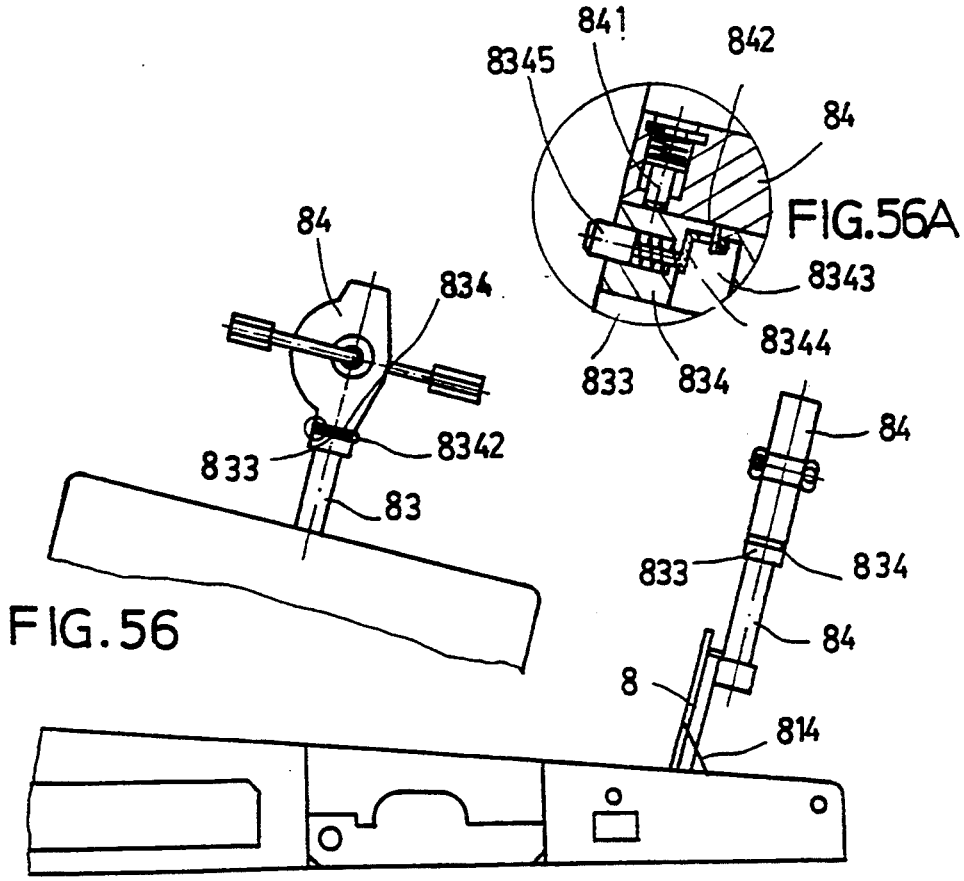
FIG. 55 is a sketch view showing a controlling means erected from the rear housing.

Referring to FIGS. 55 and 56, a retaining slot 8343 is provided at the housing 834. A clip ring 8344 is disposed within the retaining slot 8343 and the ring 8344 is controlled by an elastic knob 8345. An elastic post 841 is provided at the bottom edge of the controller 84 and a hooker 842 is provided with respect to retaining slot 8343. When the controller 84 is positioned after turning one hundred and eighty (180) degrees, the hooker 842 engages with the clip ring 8344 of the retaining slot 8343. When the controller 84 returns to its original position, only need to press down the knob 8345, then the hooker 842 is released from the clip ring 8344. By means of the spring force of the elastic post 841, the hooker 842 is then released from the retaining slot 8343.

Referring to FIGS. 55 and 56, the controller 84 is positioned to the housing 834 and not in use. As shown in FIG. 50, a rectangular boss 8341 is provided under the housing 834. This boss 8341 can change its direction within the rectangular slot 8331 of the lid 833, as shown in FIG. 57, when the bottom housing 834 is turned ninety degrees (90) on the lid 833, the controller 84 is tamed accordingly to a position for use.

Figure 57:
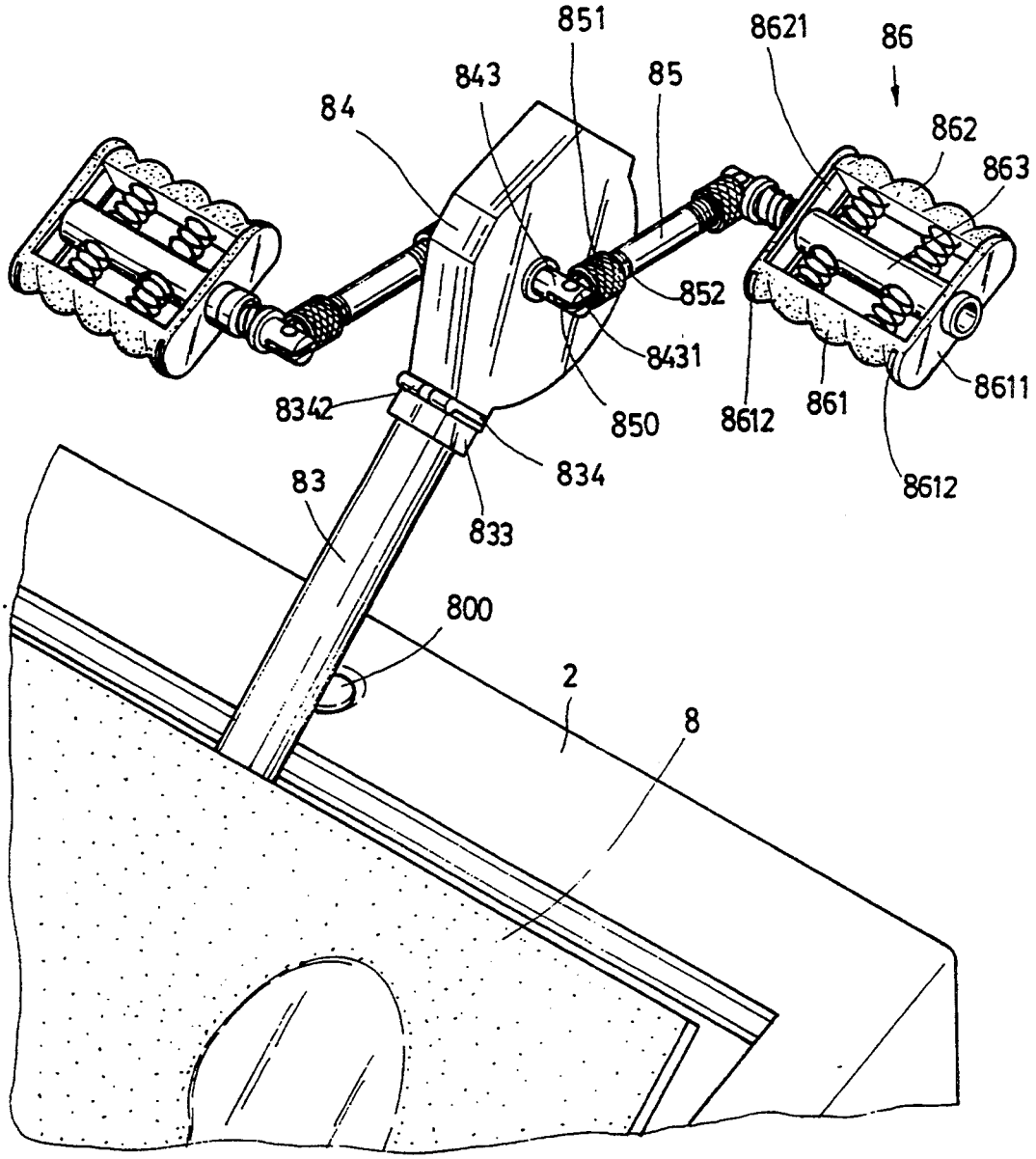
FIG. 57 is a perspective view showing a pedal in a fully extended position.
Figure 58:
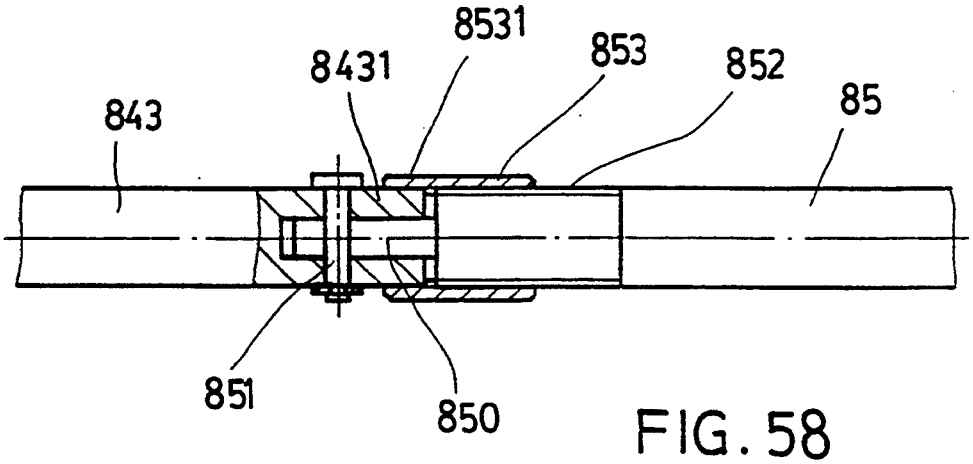
FIG. 58 is a top plan view of a rotating tube and an auxiliary tube.
Figure 59:
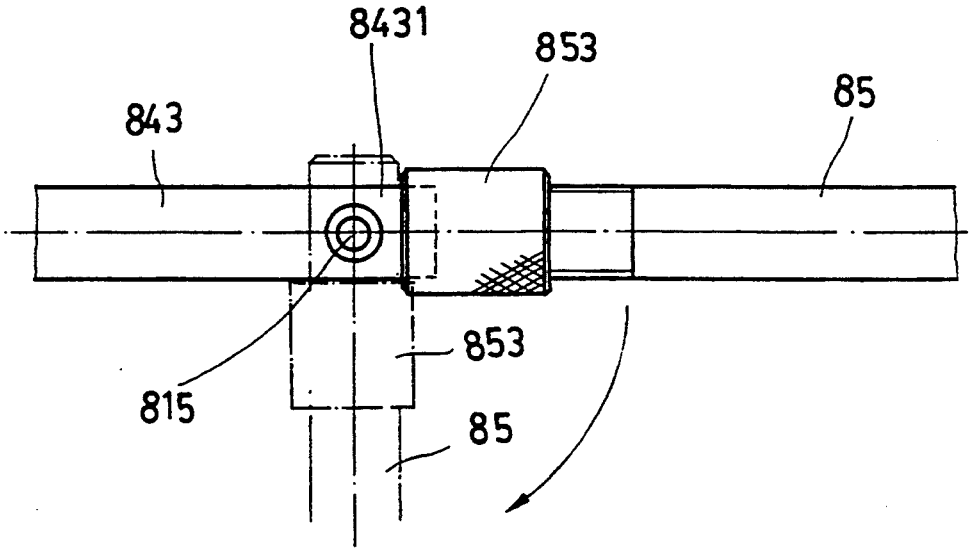
FIG. 59 is an assembled view of a rotating tube and an auxiliary tube.

As shown in FIG. 57, a shaft member 843 is provided at side of the controller 84. A connector 8431 is provided to the shaft member 843. The connector 8431 is connected to a connecting portion 850 of an assistant lever 85 by a pivot member 851. As shown in FIGS. 58 and 59. A threaded portion 852 is disposed to both ends of the assistant lever 85. A sleeve 853 is enveloped to the threaded portion 852. When the front portion 8531 of the sleeve 853 moves to the connecting portion 8431 of the shaft member 843, the assistant lever 85 is fixed horizontally. When the sleeve 85 presses against to the outer portion of the connector 8431, the assistant lever 85 and shaft member 843 is fixed vertically. By changing the position of the assistant lever 85 and shaft member 843, another pedal 86 can be adjusted as well. No detailed description is given.

Figure 60:
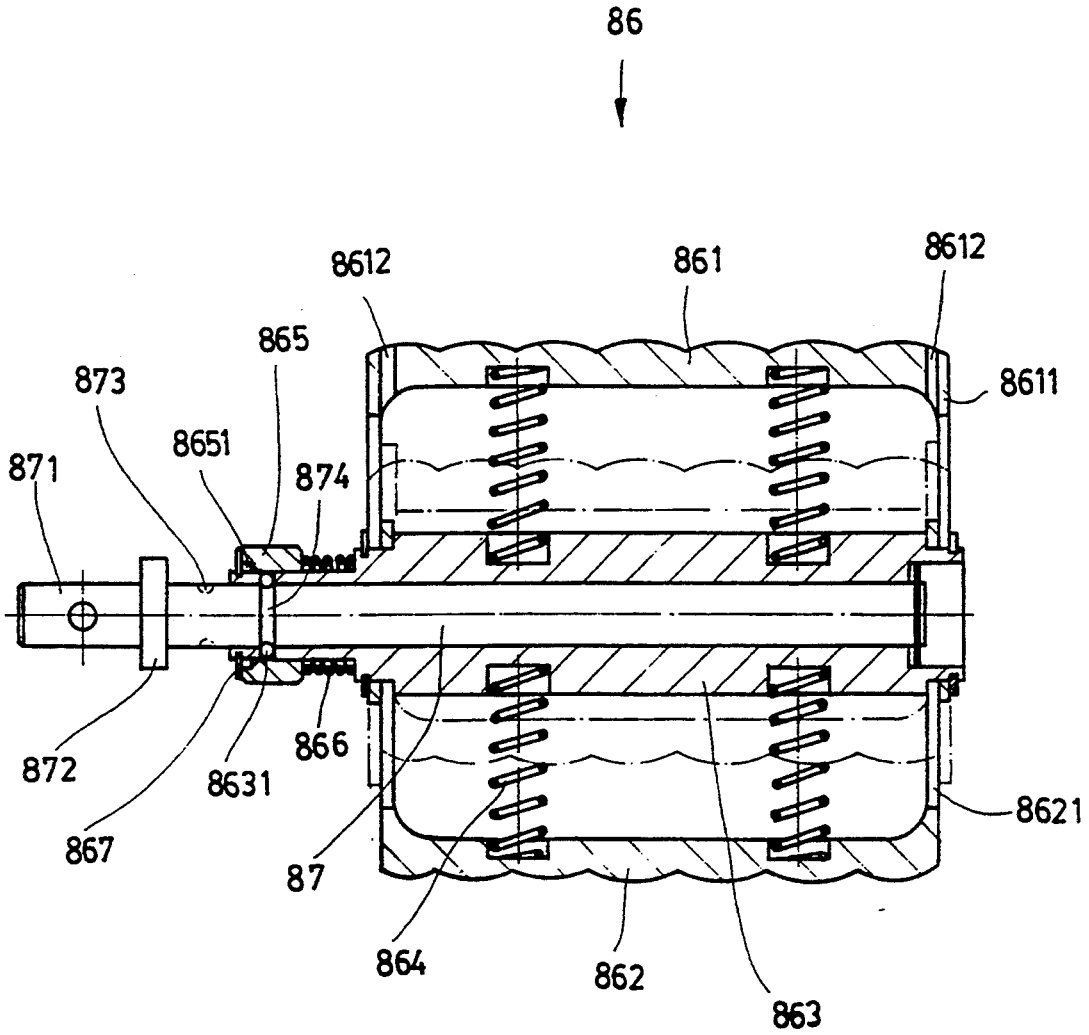
FIG. 60 is a cross sectional of a pedal member.

As shown in FIG. 86, the pedal 86 is constructed by a pair of U-shape elastic body 861, 862. The wider body 861 is provided with a slot hole 8612 at its outer wall 8611, the outer wall 8621 narrower body 862 is disposed to the inner side of the body 861. By this arrangement, these two body 861,862 can be pressed. Besides, the inner wall 8621 is slidable on the slot hole 8612. On the other hand, those two elastic body 861,862 are disposed on a sleeve member 863 and a spring member 864 is disposed therebetween to restore those two body 961,862 to the original position after the applied for is released. The sleeve member 863 is enveloped to a shaft member 87 which is connected to the connector 850 of the assistant lever 85 by a connector 871. The positioning movement will not be described. A positioning boss 872 is provided at the shaft member 87 and a symmetrical cavities 873 and annual slot 874 are disposed adjacent to the boss 872. Each of those cavities 873 receives a ball 8631 which is positioned by a sliding sleeve 865 of the sleeve 863. A spring member 866 is pressed against the inner side of the sliding sleeve 865, then the sliding sleeve 865 is rest on a C-clip 867. Besides, a slot 8651 is disposed at outer side of the sliding sleeve 865. As shown in FIG. 60, the sleeve 863 is rotatable on shaft member 87.

Figure 61:
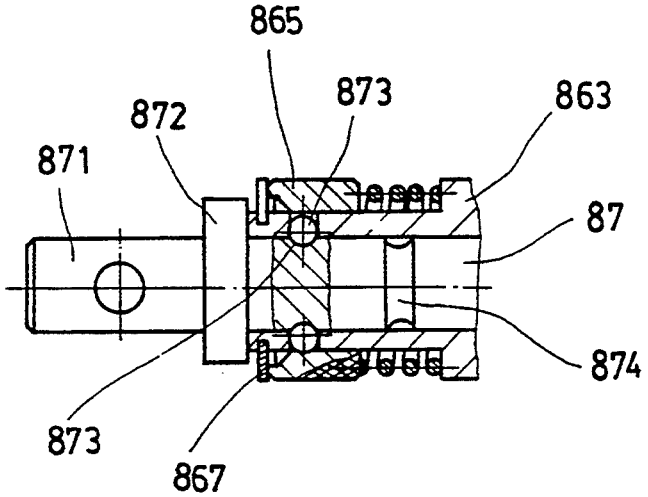
FIG. 61 is a top plan view of a retaining device for pedal member in a retracted position.

As shown in FIG. 61, when the shaft 863 moves close to the boss 872, the ball 8631 is pressed within the cavity 873. Then the sleeve 863 is retained to the shaft 87 and can not rotate thereof. That means, the pedal 86 is fixed and can not rotate.

Figure 63:
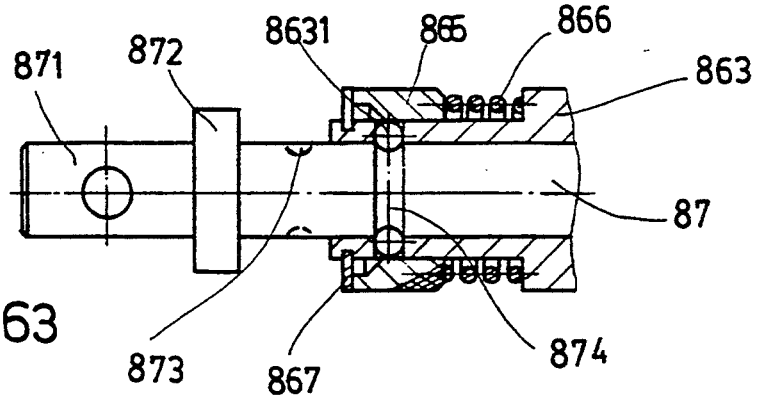
FIG. 63 is a top plan view of a retaining device for pedal member in a second extended position.

As shown in FIG. 63, when the sleeve 863 moves the ball 8631 to the annual slot 874, then release the sliding sleeve 865 and the spring 866 will move the sliding sleeve 865 to the C-clip 867. Now, the ball 8631 is retained inside the annual slot 874. By this arrangement, the sleeve 863 is rotatable on the shaft member 87 and restore to the position shown in FIG. 60.

From the above description, it can be easily understood the sporting equipment made according to this invention can be modified to a running equipment, ski equipment, rowing equipment, bicycle, wrist training equipment, leg training equipment and waist twisting equipment. Each of these equipment will be described below.

Figure 64:
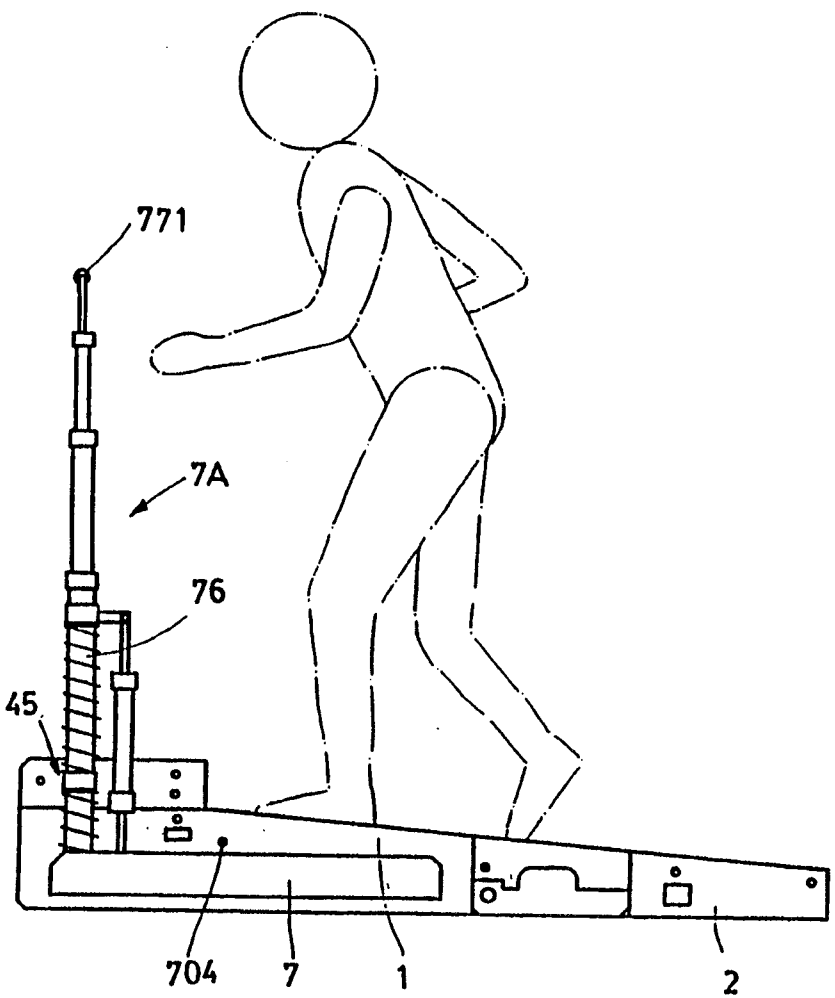
FIG. 64 is a first embodiment showing a running equipment modified from the multi-functional sporting equipment.

As shown in FIG. 64, when the rear housing 2 extends horizontally, a running equipment is formed, such as shown in FIG. 1. This is the basic functions. If the user hopes to have more training items, the knob 704 can be pressed to erect the storage box 7 from the front housing 1 and the retractable tube 7A can be erected from the storage box 7. Then the sporting equipment of this invention construct a configuration shown in FIGS. 35, 36 and 37. When the retractable tube 7A is stored, it lies in the storage box 7 transverse, as described above. The retractable tube 7A can be pulled out from the storage box 7 and connect it to the lug 45 of the sliding housing 4 by the retaining plate 7831, as shown in FIG. 35A. Then the retractable tube 7A can be fixed to a vertically, as shown in FIG. 64. In normal, the running equipment modified from this invention does not need this retractable tube 7A disposed vertically. But the older proper may need this to support them. Besides, the retractable tube 7A can adjust it height by the positioning hole 776 of the outer rectangular tube 76, as shown in FIG. 43. On the other hand, the distance and load can be adjusted, as shown in FIGS. 6 and 7, a connecting means 5 and controller 50 can be attached and controlled by the control panel 41 of the sliding housing 4.

Figure 65:
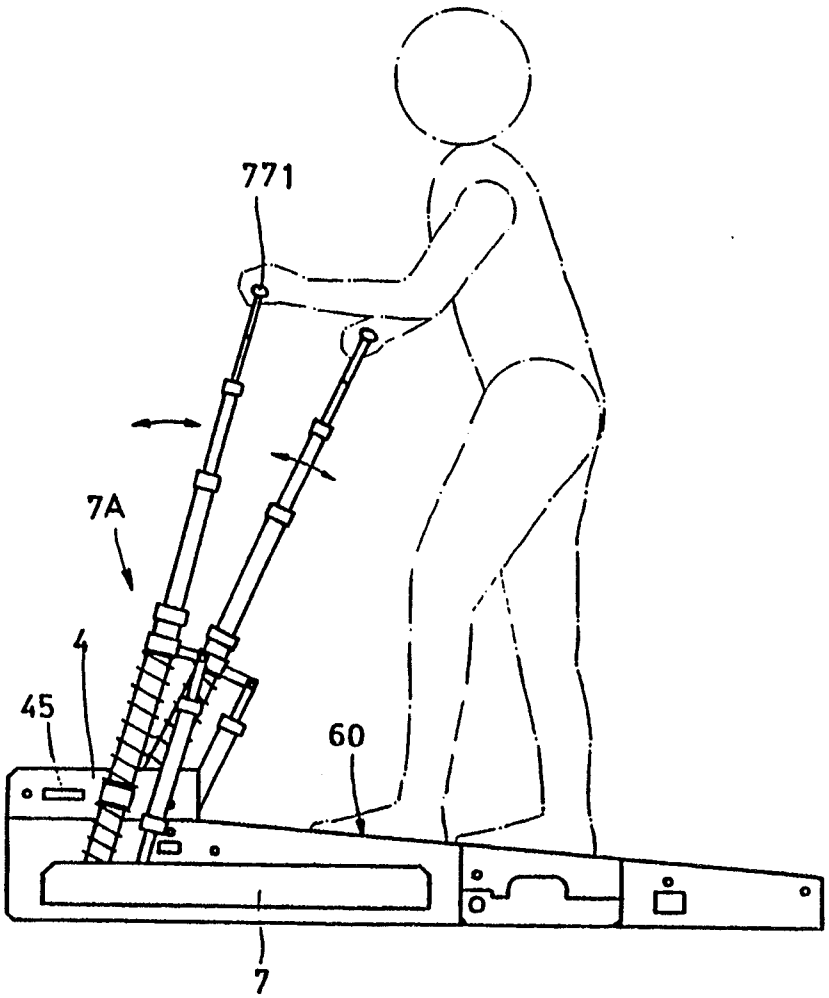
FIG. 65 is a second embodiment showing a ski equipment modified from the multi-functional sporting equipment.

As shown in FIG. 65, if the lug 45 of the sliding housing 4 does not extend outward to engage with the retaining plate 7831 of the retractable tube 7A, the retractable tube 7A can be supported and centered by the U-shape housing 72, shown in FIGS. 35 to 37 and moves back and forth. By this arrangement, the user can step on the running belt 60 and hold on the lever 771. In light of this, a ski equipment is modified from this invention.

Figure 66:
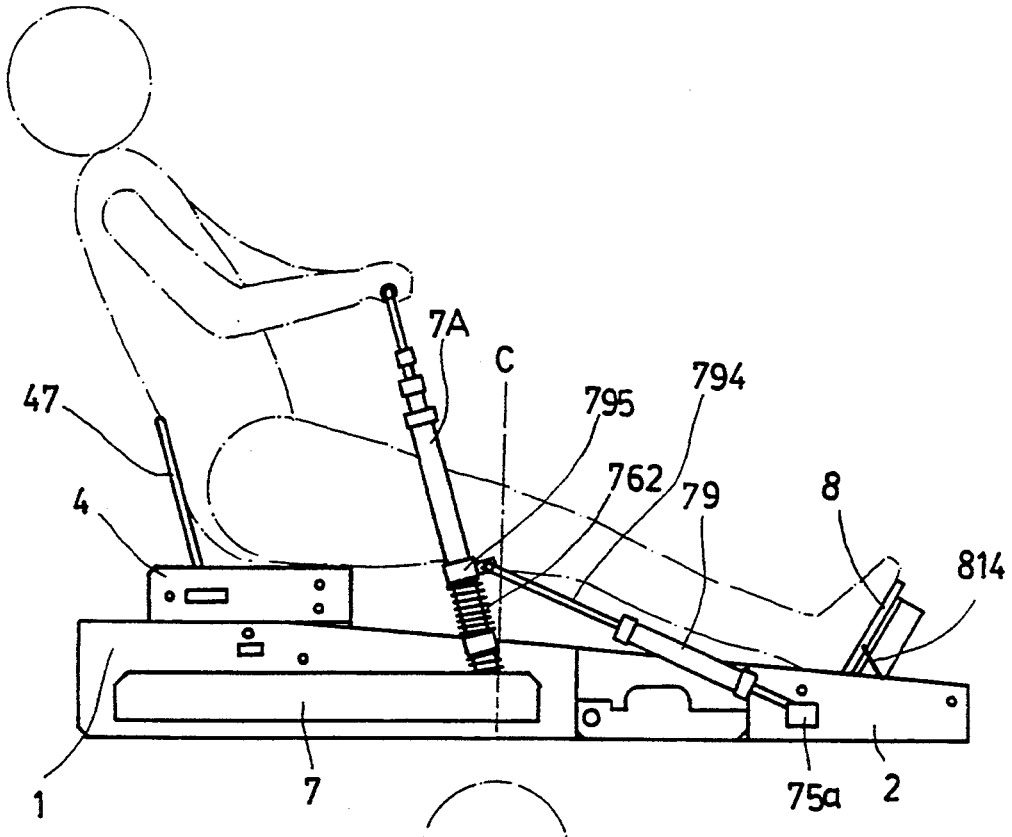
FIGS. 66 and 67 is a third embodiment showing a rowing equipment modified from the multi-functional sporting equipment.
Figure 67:
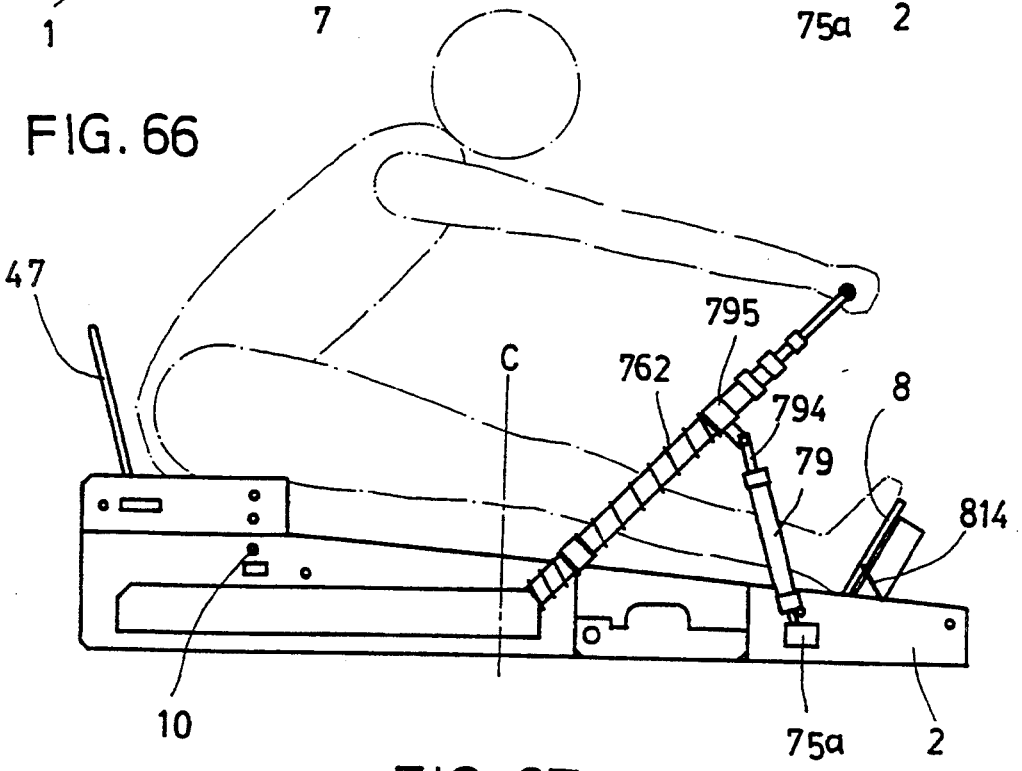

As shown in FIGS. 66 and 67, while the retractable tube 7A is erected from the storage box 7, the retaining housing 793 of the cylinder 79 is pulled out from the retaining slot 75, as shown in FIG. 35. Then the retaining housing 793 is engaged with the retaining body 75*a* of the rear housing 2, as shown in FIG. 45. The shim 47 of the sliding housing 4 is erected to vertical position to serve as a back support. Then the positioning device 10 is released and the sliding housing 4 is slidable within the slot 143, as shown in FIG. 27. Besides, when the pedal 8 is pulled up and supported by the U-shape bracket 814 and it can be fixed to a suitable angle, as shown in FIGS. 47 and 48. In this arrangement, the sporting equipment is modified to a rowing equipment and the user can perform a rowing movement thereon. While the retractable tube 7A is moved by the hand of the user, the ring member 795 disposed on the retractable tube 7A moves up and down according to the angular position of the retractable 7A and the cylinder 79. The spring member 762 is also pressed by the ring member 795. When the retractable tube 7A is moved backward by the user, a load provided by the cylinder and spring member 762 will apply to the user. The load increases as the spring member 762 is pressed. The maximum load is reached when the retractable tube 7A achieves the center line C. This is identical to the real rowing. From this view point, the present invention is more practical.

Figure 68:
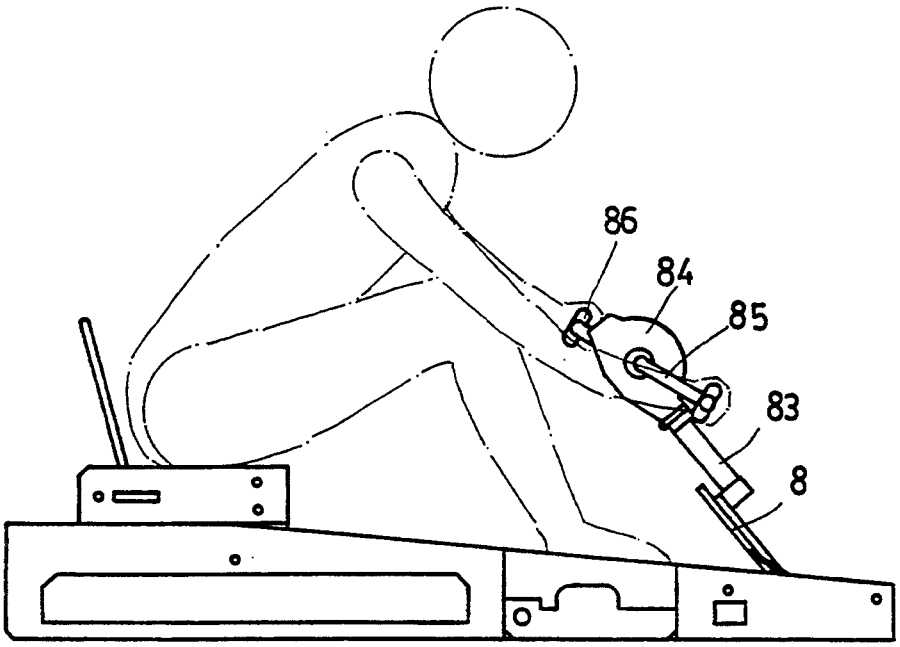
FIG. 68 is a forth embodiment showing a pedal equipment for hands modified from the multi-functional sporting equipment.
Figure 69:
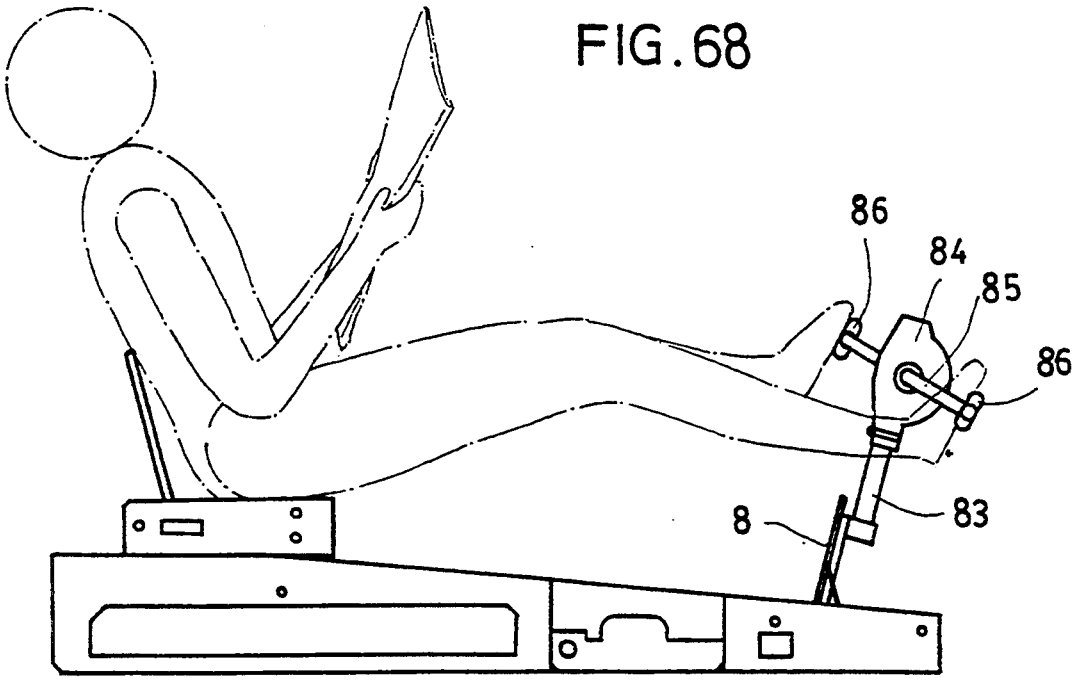
FIG. 69 is a fifth embodiment showing a pedal equipment for legs modified from the multi-functional sporting equipment.

Referring to FIGS. 68 and 69, when the tube 83 is pulled up from the bottom edge of the pedal 8 and the controller is adjusted to a suitable position, as shown in FIG. 57, the pedal 86 can be rotated both by hands and legs.

Figure 70:
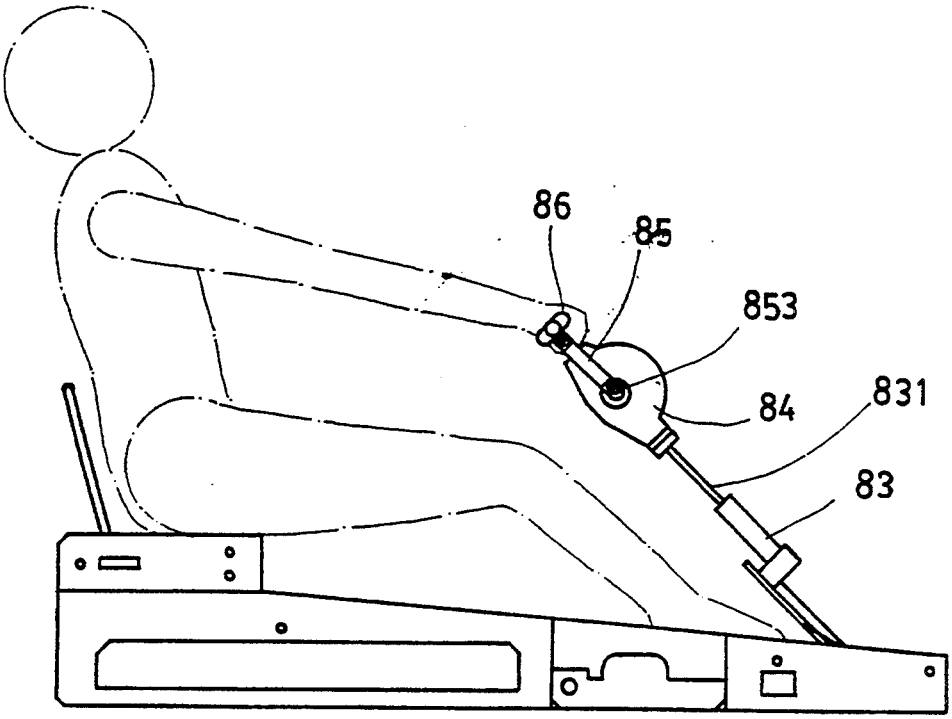
FIG. 70 is a sixth embodiment showing a stretching equipment for upper body modified from the multi-functional sporting equipment.

Referring to FIG. 70, the assistant lever 85 of the controller 84, as shown in FIG. 58 and 59, is adjusted by a sleeve 853. Then it can be adjusted to a parallel position. In this arrangement, the pedal 86 can be hold by both hands and the lever 831 of the tube 83, as shown in FIG. 50, provides a load by the spring member 832 disposed on the lever 831. Then the user can use it to stretch his arm.

Figure 71:
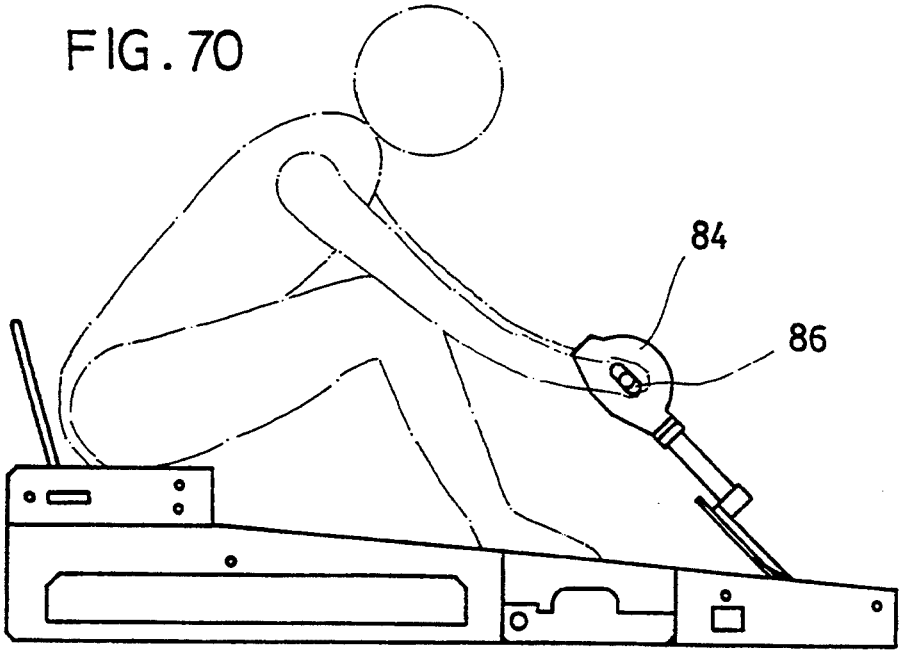
FIG. 71 is a seventh embodiment showing a grasping equipment for upper body modified from the multi-functional sporting equipment.

As shown in FIG. 71, the assistant robe 85 of the controller 84 can be adjusted to a horizontal position. In this arrangement, the pedal 86 serves as a grasp training equipment, as shown in FIG. 60, the pedal 86 is constructed by a pair of U-shape body 861,862. A spring member 864 is disposed therebetween. In light of this, it provides an excellent grasp training equipment.

Figure 62:
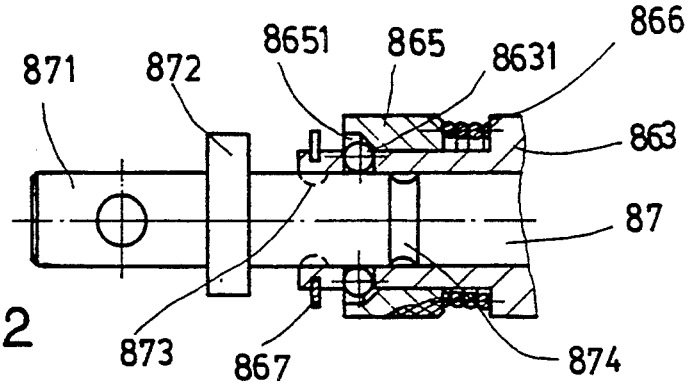
FIG. 62 is a top plan view of a retaining device for pedal member in a first extended position.
Figure 72:
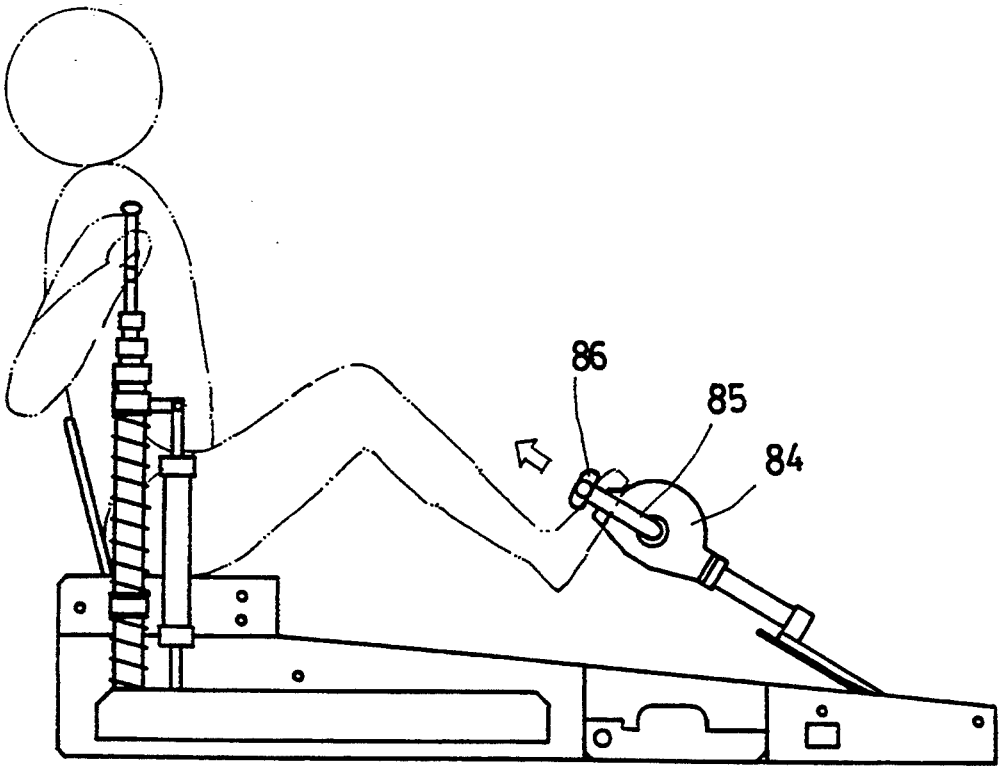
FIG. 72 is a eighth embodiment showing a pulling equipment for legs modified from the multi-functional sporting equipment.

As shown in FIG. 72, the pedal 86 can be constructed by the configuration shown in FIGS. 61 to 63, it can be adjusted to a stationary position which can not rotate. In this arrangement, the equipment can provide an excellent load to the leg. It serves an excellent leg training equipment.

Figure 73:
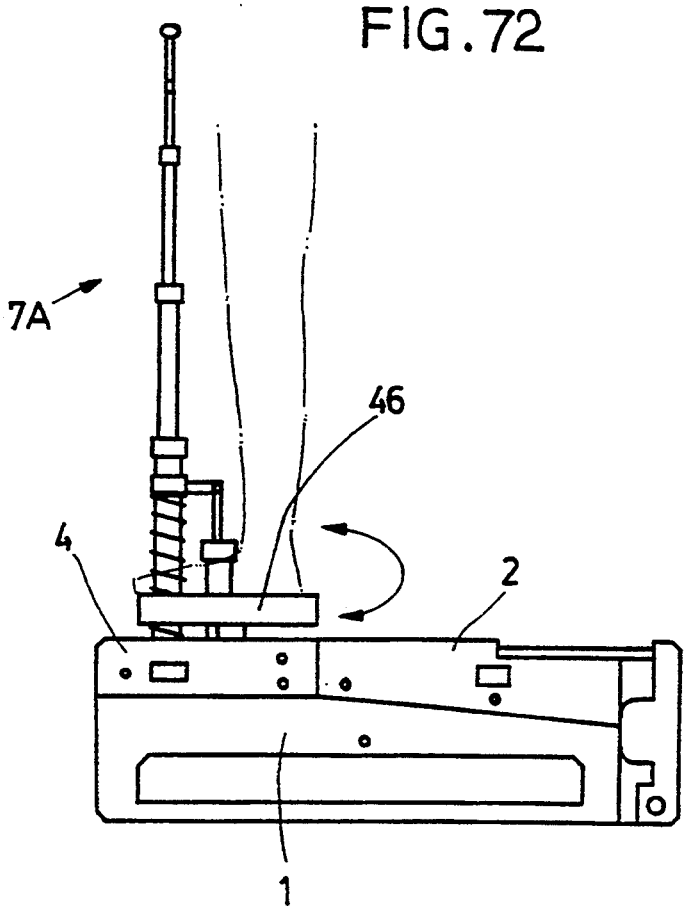
FIG. 73 is a ninth embodiment showing a twisting equipment for waist modified from the multi-functional sporting equipment.

As shown in FIG. 73, the sporting equipment can be arranged to a box while not in use. When the positioning device 10 is pressed, as shown in FIG. 30, the turntable 46 of the sliding housing 4 is released and lifted up. Then it can rotate freely thereof. In this arrangement, it serves an excellent waist training equipment. On the other hand, the retractable 7A can provide a support to the user.

The sporting equipment of this invention can be concluded to the following advantages.

1. A plurality training equipments are disposed and stored in a proper position of the housing. In light of this, no interference will raise when perform a single exercise. This is really a multi-functional sporting equipments.

2. The rear housing can be folded to a box. On the other hand, a cast and handle 191 are provided and the sporting equipment can be easily moved to proper position.

3. All the sporting equipment is incorporated with an actuating device 9 and positioning device 10. By this arrangement, the sporting equipment can be easily installed and retracted. No need to electricity or other power.

4. The installation of the sporting equipment is easily done by pressing the knob or positioning device. The user can easily perform these movement.

Although the present invention has been described in connection with preferred embodiments thereof, many other variations and modifications will now become apparent to those skilled in the art without departing from the scope of the invention. It is preferred, therefore, that the present invention not be limited by the specific disclosure herein, but only by the appended claims.

I claim:

1. A multi-functional sporting equipment system comprising:

a front housing having a front frame covered with a cover, said frame having a hollow portion therein for receiving a storage box, a recessed portion disposed at a rear portion of said front housing having a lug member;

a rear housing having a rear frame covered with a cover, said lug member disposed at a recessed portion of said rear housing;

a connecting lever disposed at an upper connecting portion of said recessed portions to connect the front housing and rear housing;

a pair of parallel juxtaposed supporting racks connected by said connecting lever at their middle portion, a plurality of rollers provided on said supporting rack, said supporting rack being attached to said front frame and said rear frame through a plurality of connecting shafts;

a bottom protecting cover disposed at a bottom of the connecting portion wherein when the rear housing is folded onto said front housing a protecting surface will be formed, said bottom protecting cover comprising a folded edge portion with a drive shaft comprising a gear disposed at a middle portion thereon, said gear being controlled by an actuating device installed in said rear housing, and said bottom protecting cover further comprising a hook portion at a top rear portion thereof;

a sliding block having a projected plate at its bottom edge, said projected plate extending into a slot formed in said front housing, said projected plate comprising an elongate slot being provided wherein a pin is inserted into the elongate slot through the slot of the front housing, a row of rollers disposed at the underside of the projected plate, the sliding block being movable on the front housing, the front housing further comprising a positioning hole provided at an upper position of the elongate slot of the projected plate wherein a positioning member can be inserted into the hole to adjust the position of the sliding block;

a pair of storage boxes disposed in a hollow portion on both sides of the front housing, a second hooking portion disposed at the upper portion of the storage boxes, said second hooking portion retained by a retaining plate which is disposed within a third housing and controlled by a knob, a row of teeth provided at the inner sides of the storage box, said teeth meshed with an actuating device when the storage boxes are stored, wherein said actuating device is rotated to reserve potential energy such that when the hooking portion is released from the retaining plate the potential energy released by said actuating device pushes said storage boxes to an erect position, said storage boxes comprising a dovetail slot on the bottom and a retractable tube disposed therein such that said retractable tube can be pulled up from said front housing; and, a pedal covered by the rear housing when the pedal is stored, the pedal being controlled by a knob having a cone surface disposed at the front portion of said housing, when the knob is pressed the cone surface of the knob presses a spring post to the left side to release a retaining post from a slot hole, the pedal supported by a pivoting ring member at its inner portion, an elastic post which is disposed at the front end portion pressed to a central post of a positioning device, the positioning device fixed to an adjusting socket which is disposed at the rear housing and pivoted to a bottom socket through a fourth shaft member comprising a U-shaped supporting bracket pivoted to the sides of the pedal.

2. The multi-functional sporting equipment system as recited in claim 1, wherein said actuating device comprises:

a gear having a stopper located at an inner rim portion, a projected block disposed at a front portion thereof and a first block located at a central hole formed therethrough;

a first actuating member sleeved on an inner portion of said gear, a second block located at a front portion thereof and a hole formed in the second block having a block therein:

a second actuating member having a hole formed therein with a key member at an inner rim portion, said second actuating member having a smaller diameter at a front portion aligned with the hole of the first actuating member, a rib portion being provided thereon;

a shaft member for receiving the gear, the first actuating member and the second actuating member, the shaft member being disposed on a positioning plate within the housing;

a coiled spring member attached to the shaft member at a first end and a second end being attached to the positioning post of the gear; and, a spring member disposed at an outer side of said second actuating member, said spring member being fixed to said shaft by a C-shaped clip received in a ring slot, said spring member providing a biasing force to said second actuating member.

3. The multi-functional sporting equipment system as recited in claim 1, wherein said positioning device comprises:

a tube member disposed at a positioning member, a plurality of holes provided at a middle portion thereof for a steel ball, and a post member having a projected edge portion;

a central post member received by said tube member, an annular portion provided at the outer wall for receiving the ball, said post member having a projected edge portion, a spring member disposed within said projected edge portion biasing said projected edge of said tube member; and, an adjusting tube enveloping the outer wall of the tube member, a spring member disposed between the adjusting tube and said tube member having an inclined slot portion disposed at the front portion thereof.

4. The multi-functional sporting equipment system as recited in claim 1, wherein said actuating device comprises:

a sliding housing having a retaining slot slidable on the rail disposed at a bottom section, a hooker and an elastic boss disposed at a rear portion of the retaining slot, the sliding housing having a connecting rib at an upper portion and a hole disposed therein for receiving a shaft;

a U-shaped housing, a rectangular hole and a hole being disposed separately on the sides of the U-shaped housing, a pair of lugs which are parallel to each other being disposed at a bottom portion, said lugs engaged with the rib and positioned by a shaft member;

a central shaft having a threaded portion at a tip end and a rectangular block at a rear portion, the rectangular block received by the rectangular hole of the U-shaped housing, an oval adjusting knob locked to a threaded portion thereof to adjust the tightness of the U-shaped housing;

a rotating body having a hole formed therein, said rotating body being fixed to the U-shaped housing by means of a lever member, a pair of lining plates disposed at the sides of the rotating body, the rotating clearance of the rotating body adjustable by the adjusting knob disposed at the side of U-shaped housing, a connecting boss provided at an upper portion of the rotating body which has a threaded hole and screws insertable within said side portions;

a retaining slot body having a rectangular hole enveloped about the connecting boss and a retaining slot with a rectangular slot provided therein, a clip ring inserted therein, a positioning body being used to fix the clip ring through the bottom of the retaining slot, said positioning body passing through a hole of the clip ring and positioned by a C-shaped clip, the clip ring being retained inside the retaining slot for positioning the hole above the retaining slot for engagement with a hooker;

an outer rectangular tube having a hole formed in a side in cooperation with the threaded hole of the connecting boss, said tube enveloped to the boss and retained therewith by a screw member, the retaining slot enveloped about the connecting boss, a spring member provided at a peripheral surface;

a plurality of retractable tubes telescopically disposed within the outer rectangular tube, an upper circular lever received within the upper retractable tube, the circular lever being removable and a second tube attached to a bottom of the tube wherein when the upper lever is removed reversible rotation is provided;

a tube enveloping a lower portion of the outer rectangular tube, an upper portion of the tube having a folded flange, a spring member at the circumference of the tube and in biasing contact with a movable ring thereunder, a retaining plate externally disposed thereof connected with the lug extending from the sliding housing to secure the retractable tube;

a cylinder disposed at one side of the retractable lever, a connecting portion being provided at a lower portion thereof and a U-shaped housing connected thereto, said U-shaped housing pivoted to a retaining housing, a retaining slot formed at the bottom of the retaining housing, a retractable piston provided above the cylinder, a pivoting portion being pivoted to a lug member of the ring member located above the retractable tube, the piston located internal the cylinder and an anchoring plate at the lower portion of the tube, a spring member for slidable displacement of the piston.

5. The multi-function sporting equipment system as recited in claim 1, where a U-shaped slot is provided in the rear housing, a U-shaped frame received by said slot, end portions of the U-shaped frame extending into the housing and a gear meshed to an actuating device disposed on said frame.

6. The multi-functional sporting equipment system as recited in claim 1, including a retaining slot body located at side surfaces of the rear housing, said retaining slot body connected by a row of teeth, said teeth meshed with said actuating device and slidable within the sliding slot, a hooker provided at an inner side of the retaining slot body controlled by a knob disposed thereabove.

7. The multi-functional sporting equipment system as recited in claim 1, including a positioning device disposed at a recessed arc portion formed in a side of the rear housing, a retaining plate disposed at a front portion of the central post of the positioning device, two cavities formed in the retaining plate, a slot portion formed at the rear portion of the rear housing, a positioning block disposed at said slot portion, a pushing lever disposed internal the positioning block, a spring member disposed at a middle portion of the pushing lever, a recessed portion for receiving a cast installed at a rear end thereof, a hooking lever disposed parallel with the pushing lever, a hooker provided at the front portion of the hooking lever, a sliding slot at said front housing with respect to the slot of the rear housing, a sliding block disposed therein, a cast disposed at the front portion of the sliding block and a spring member disposed at the rear end, a retaining hole formed at the center portion thereof, the hooker of the hooking lever in engagement with the sliding block to connect the front housing and rear housing.

8. The multi-functional sporting equipment system as recited in claim 1, including an elastic boss having a retaining slot disposed at a rear portion thereof located at said rear housing, said retaining slot engageable with the inclined retaining block.

9. The multi-functional sporting equipment system as recited in claim 1, including a retractable lug member located at the sliding housing, each lug member provided with a recessed portion and a row of teeth formed thereon, the lug member being oppositely located to the teeth and an actuating device disposed between said teeth.

10. The multi-functional sporting equipment system as recited in claim 1, including a turntable disposed at the sliding housing, said turntable being fixed by a positioning device installed on one side of the sliding housing, a housing being provided at the sliding housing, a lifting block being installed within the housing and a spring disposed between the lifting block and a rotating sleeve disposed above the lifting block, said rotating sleeve contacting the upper portion of the sliding block through a steel ball interface, the turntable being fixed to the upper portion of the rotating sleeve through a shaft member, the rotating sleeve rotating freely above the lifting block, a stopper provided at the outer circumference of the housing and an elongate end portion provided at the rotating sleeve and a spring member disposed between the turntable and the housing.

11. The multi-functional sporting equipment system as recited in claim 1, including a rail located at the underside of the pedal for slidably receiving a T-slot thereof.

12. The multi-functional sporting equipment system as recited in claim 1, including a tube located parallel with the rail for slidable displacement within a T-slot and an extended lever and a spring disposed within the tube, a bottom surface of the spring in contact with a boss of the extended lever to provide a force to the extended lever, a lid located above the tube, the tube having a rectangular shape at an upper portion thereof, a housing disposed at an end of said extended lever which extends to the upper portion of the lid, a rectangular body engaged in said rectangular slot located at the lower portion of the housing to position the housing, the housing being lifted and rotated by approximately ninety degrees for seating in the rectangular slot.

* * * * *